US005250493A

United States Patent [19]

Ueda et al.

[11] Patent Number: 5,250,493

[45] Date of Patent: Oct. 5, 1993

[54] THERMOSENSITIVE RECORDING MATERIAL

[75] Inventors: Takashi Ueda, Numazu; Yasuhiko Watanabe, Shizuoka, both of Japan

[73] Assignee: Ricoh Company, Ltd., Tokyo, Japan

[21] Appl. No.: 796,390

[22] Filed: Nov. 22, 1991

[30] Foreign Application Priority Data

Nov. 22, 1990 [JP] Japan ..... 2-320245

[51] Int. Cl.[5] ..... B41M 5/28

[52] U.S. Cl. ..... 503/220; 503/200; 503/221; 503/226

[58] Field of Search ..... 503/200, 204, 221, 226, 503/220; 427/150-152

[56] References Cited

U.S. PATENT DOCUMENTS 3,843,384 10/1974 Adachi et al. ..... 503/204
4,748,148 5/1988 Kondo et al. ..... 503/220
4,939,116 7/1990 Ueda et al. ..... 503/204

*Primary Examiner*—Pamela R. Schwartz
*Attorney, Agent, or Firm*—Oblon, Spivak, McClelland, Maier & Neustadt

[57] ABSTRACT

A thermosensitive recording material having a support and a thermosensitive coloring layer formed on the support, which thermosensitive coloring layer includes at least a first thermosensitive coloring layer containing at least one leuco dye having formula (I), (II) or (III) and a color developer capable of inducing color formation in the leuco dye under application of heat thereto, and a second thermosensitive coloring layer containing at least one leuco dye having formula (IV) and a color developer capable of inducing color formation in the leuco dye under application of heat thereto. The leuco dye for use in the first thermosensitive coloring layer has the absorption intensity in the near infrared region, and the leuco dye for use in the second thermosensitive coloring layer has the absorption intensity in the visible spectrum.

8 Claims, No Drawings

THERMOSENSITIVE RECORDING MATERIAL

BACKGROUND OF THE INVENTION

1. Field of the Invention

This invention relates to a thermosensitive recording material, and more particularly to a thermosensitive recording material comprising a support and a thermosensitive coloring layer formed on the support, which thermosensitive coloring layer comprises at least a first thermosensitive coloring layer which comprises a leuco dye having absorption intensity in the near infrared region, and a second thermosensitive coloring layer which comprises a leuco dye having absorption intensity in the visual spectrum.

2. Discussion of Background

Conventionally, there is known a thermosensitive recording material, in which a thermosensitive coloring layer mainly comprising a thermosensitive coloring composition is provided on a support such as a sheet of paper and synthetic paper, or a plastic film. In such a recording material colored images are obtained by application of heat to the recording material using a thermal head, thermal pen, laser beam, and the like.

This kind of recording material has been widely utilized in various fields because of the following advantages over other conventional recording materials:

(1) image recording can be speedily performed, using a comparatively simple device without complicated steps for development and image fixing;

(2) the thermosensitive recording material can be produced and used without generating noise and causing environmental pollution; and (3) the manufacturing cost of the thermosensitive recording material is low.

Recently, an optical character reader and a bar-code reader have been developed and utilized increasingly. As a light source in such character readers, a light emitting diode or a semiconductor laser beam having a wavelength of 700 nm or more is conventionally used. However, leuco dyes such as fluoran-type leuco dyes and triphenylmethane-type leuco dyes for use in the conventional thermosensitive recording materials can hardly absorb the near infrared rays having a wavelength of 700 nm or more. Therefore the images formed on the conventional thermosensitive recording materials can be read by neither the optical character reader nor the bar-code reader.

Several proposals relating to the leuco dyes having absorption intensity in the near infrared region have been made, for example, as disclosed in Japanese Patent Publication 58-5940, and Japanese Laid-Open Patent Applications 59-199757, 60-230890, 62-106964, 62-243653, 62-257970, and 63-37158.

However, these leuco dyes having absorption intensity in the near infrared region have the shortcomings that the leuco dyes are colored or a color tone of the obtained images is not black.

Moreover, the above proposals also disclose that the conventionally used leuco dyes having absorption intensity in the wavelength of less than 700 nm, such as fluoran-type leuco dyes and triphenylmethane-type leuco dyes, are used in combination with the above-mentioned leuco dyes having absorption intensity in the near infrared region. In such a case, however, inconsistency of coloring sensitivity between in the visible spectrum and in the near infrared region is caused. In addition, the deterioration in the heat resistance of the thermosensitive recording materials induces the fogging of the background thereof.

SUMMARY OF THE INVENTION

It is therefore an object of the present invention to provide a thermosensitive recording material capable of producing images which can be read by a reader having as a light source a light emitting diode or a semiconductor laser beam having a wavelength of 680 to 1000 nm.

Another object of the present invention is to provide a thermosensitive recording material capable of producing clear black images, with the background of the recording material maintained white.

The above objects of the present invention can be attained by a thermosensitive recording material comprising (a) a support and (b) a thermosensitive coloring layer formed on the support, which thermosensitive coloring layer comprises at least a first thermosensitive coloring layer which comprises at least one leuco dye selected from the group consisting of leuco dyes having the following formulas (I), (II) and (III) and a color developer capable of inducing color formation in the leuco dye upon application of heat thereto, and a second thermosensitive coloring layer which comprises at least one leuco dye having the following formula (IV) and a color developer capable of inducing color formation in the leuco dye under application of heat thereto:

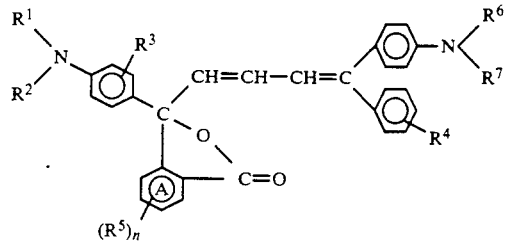

(I)

wherein $R^1$ and $R^2$ each represent a lower alkyl group having 1 to 8 carbon atoms, a substituted alkyl group having 1 to 8 carbon atoms, an aralkyl group which may have a substituent, or an aryl group which may have a substituent; $R^3$ represents hydrogen, a lower alkyl group having 1 to 8 carbon atoms, an alkoxyl group having 1 to 8 carbon atoms, or an aralkyloxy group; $R^4$ represents hydrogen, a lower alkyl group having 1 to 8 carbon atoms, an alkoxyl group having 1 to 8 carbon atoms, a halogen, or a dialkylamino group having 1 to 8 carbon atoms; $R^{56}$ represents hydrogen, a halogen, or a dialkylamino group having 1 to 8 carbon atoms; $R^6$ and $R^7$ each represent a lower alkyl group having 1 to 8 carbon atoms;

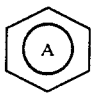

represents a benzene ring or a naphthalene ring; and n is an integer of 1 to 4;

(II)

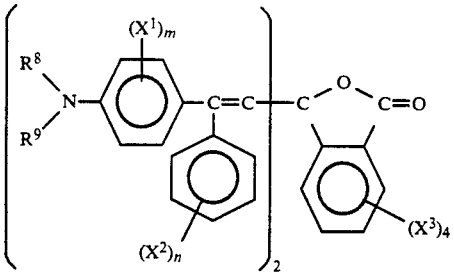

wherein $R^8$ represents an alkyl group having 8 carbon atoms or less; $R^9$ represents an alkyl group having 8 carbon atoms or less, a cycloalkyl group having 5 to 7 carbon atoms, or a benzyl group or a phenyl group which may have a substituent such as chlorine, bromine, or an alkyl group having 4 carbon atoms or less; $X^1$ and $X^2$ each represent an alkyl group having 8 carbon atoms or less, an alkoxyl group having 8 carbon atoms or less, fluorine, chlorine, or bromine provided that each $X^1$ may be the same or different and each $X^2$ may also be the same or different; $X^3$ represents chlorine or bromine; and m and n are integers of 0 to 3;

(III)

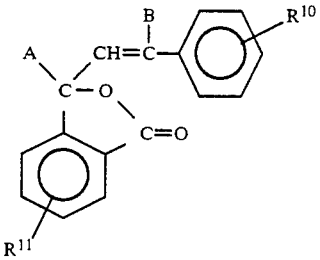

wherein A represents

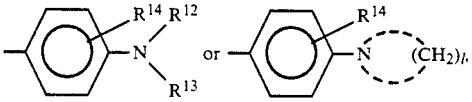

in which $R^{12}$ and $R^{13}$ each represent an alkyl group having 1 to 8 carbon atoms, a cycloalkyl group, or a benzyl group; $R^{14}$ represents hydrogen, an alkyl group having 1 to 8 carbon atoms, or an alkoxyl group having 1 to 8 carbon atoms; and l is an integer of 4 to 6, B represents

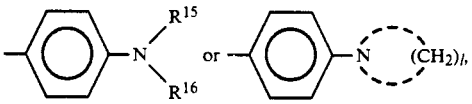

in which $R^{15}$ and $R^{16}$ each represent an alkyl group having 1 to 8 carbon atoms or a benzyl group; and l is an integer of 4 to 6, $R^{10}$ represents hydrogen, an alkyl group having 1 to 8 carbon atoms, a halogen, or a nitro group; and $R^{11}$ represents hydrogen, an alkyl group having 1 to 8 carbon atoms an alkylamino group having 1 to 8 carbon atoms, a dialkylamino group having 1 to 8 carbon atoms, a cyclic amino group, an amino group, or a halogen;

(IV)

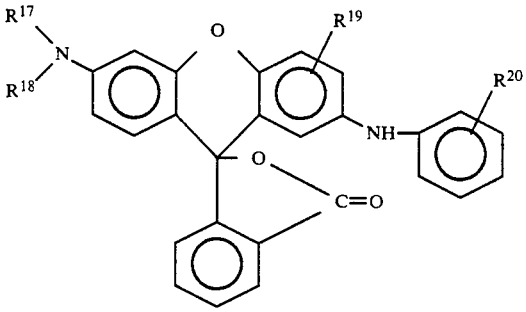

wherein $R^{17}$ and $R^{18}$ each represent a saturated or unsaturated hydrocarbon a group having 1 to 10 carbon atoms, which may be cyclic or non-cyclic, and may have an ether linkage; $R^{19}$ represents a hydrocarbon group having 1 to 2 carbon atoms or a halogen; and $R^{20}$ represents hydrogen, a halogen, or a hydrocarbon group having 1 to 6 carbon atoms.

DESCRIPTION OF THE PREFERRED EMBODIMENTS

Specific examples of the leuco dye having the above formula (I) for use in a first thermosensitive coloring layer in the thermosensitive recording material according to the present invention are as follows:

No. 1

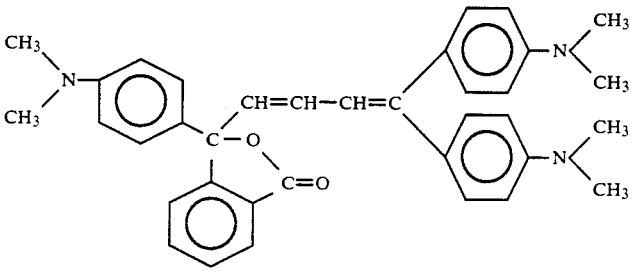

-continued
No. 2
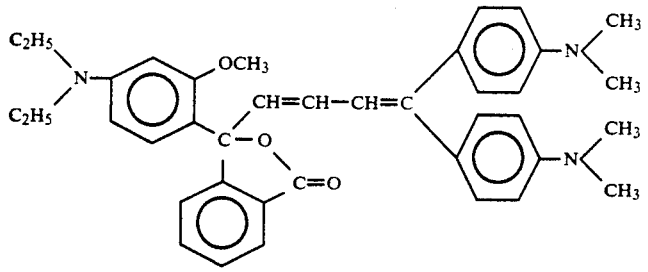
No. 3
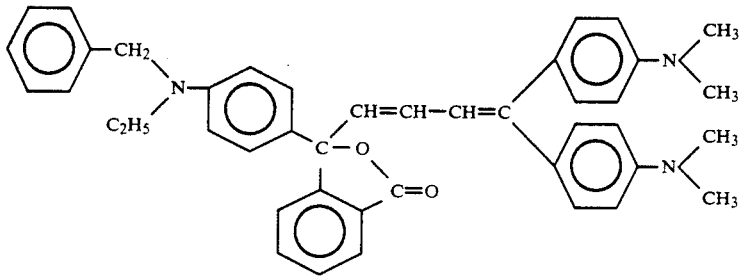
No. 4
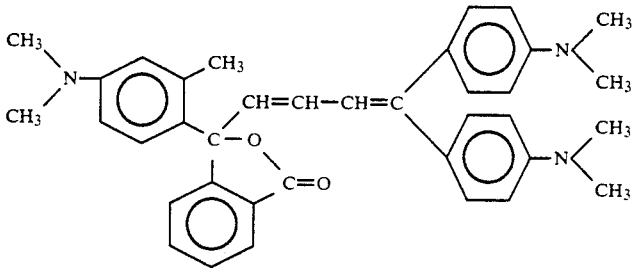
No. 5
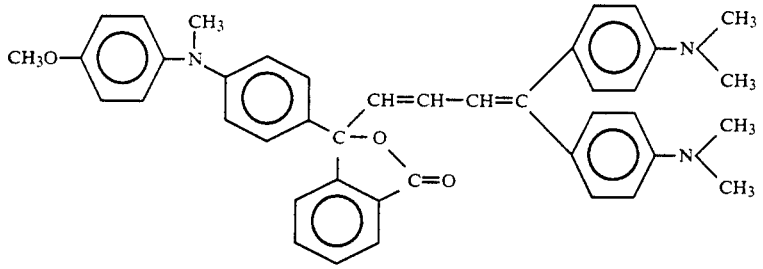
No. 6
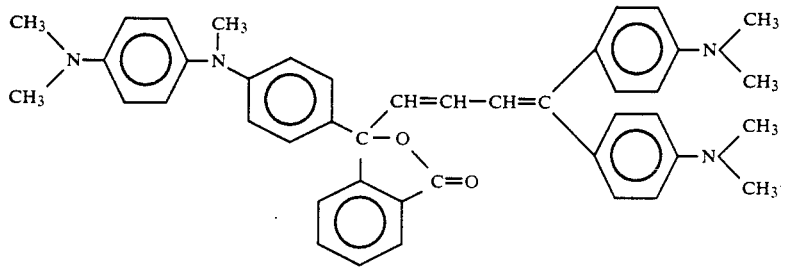

-continued
No. 7
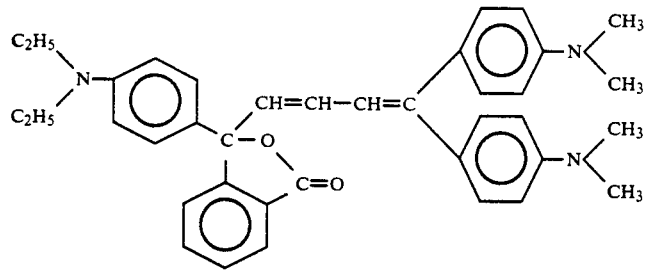
No. 8
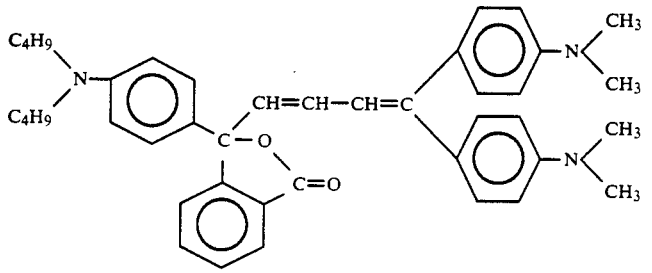
No. 9
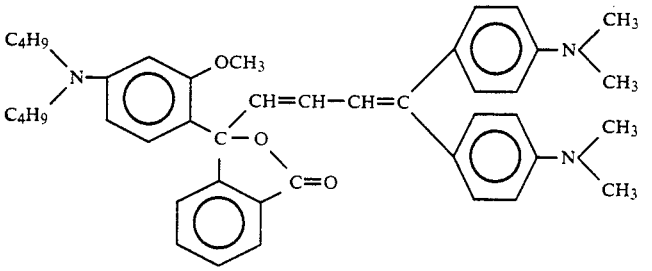
No. 10
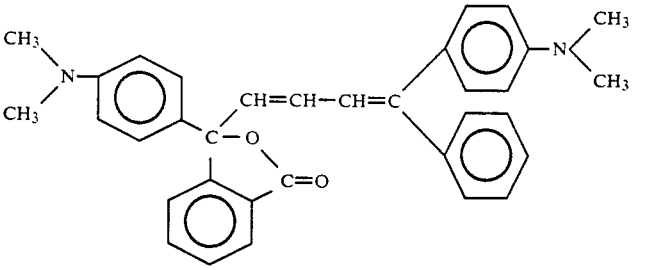
No. 11
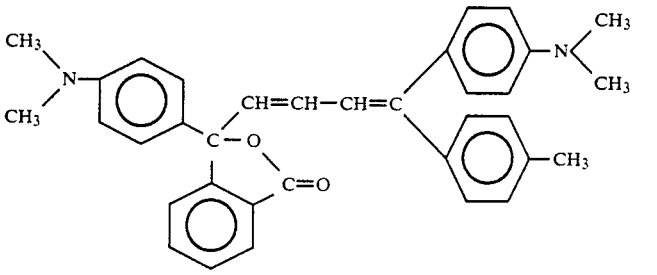

-continued
No. 12
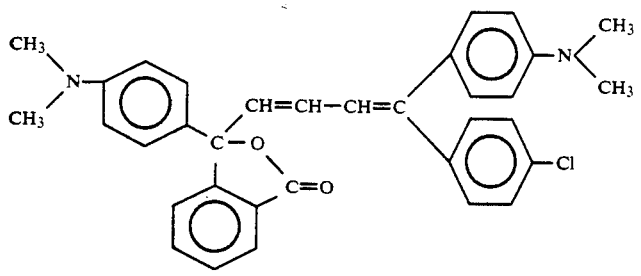
No. 13
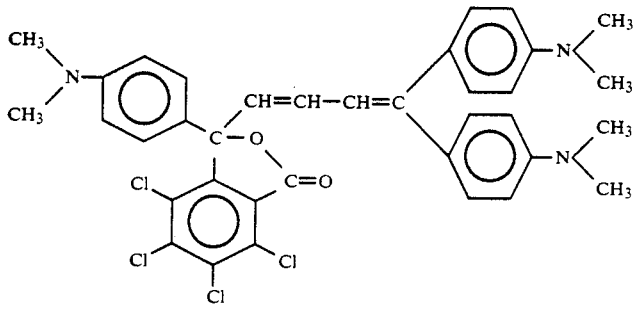
No. 14
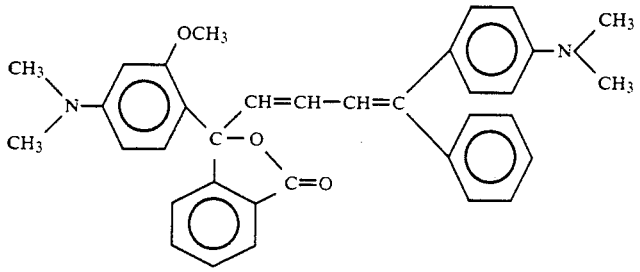
No. 15
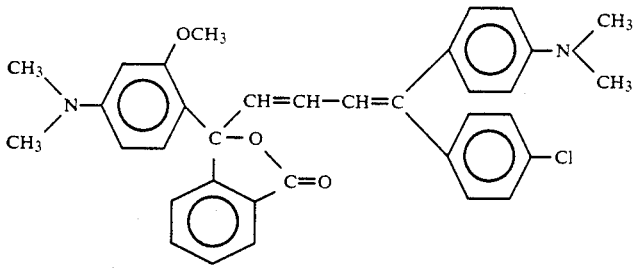
No. 16
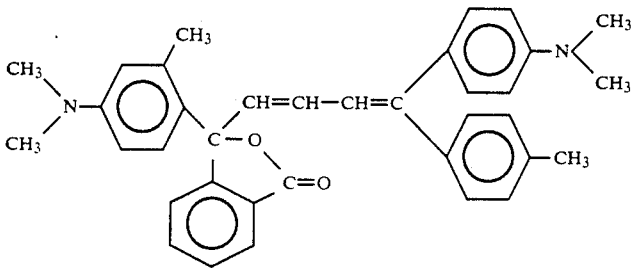

-continued
No. 17
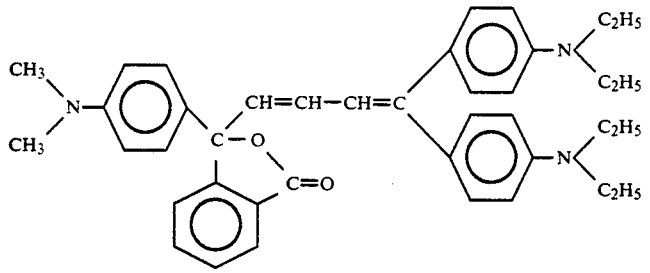
No. 18
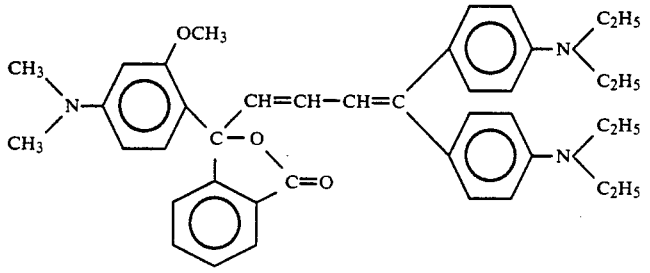
No. 19
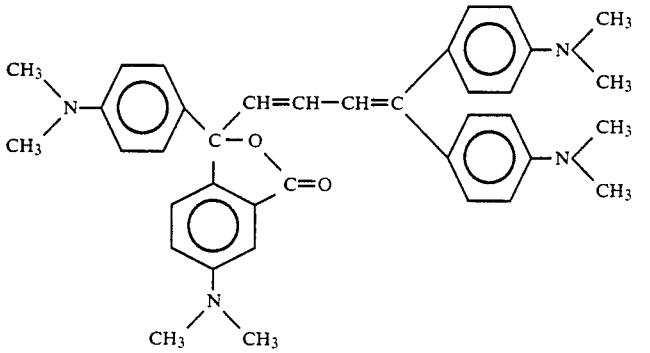
No. 20
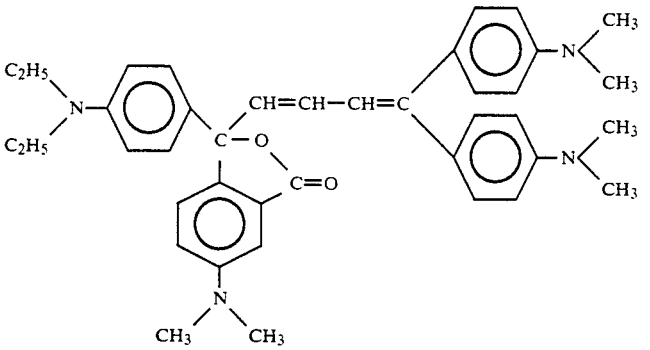
No. 21
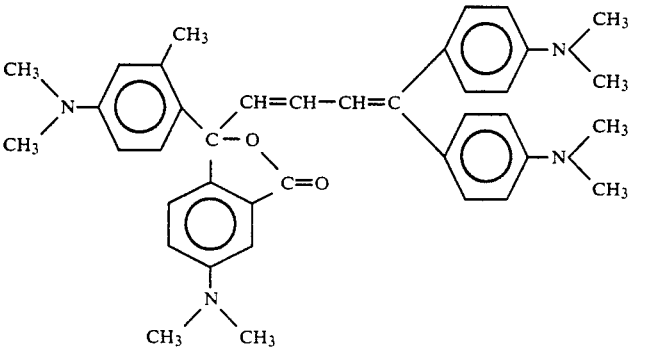

-continued
No. 22
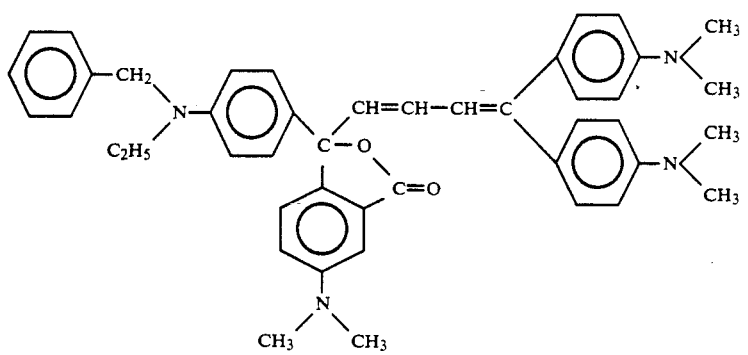
No. 23
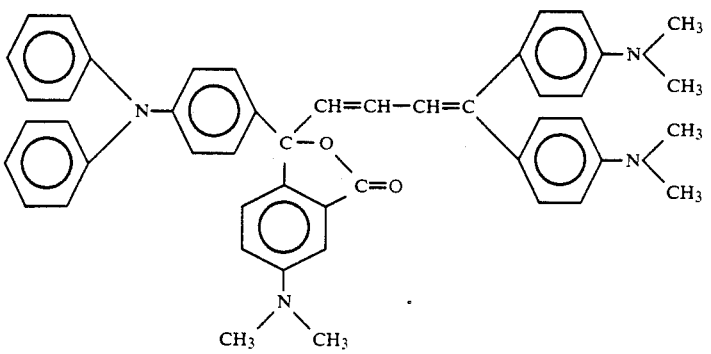
No. 24
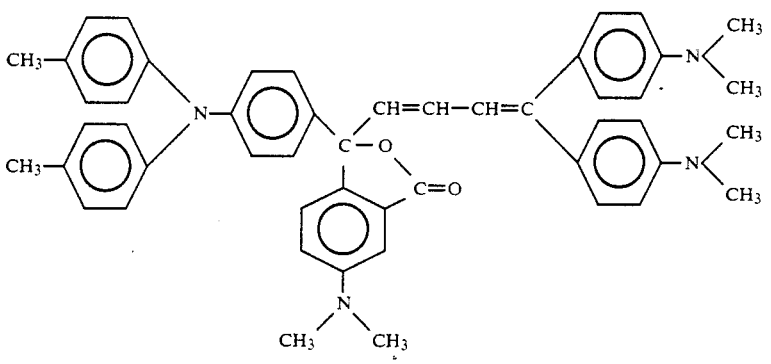
No. 25
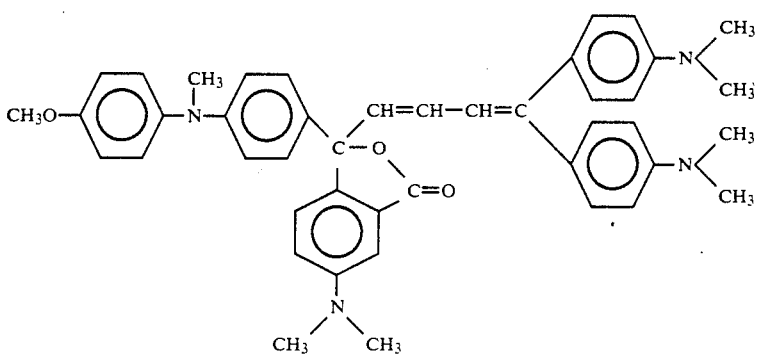

-continued
No. 26
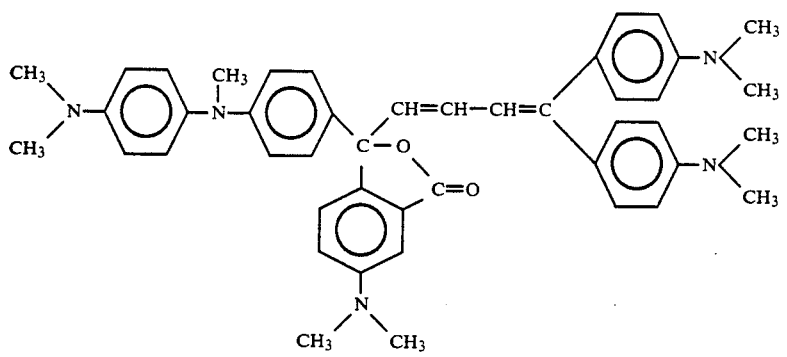
No. 27
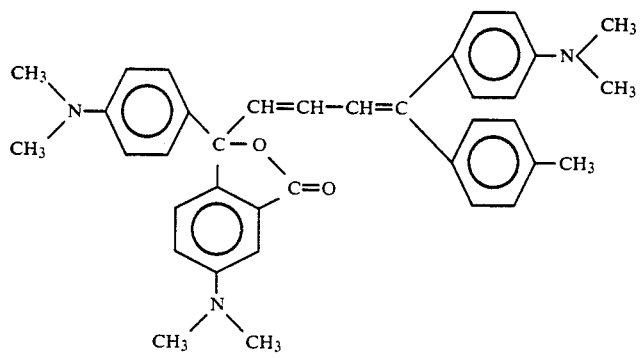
No. 28
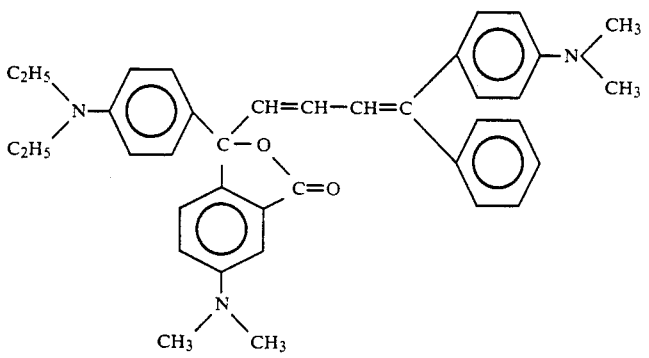
No. 29
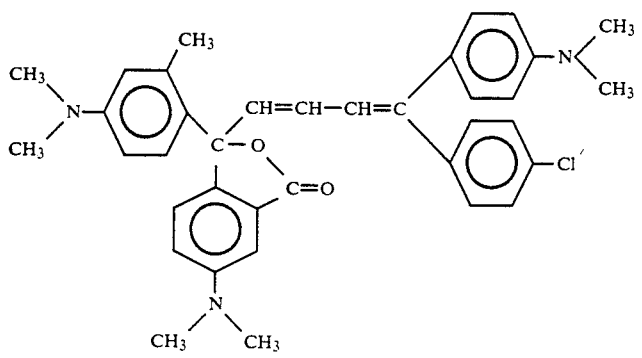

-continued
No. 30
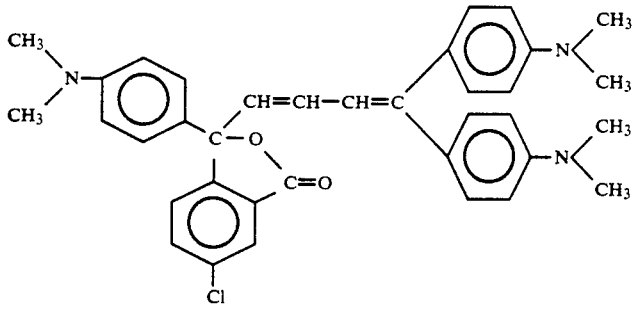
No. 31
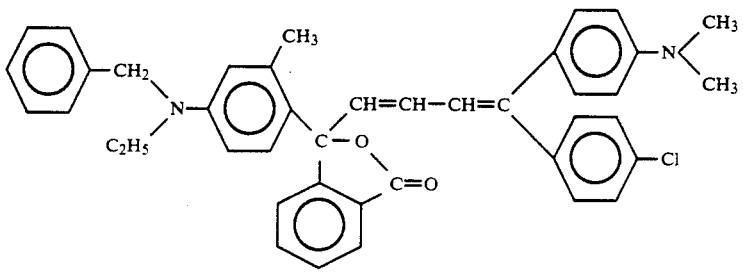
No. 32
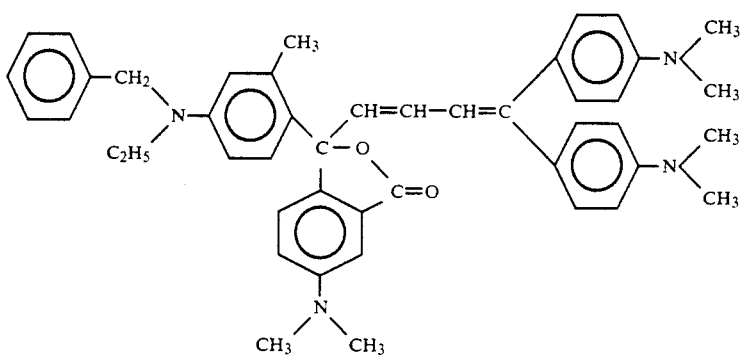
No. 33
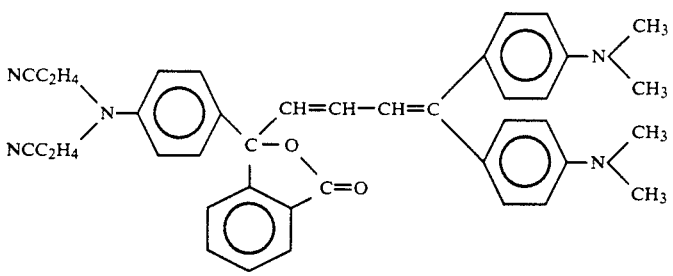
No. 34
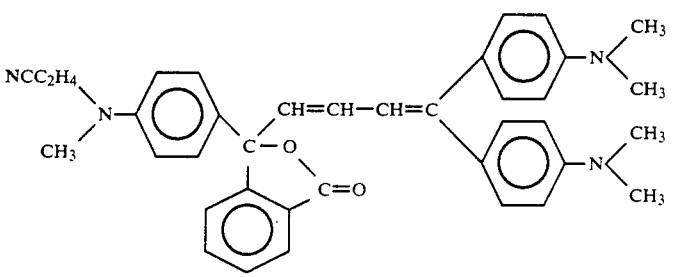

-continued
No. 35
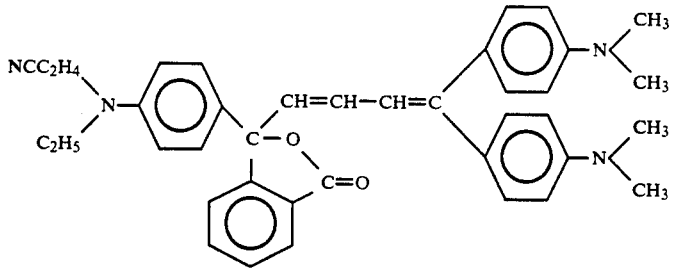
No. 36
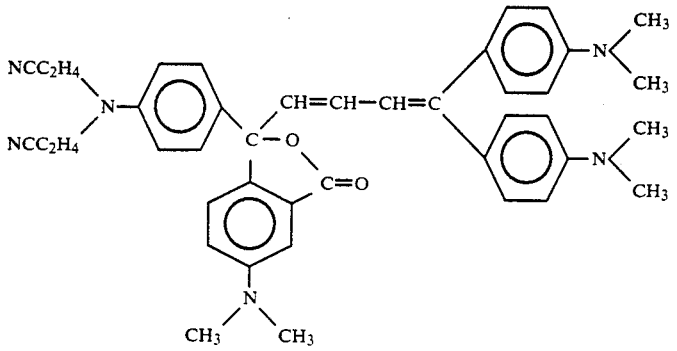
No. 37
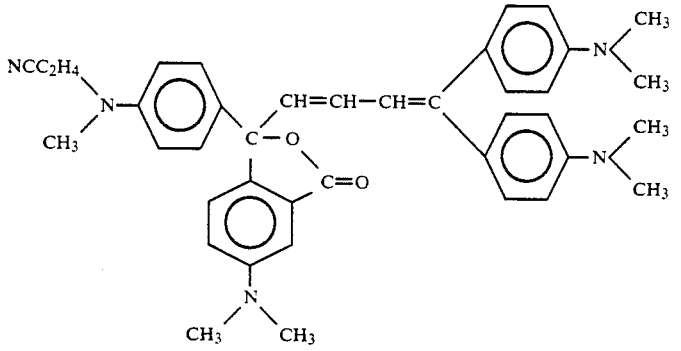
No. 38
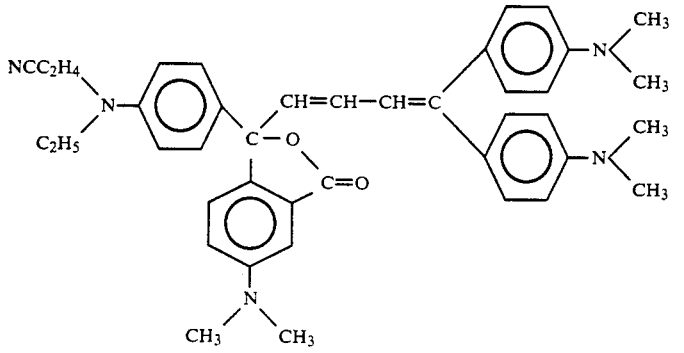

-continued
No. 39
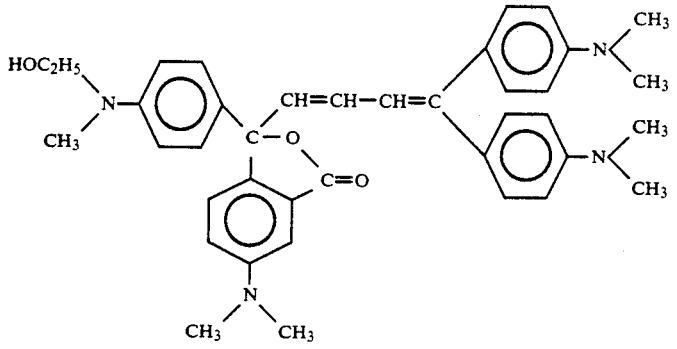
No. 40
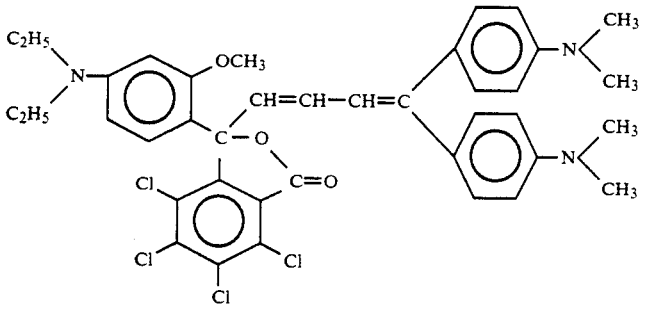
No. 41
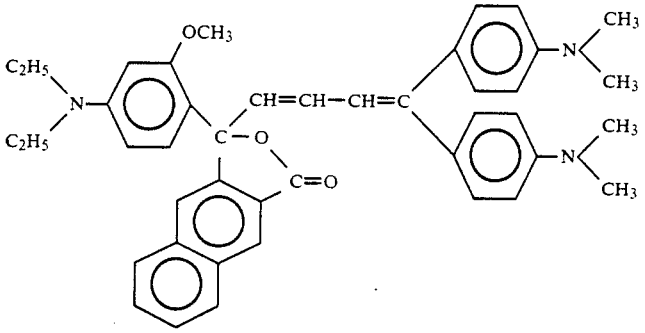
No. 42
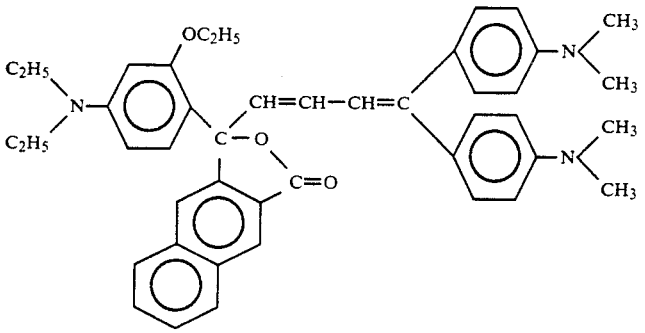

-continued
No. 43
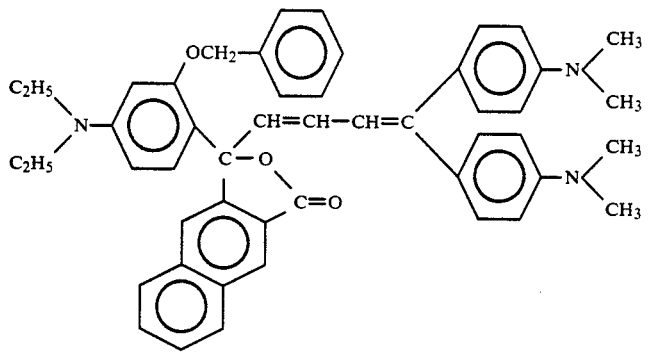
No. 44
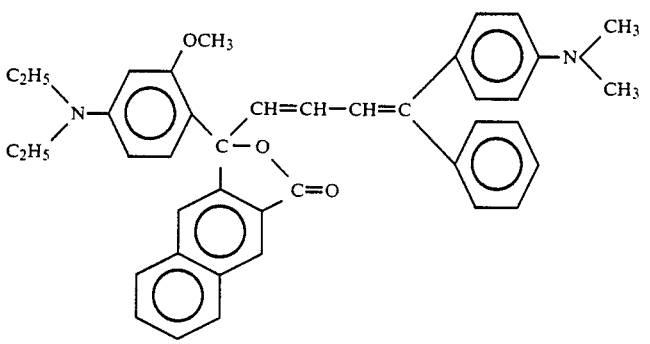
No. 45
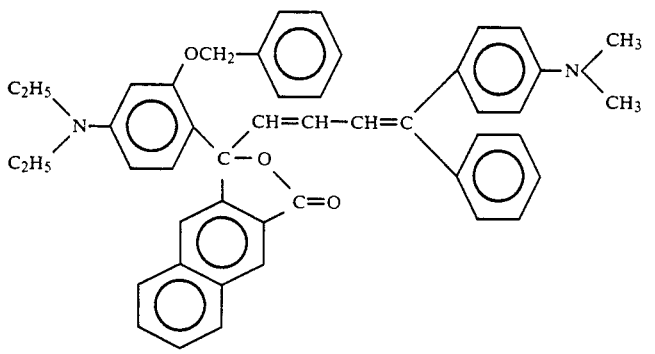
No. 46
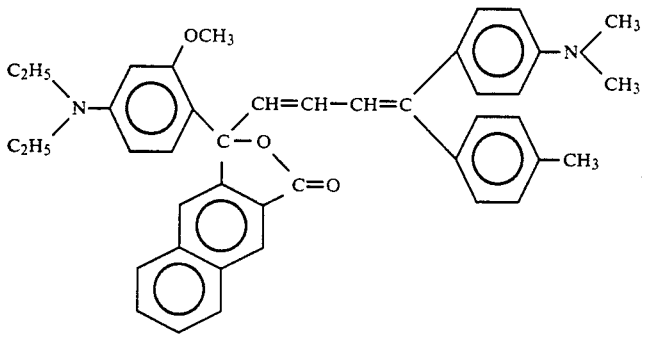

-continued
No. 47
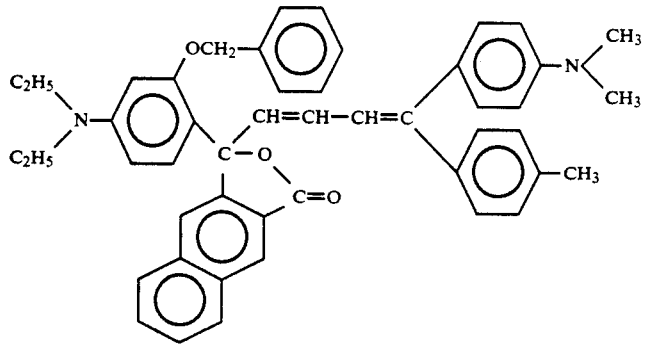
No. 48
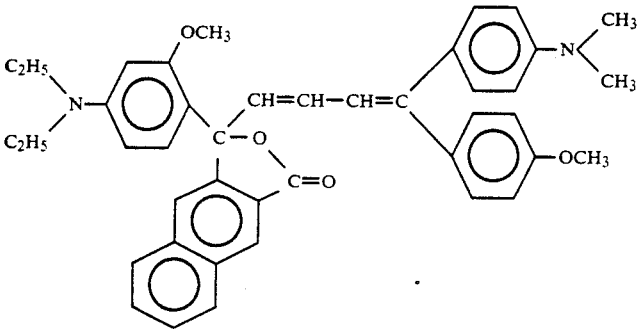
No. 49
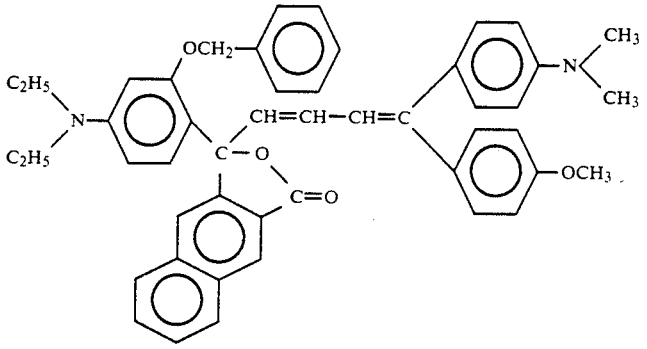
No. 50
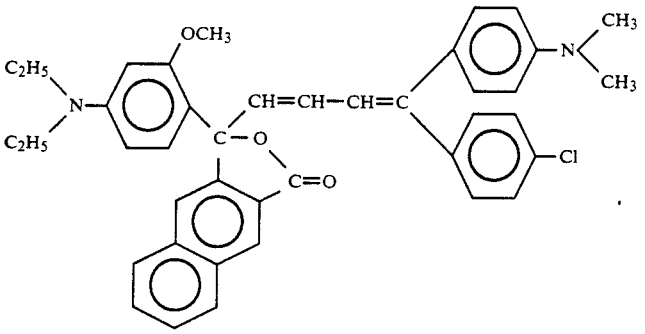

-continued
No. 51
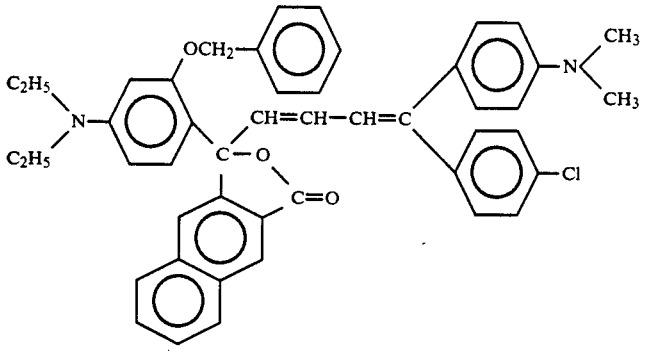
No. 52
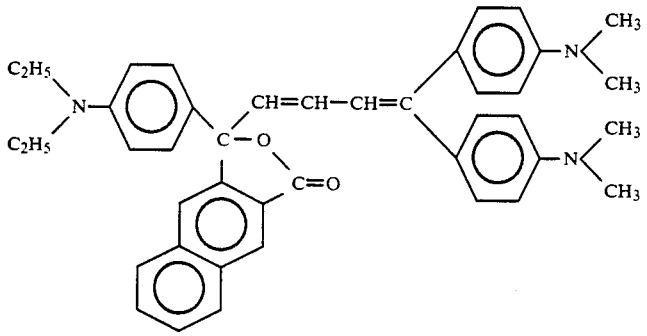
No. 53
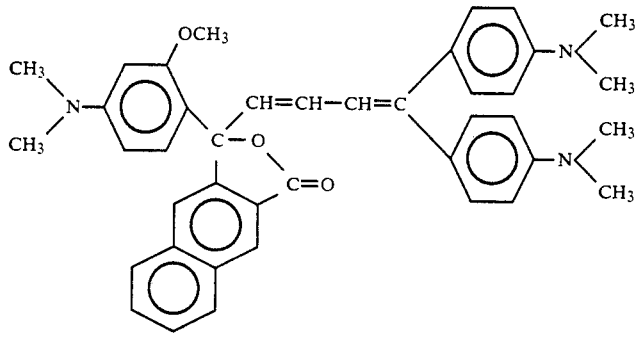
No. 54
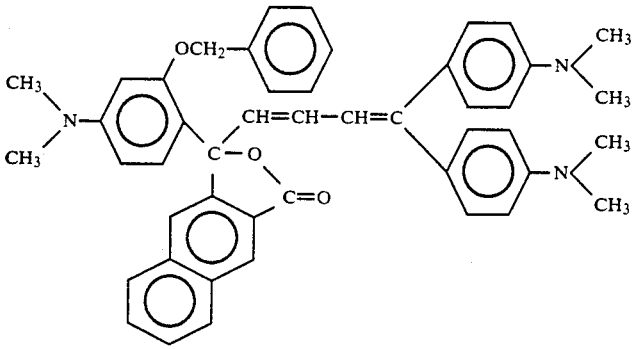

-continued
No. 55
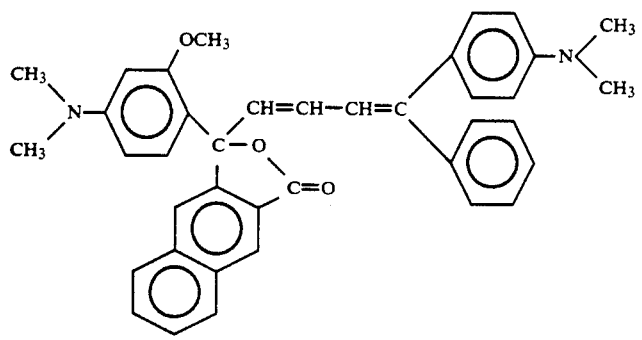
No. 56
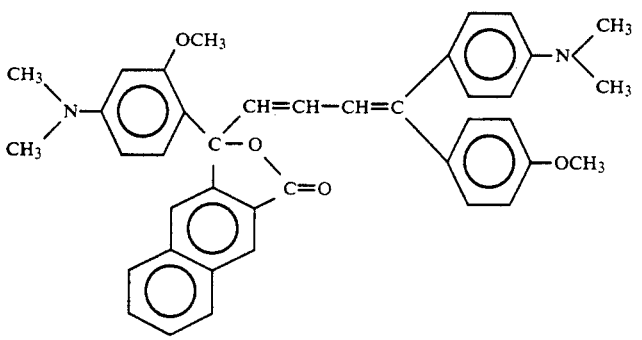
No. 57
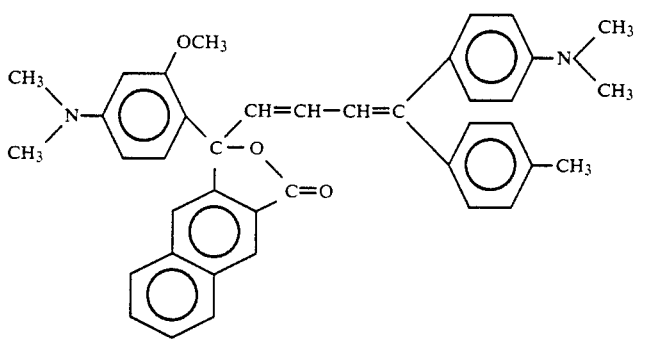
No. 58
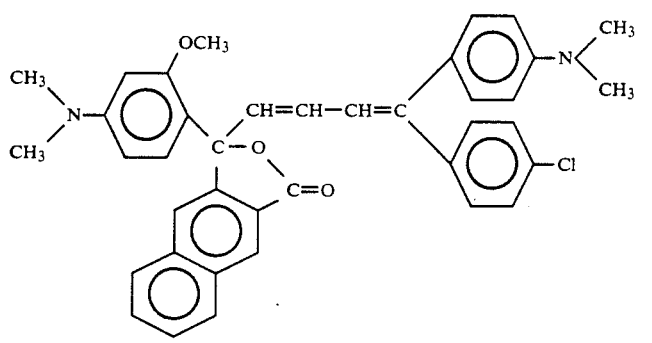

-continued
No. 59
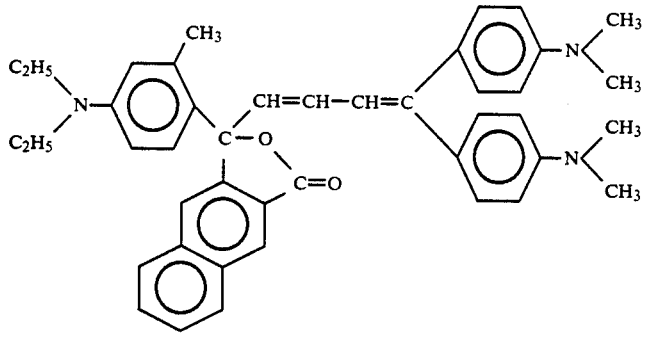
No. 60
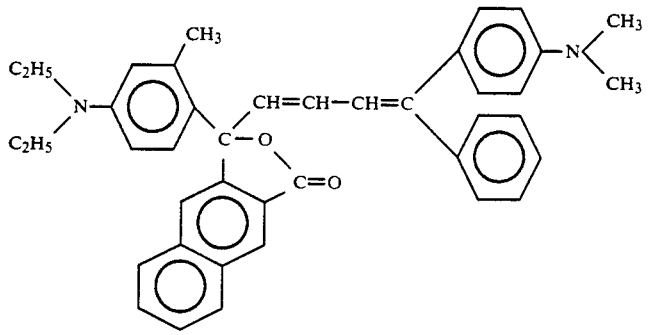
No. 61
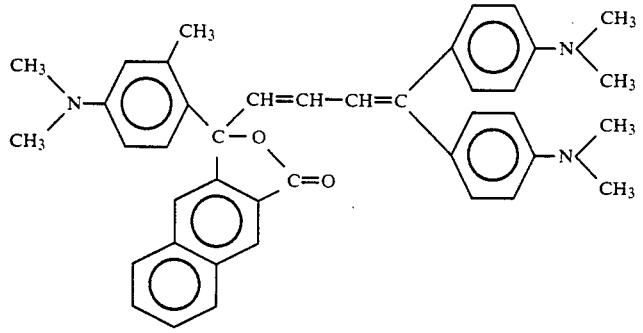
No. 62
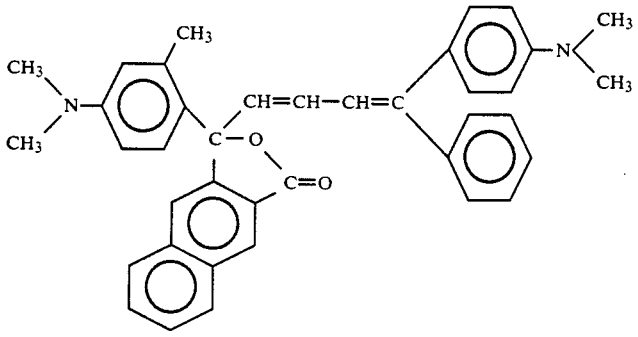

-continued
No. 63
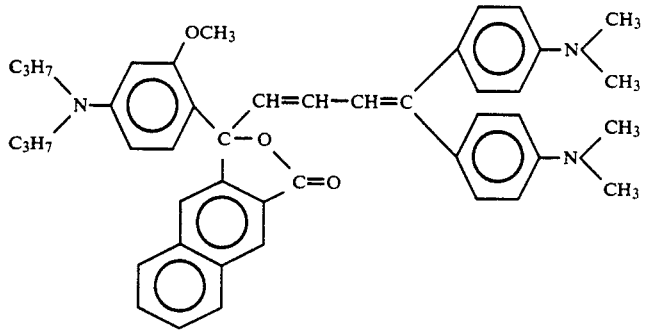
No. 64
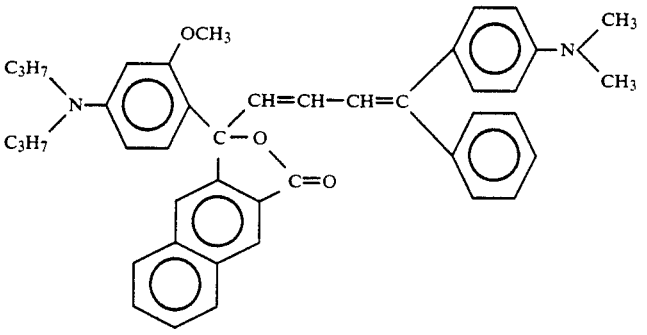
No. 65
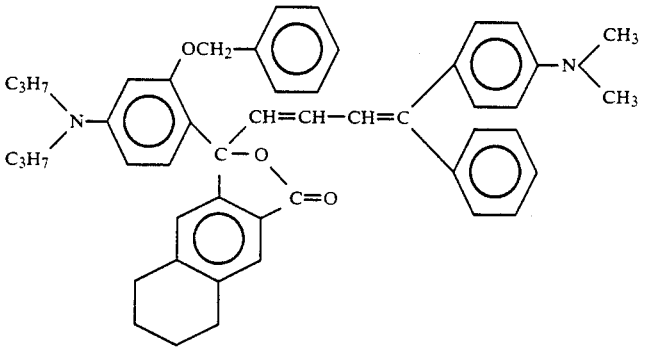
No. 66
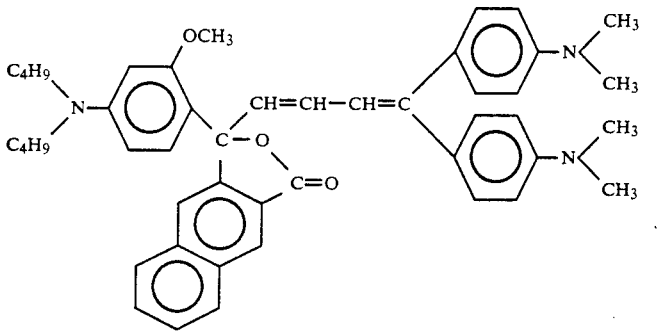

-continued
No. 67
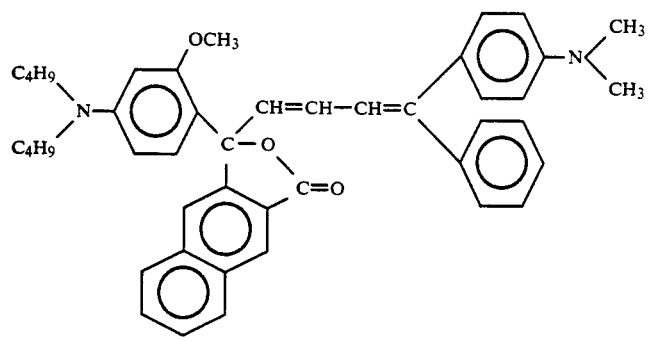
No. 68
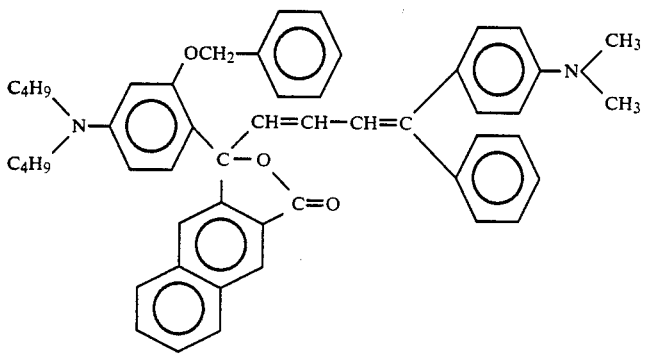
No. 69
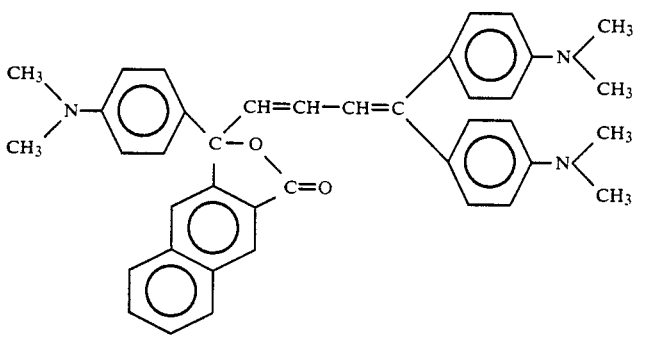
No. 70
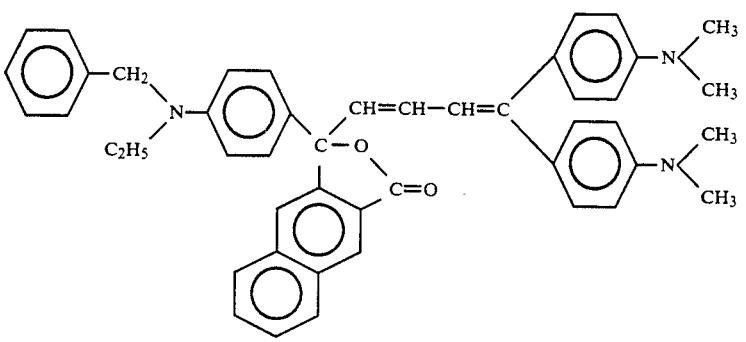

-continued
No. 71
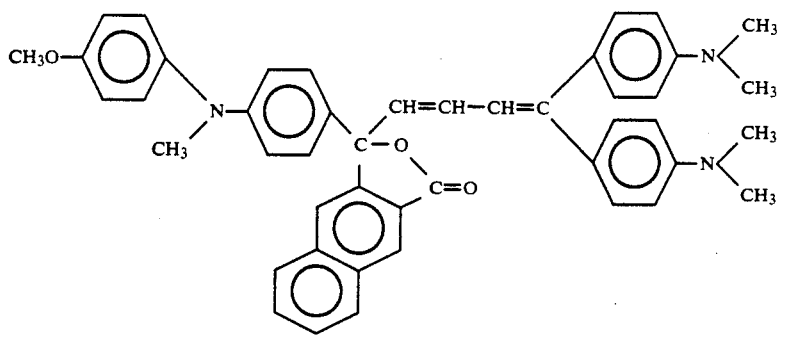
No. 72
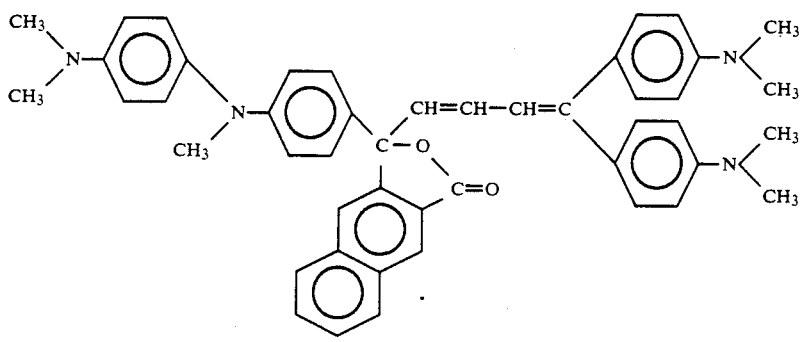
No. 73
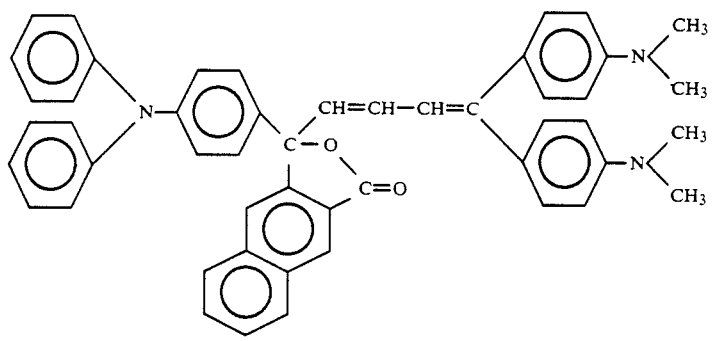
No. 74
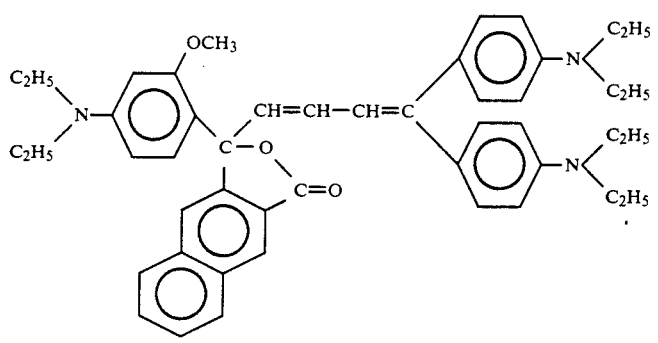

-continued
No. 75
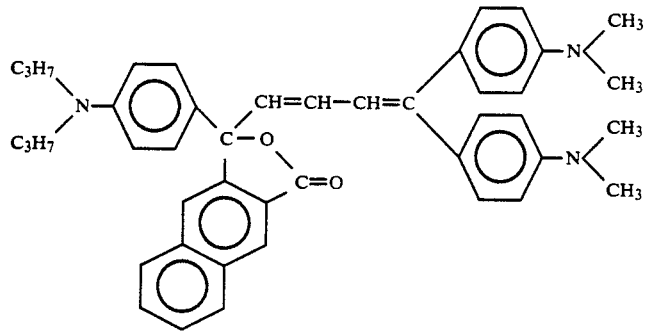
No. 76
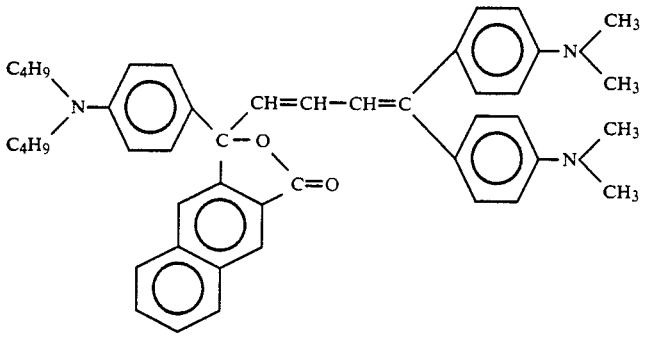
No. 77
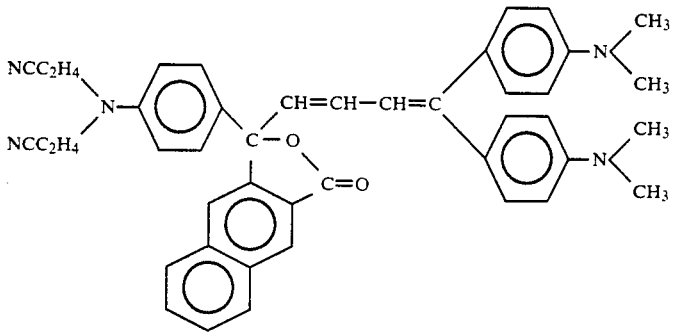
No. 78
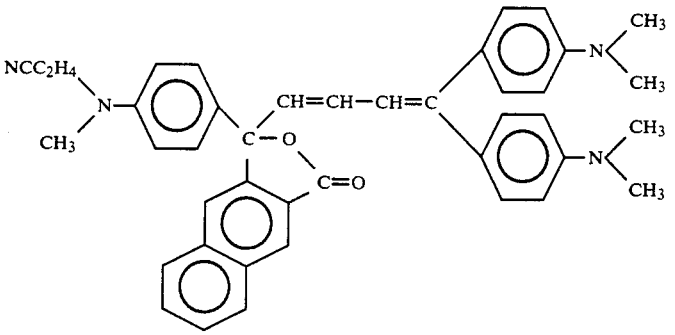

-continued
No. 79
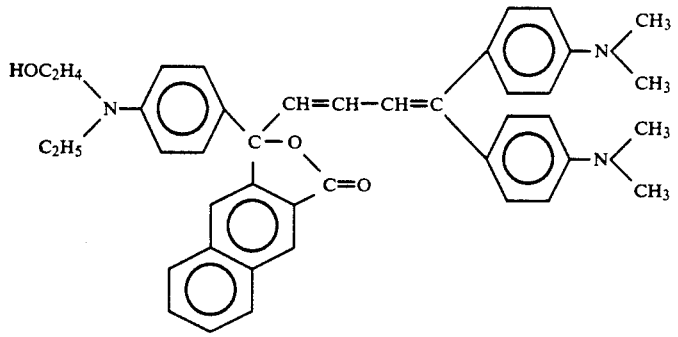
No. 80
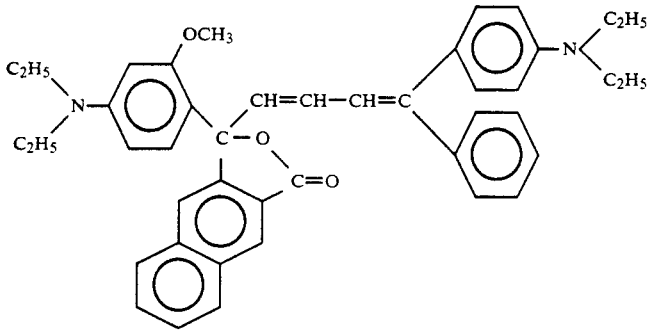
No. 81
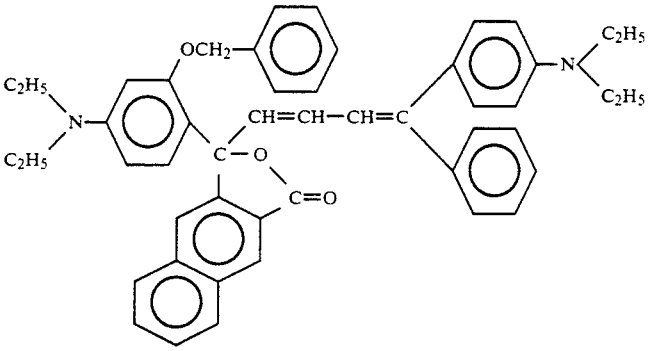
No. 82
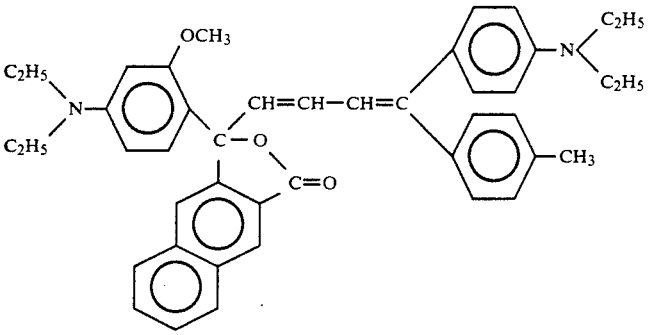

-continued
No. 83
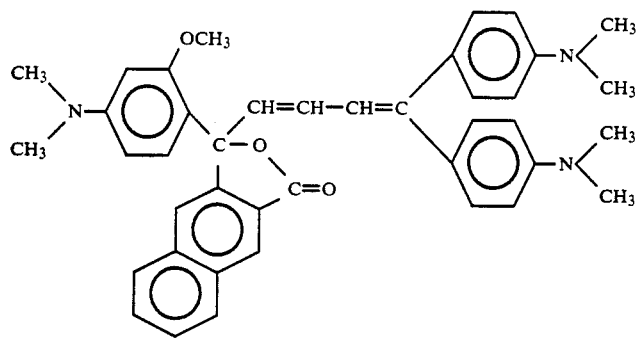
No. 84
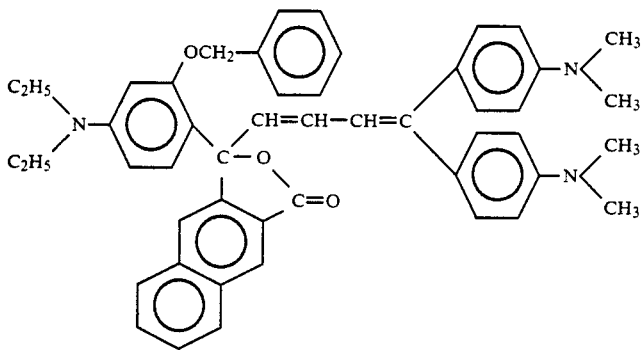
No. 85
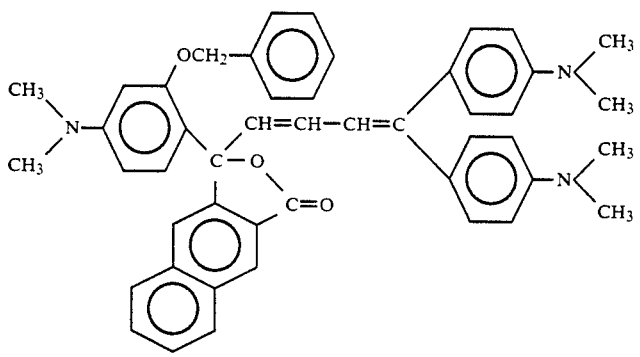
No. 86
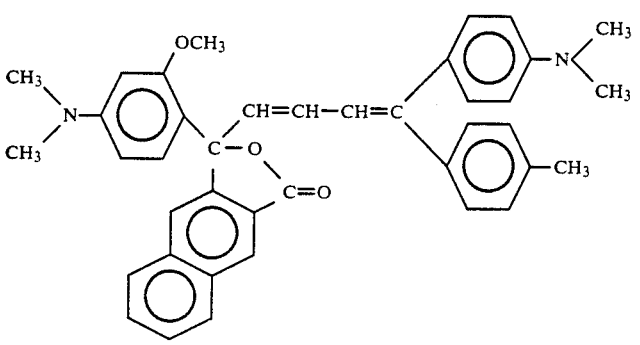

-continued
No. 87
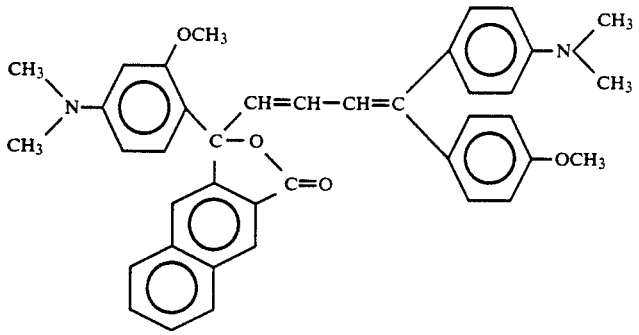
No. 88
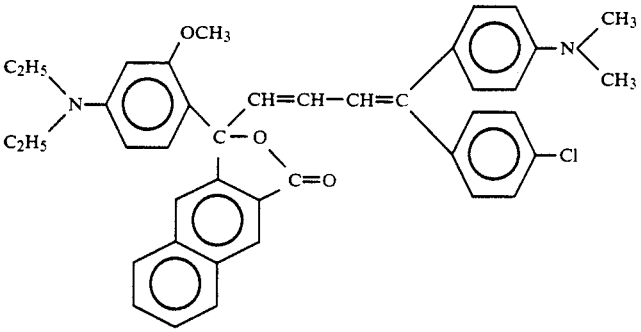
No. 89
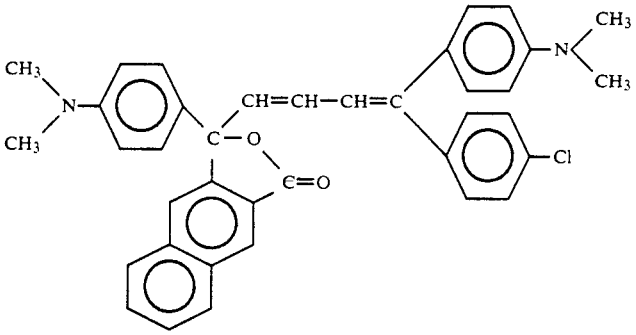
No. 90
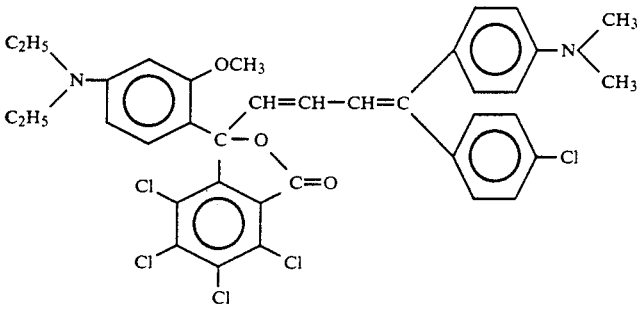

-continued

No. 91

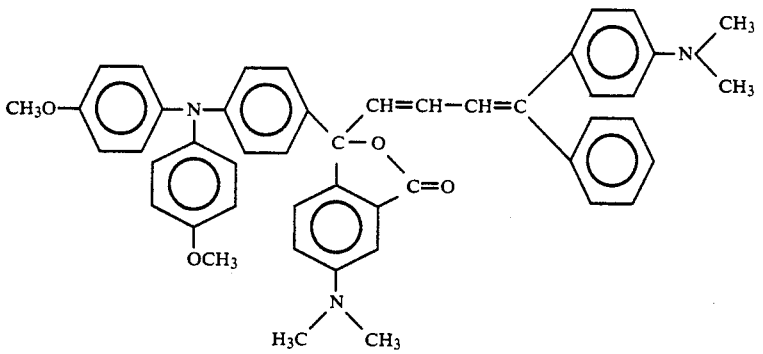

No. 92

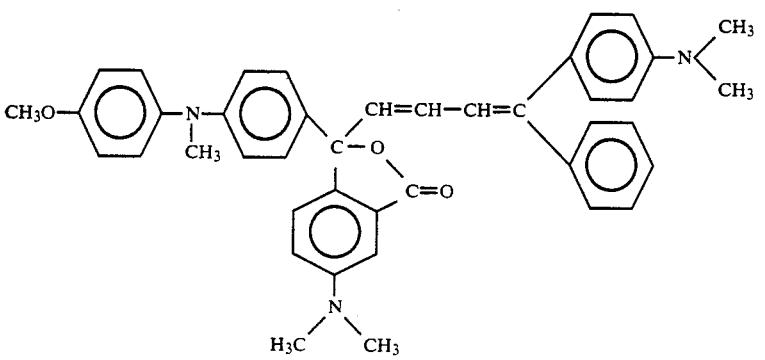

Specific examples of the leuco dye having the previously mentioned formula (II) for use in the first thermosensitive coloring layer in the thermosensitive recording material according to the present invention are as follows:

(1) 3,3-bis[2-(p-dimethylaminophenyl)-2-(phenylethenyl)-4,5,6,7-tetrachlorophthalide, (2) 3,3-bis[2-(p-dimethylaminophenyl)-2-(p-methylphenyl)-ethenyl]-4,5,6,7-tetrachlorophthalide, (3) 3,3-bis[2-(p-dimethylaminophenyl)-2-(p-methoxyphenyl)-ethenyl]-4,5,6,7-tetrachlorophthalide, (4) 3,3-bis[2-(p-dimethylaminophenyl)-2-(p-ethoxyphenyl)-ethenyl-4,5,6,7-tetrachlorophthalide, (5) 3,3-bis[2-(p-dimethylaminophenyl)-2-(m,p-dimethylphenyl) ethenyl]-4,5,6,7-tetrachlorophthalide, (6) 3,3-bis[2-(p-dimethylaminophenyl)-2-(o-methyl-p-methoxyphenyl) ethenyl]-4,5,6,7-tetrachlorophthalide, (7) 3,3-bis[2-(p-dimethylamino-o-methylphenyl)-2-phenylethenyl]-4,5,6,7-tetrachlorophthalide, (8) 3,3-bis[2-(p-dimethylamino-o-chlorophenyl)-2-(p-methylphenyl)ethenyl]-4,5,6,7-tetrachlorophthalide, (9) 3,3-bis[2-(p-dimethylaminophenyl)-2-(p-chlorophenyl)-ethenyl]-4,5,6,7-tetrachlorophthalide,

(10) 3,3-bis[2-(p-dimethylaminophenyl)-2-(o,p-dimethoxyphenyl)ethenyl]-4,5,6,7-tetrachlorophthalide,

(11) 3,3-bis[2-(p-methylbutylaminophenyl)-2-(p-methoxyphenyl)ethenyl]-4,5,6,7-tetrachlorophthalide,

(12) 3,3-bis[2-(p-dimethylaminophenyl)-2-(p-octylphenyl)-ethenyl] -4,5,6,7-tetrachlorophthalide,

(13) 3,3-bis[2-(p-dimethylaminophenyl)-2-(p-hexyloxyphenyl)ethenyl]-4,5,6,7-tetrachlorophthalide,

(14) 3,3-bis[2-(p-methylcyclohexylaminophenyl)-2-(p-methylphenyl)ethenyl]-4,5,6,7-tetrachlorophthalide,

(15) 3,3-bis[2-(p-ethylbenzylaminophenyl)-2-(p-methoxyphenyl)ethenyl]-4,5,6,7-tetrachlorophthalide,

(16) 3,3-bis[2-(p-dimethylaminophenyl)-2-phenylethenyl]-4,5,6,7-tetrabromophthalide,

(17) 3,3-bis[2-(p-dimethylaminophenyl)-2-phenylethenyl]-5-chloro-4,6,7-tribromophthalide, and

(18) 3,3-bis[2-(p-dimethylaminophenyl)-2-(p-methoxyphenyl)-ethenyl]-5,6-dichloro-4,7-dibromophthalide.

Specific examples of the leuco dye having the previously mentioned formula (III) for use in the first thermosensitive coloring layer in the thermosensitive recording material according to the present invention are as follows:

No. 1
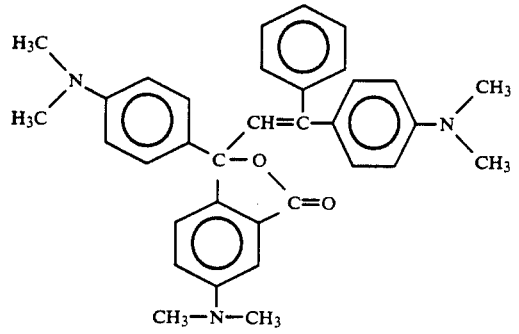
No. 2
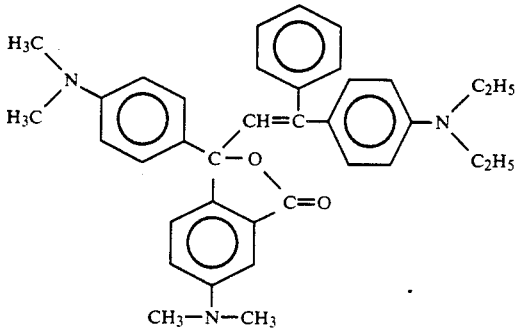
No. 3
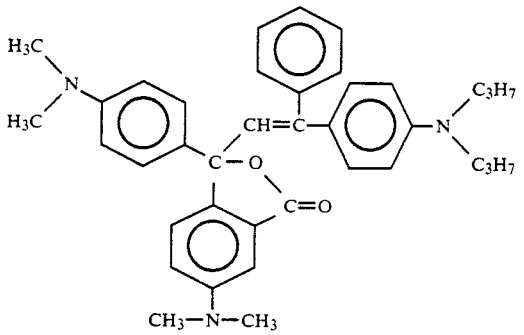
No. 4
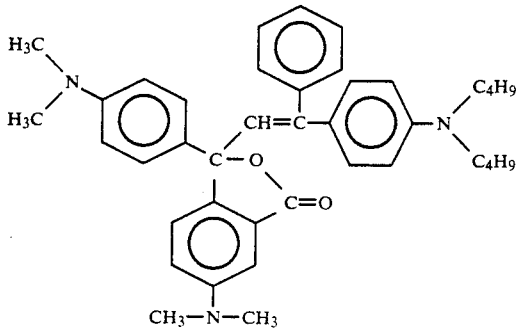

-continued
No. 5
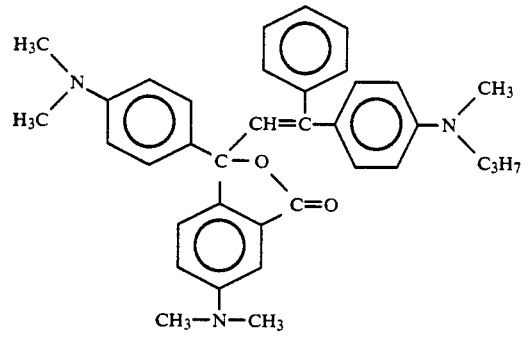
No. 6
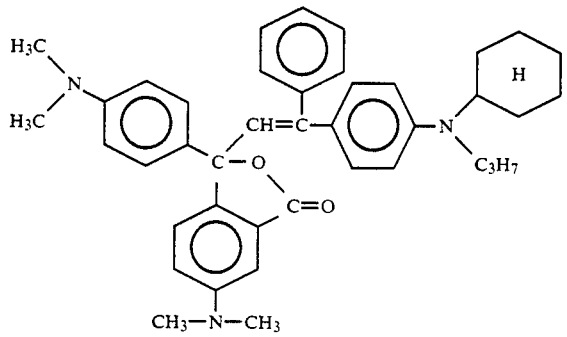
No. 7
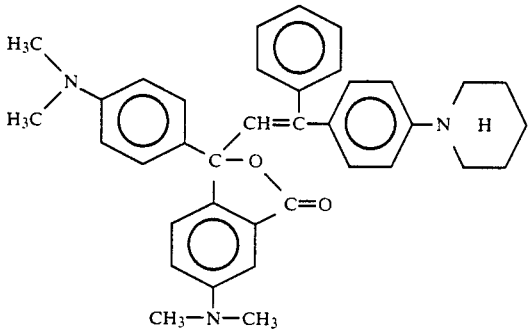
No. 8
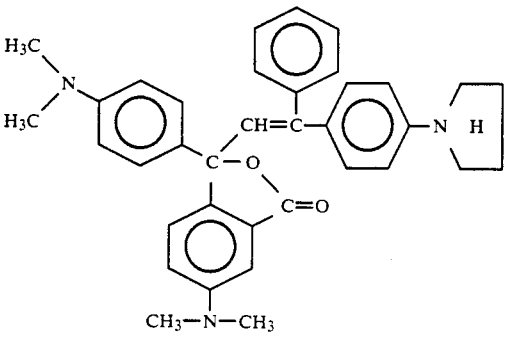

-continued
No. 9
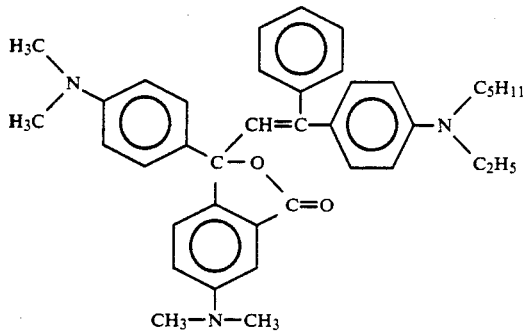
No. 10
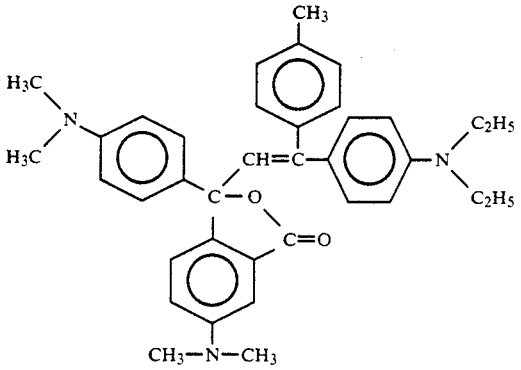
No. 11
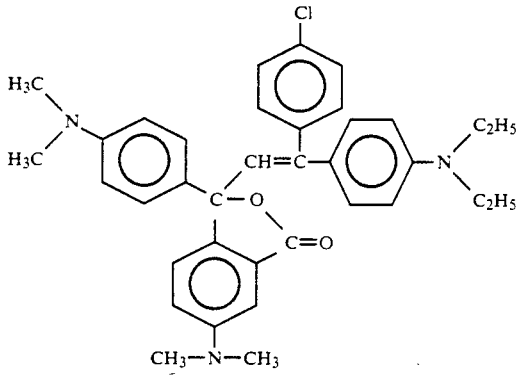
No. 12
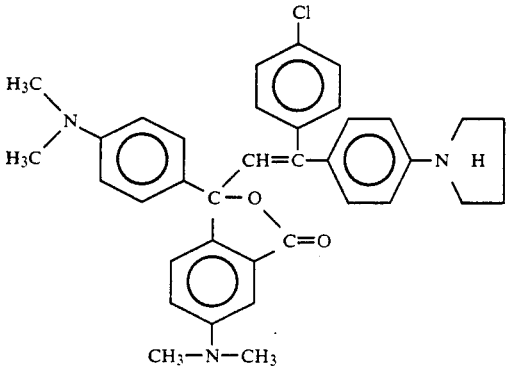

-continued
No. 13
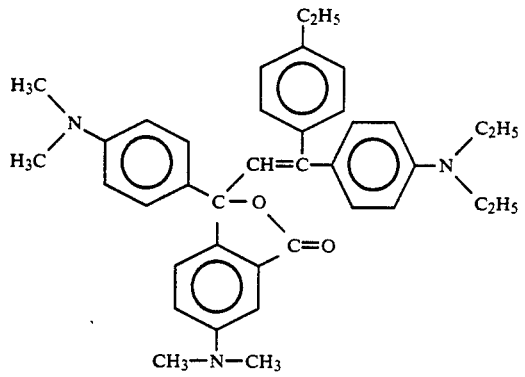
No. 14
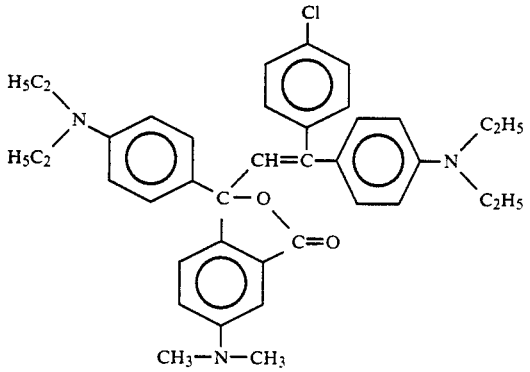
No. 15
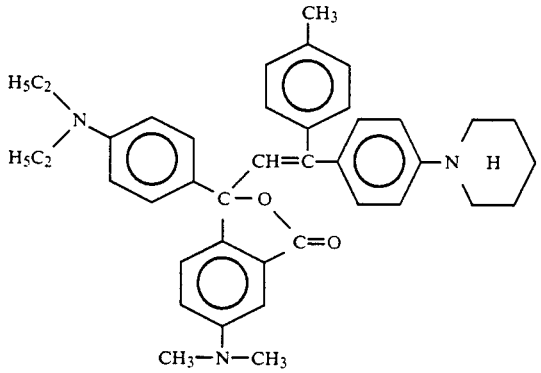
No. 16
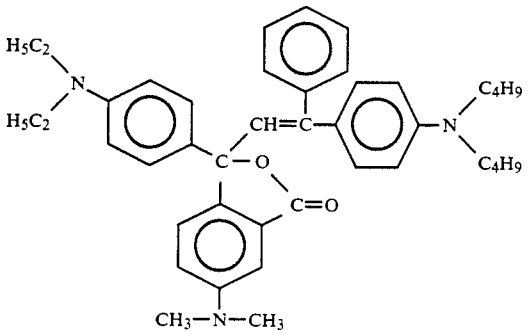

-continued
No. 17
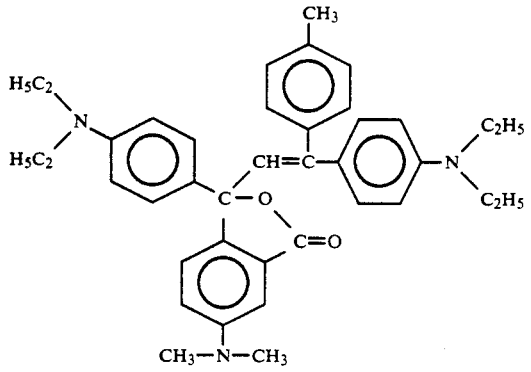
No. 18
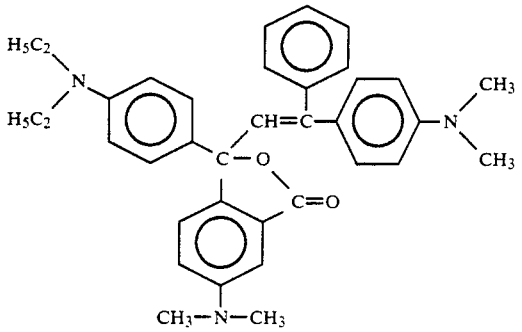
No. 19
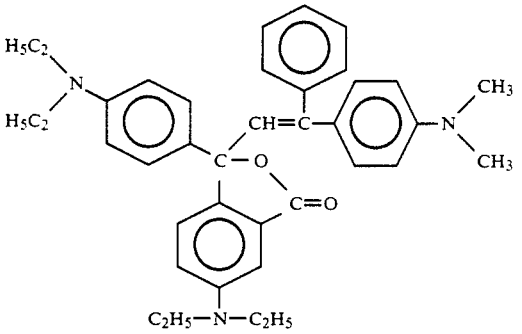
No. 20
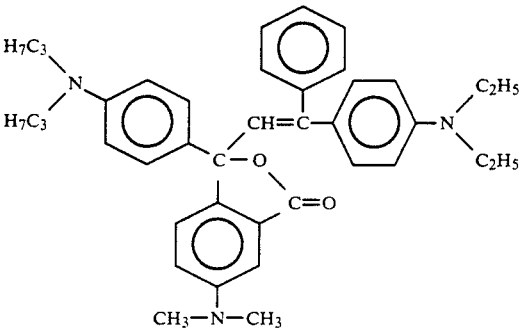

-continued
No. 21
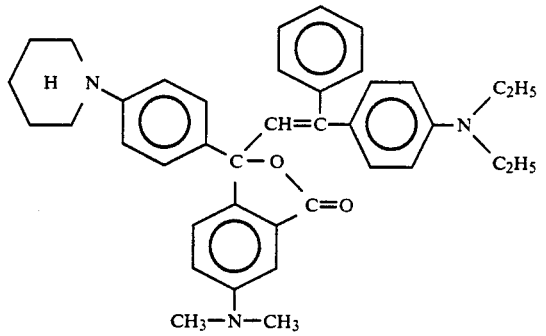
No. 22
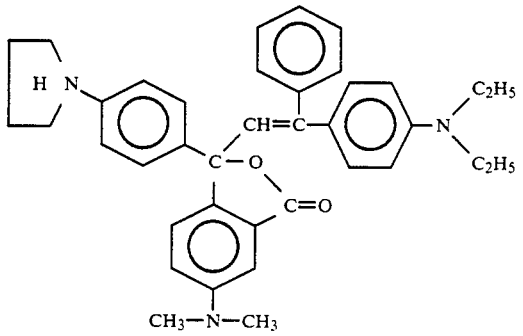
No. 23
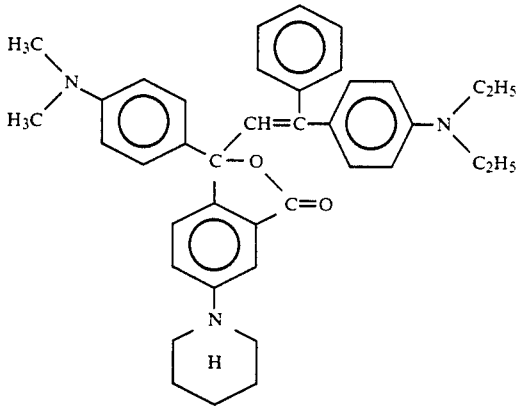
No. 24
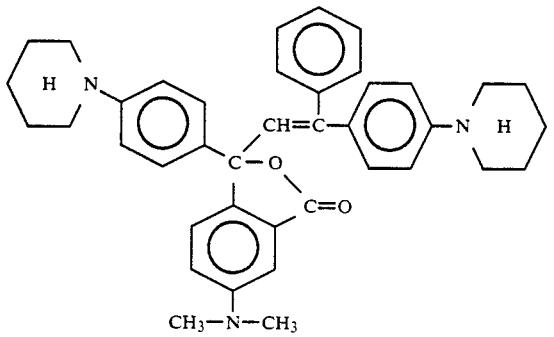

-continued
No. 25
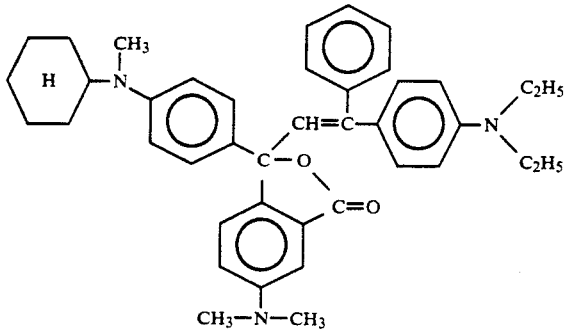
No. 26
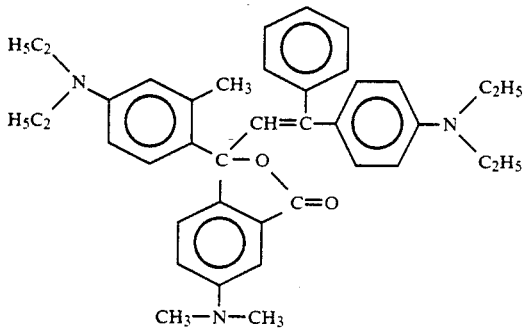
No. 27
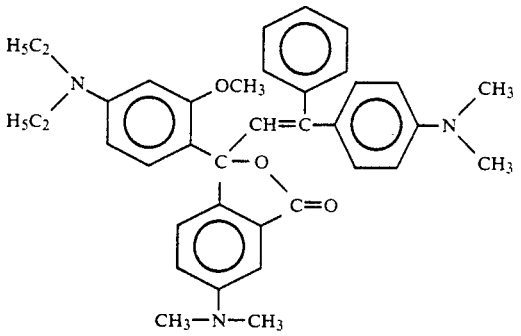
No. 28
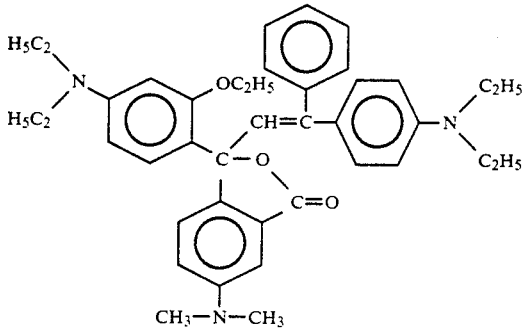

-continued
No. 29
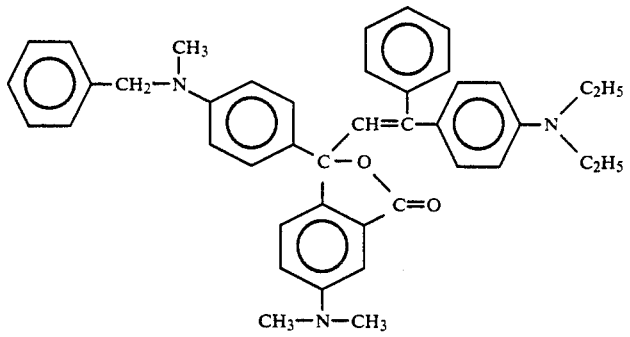
No. 30
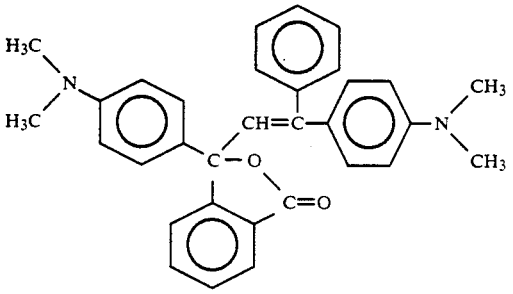
No. 31
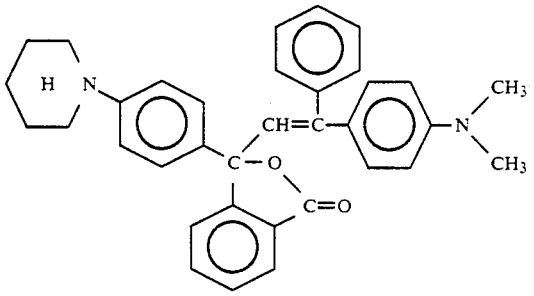
No. 32
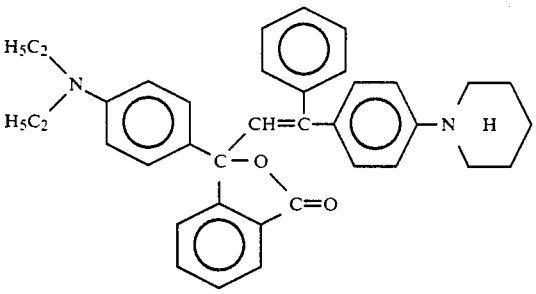
No. 33
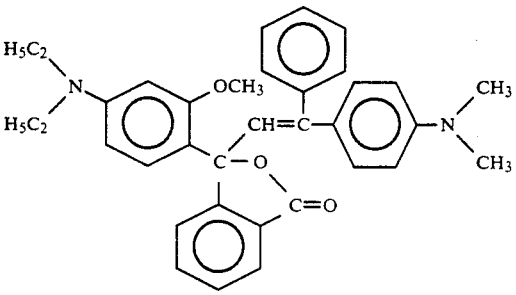

-continued
No. 34
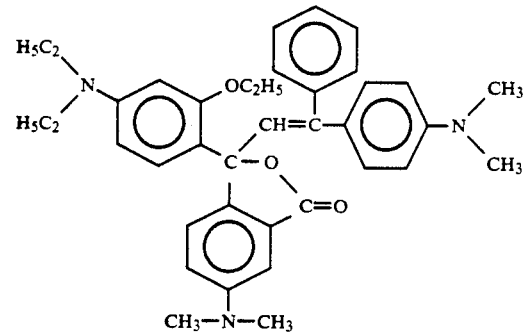
No. 35
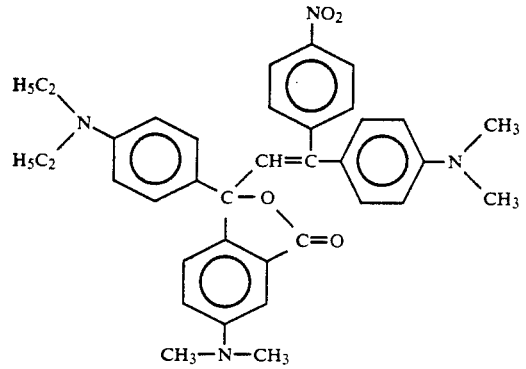
No. 36
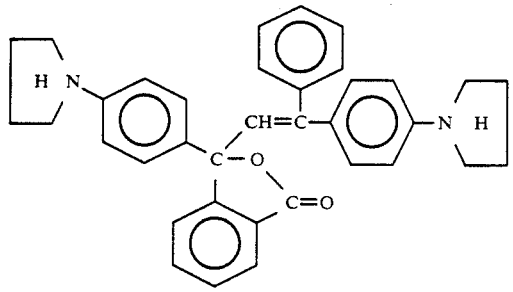
No. 37
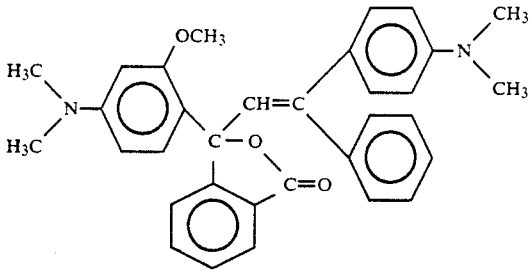
No. 38
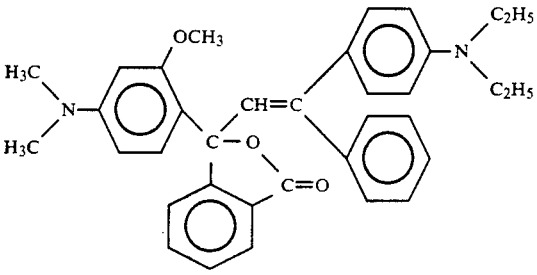

-continued
No. 39
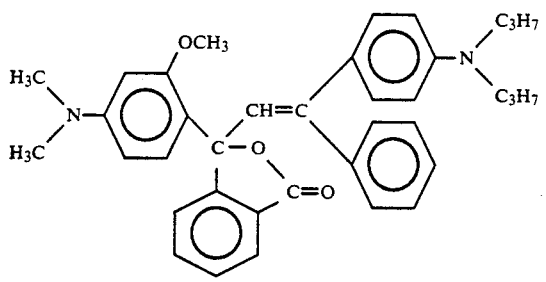
No. 40
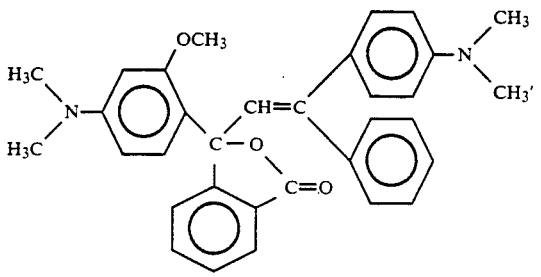
No. 41
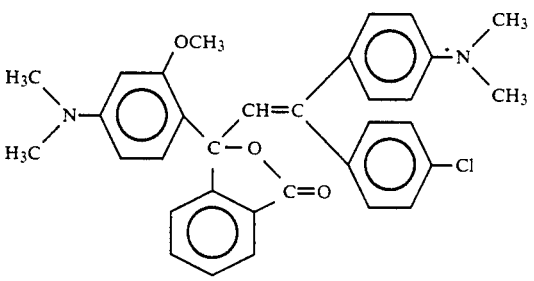
No. 42
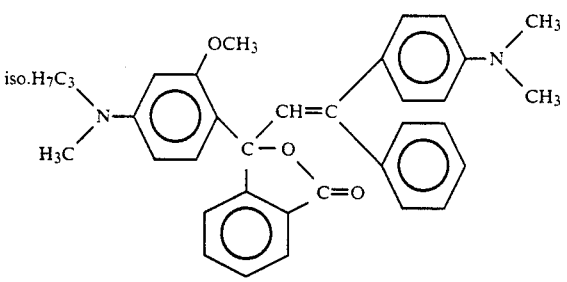
No. 43
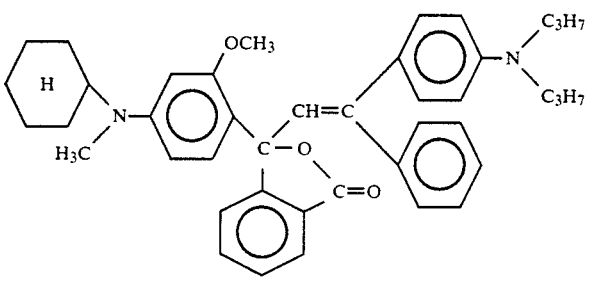

-continued
No. 44
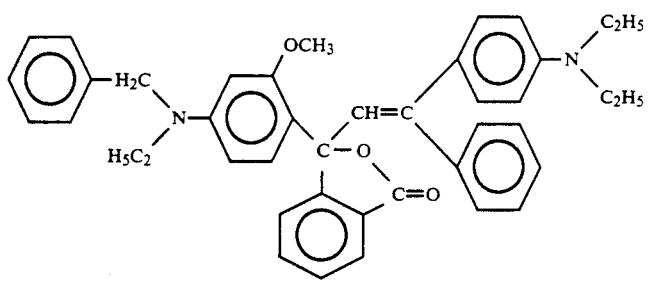
No. 45
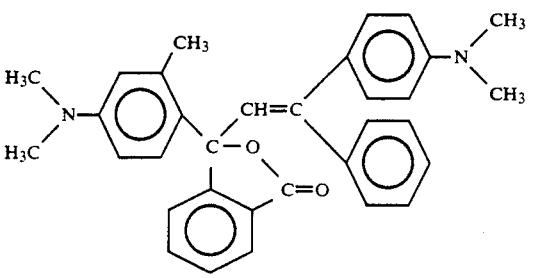
No. 46
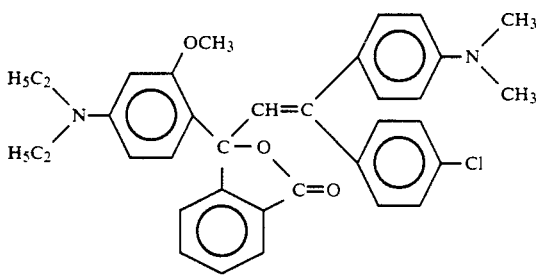
No. 47
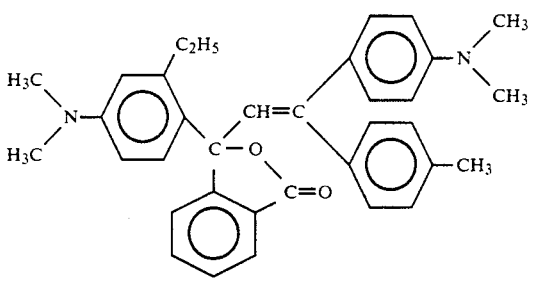
No. 48
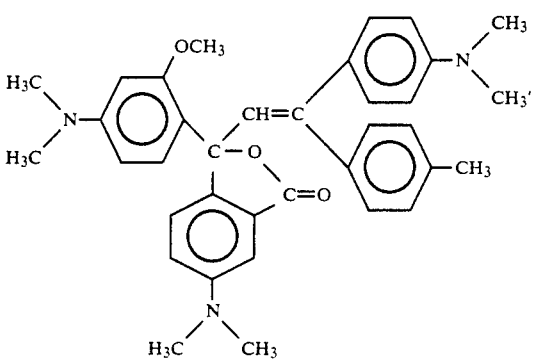

-continued
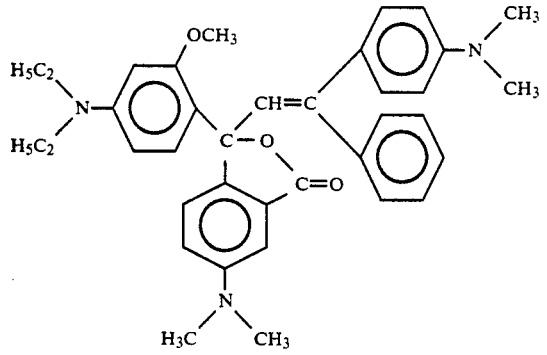
No. 49
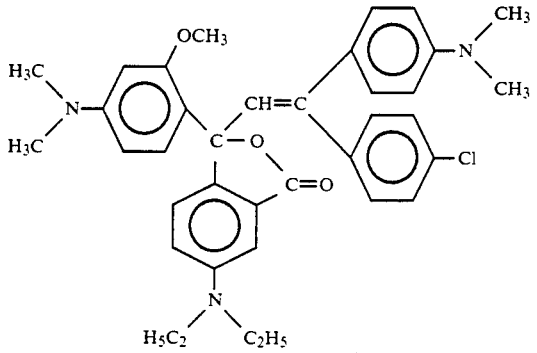
No. 50
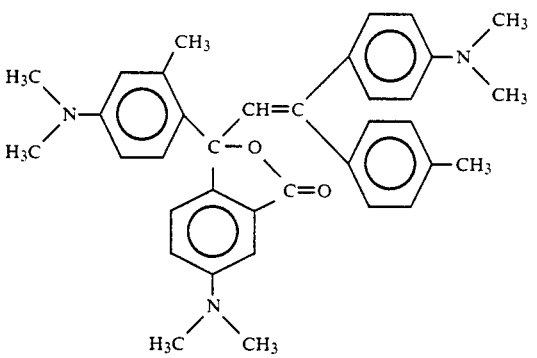
No. 51
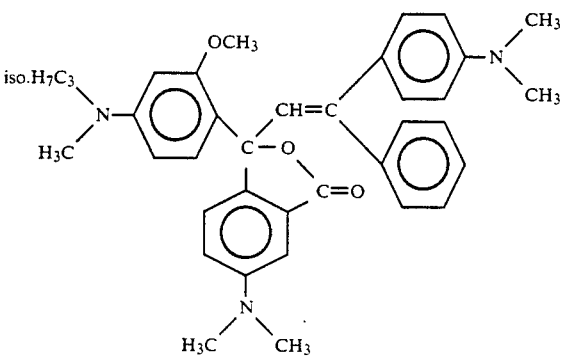
No. 52

-continued
No. 53
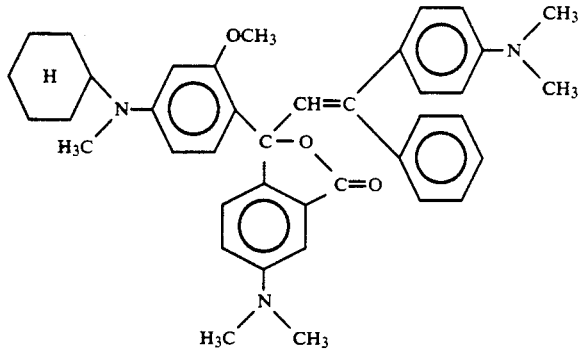
No. 54
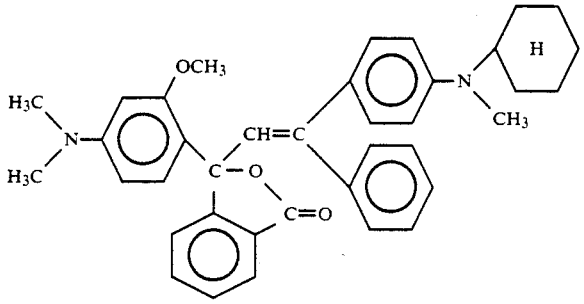
No. 55
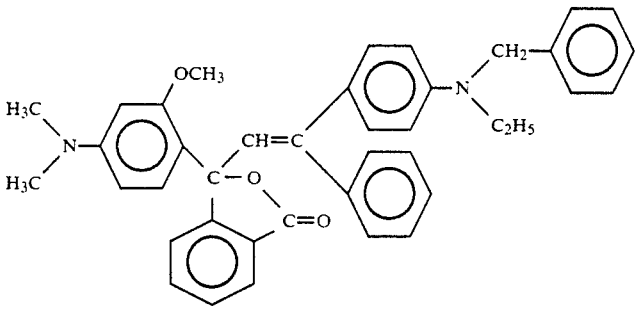
No. 56
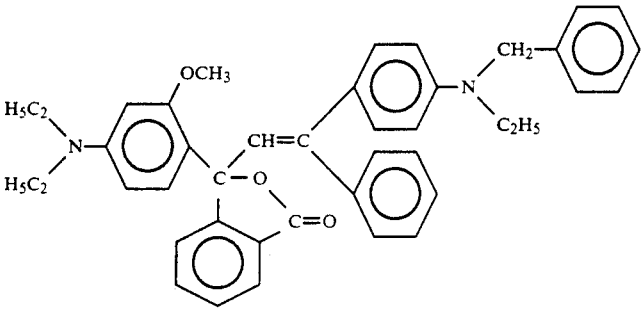

-continued
No. 57
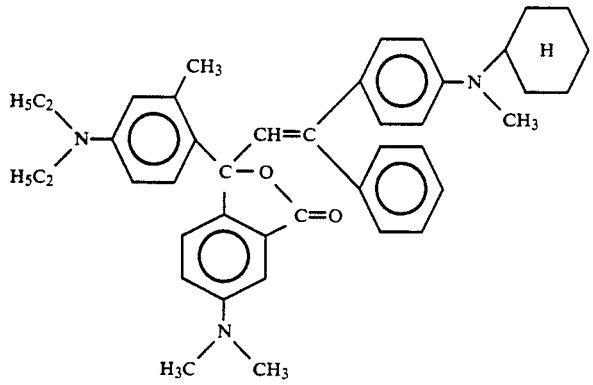
No. 58
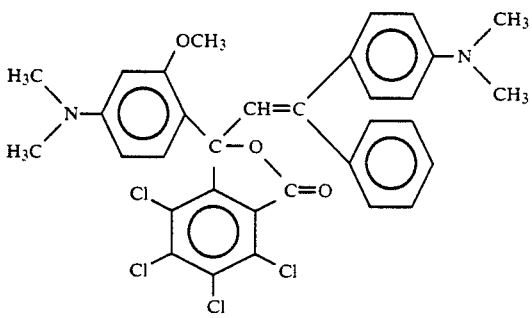
No. 59
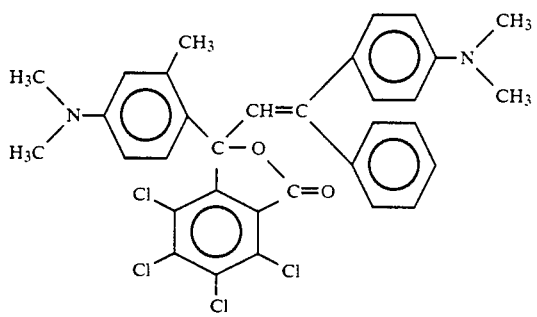
No. 60
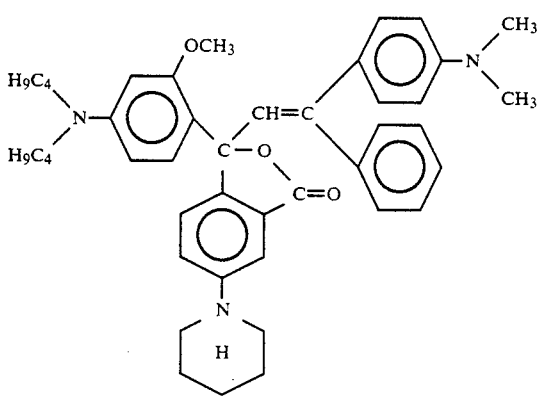

-continued

No. 61

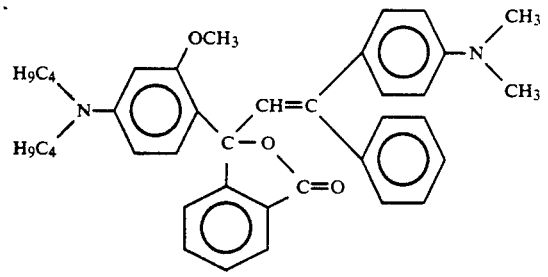

No. 62

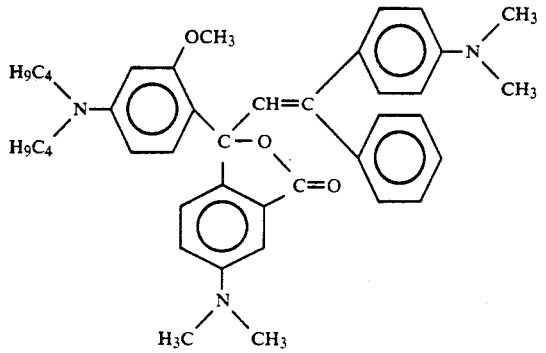

No. 63

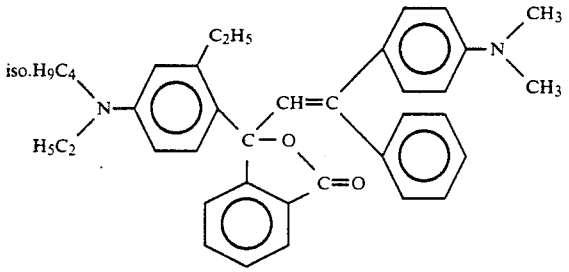

Specific examples of the fluoran leuco dye having the previously mentioned formula (IV) for use in a second thermosensitive coloring layer in the thermosensitive recording material according to the present invention are as follows:

3-(N-p-tolyl-N-ethylamino)-6-methyl-7-anilinofluoran,
3-diethylamino-6-methyl-7-(m-trifluoromethylanilino)-fluoran,
3-diethylamino-7-(o-chloroanilino)fluoran,
3-dibutylamino-7-(o-chloroanilino)fluoran,
3-N-methyl-N-acylamino-6-methyl-7-anilinofluoran,
3-N-methyl-N-cyclohexylamino-6-methyl-7-anilino-fluoran,
3-diethylamino-6-methyl-7-anilinofluoran,
3-diethylamino-6-chloro-7-anilinofluoran,
3-N-ethyl-N-tetrahydrofurfurylamino-6-methyl-7-anilinofluoran, and
3-diethylamino-6-methyl-7-mesidino-4',5'-benzofluoran.

As the color developer for use in the thermosensitive coloring layer in the present invention, various electron acceptors which work upon the above-mentioned leuco dyes to induce color formation, such as phenolic compounds, thiophenolic compounds, thiourea derivatives, and organic acids and metal salts thereof, are preferably employed.

Specific examples of such color developers are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methylphenol),
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea, salicylanilide,
5-chloro-salicylanilide,
2-hydroxy-3-naphthoate,
2-hydroxy-1-naphthoate,
1-hydroxy-2-naphthoate,
metal salts such as zinc, aluminum, calcium of hydroxynaphthoate,
bis-(4-hydroxyphenyl)methyl acetate,
bis-(4-hydroxyphenyl)benzyl acetate,
1,3-bis(4-hydroxycumyl)benzene,
1,4-bis(4-hydroxycumyl)benzene,
2,4'-diphenolsulfone,
3,3'-diallyl-4,4'-diphenolsulfone,
3,4-dihydroxy-4'-methyldiphenylsulfone,
α,α-bis(4-hydroxyphenyl)-α-methyltoluene,
antipyrine complex of zinc thiocyanate,
tetrabromobisphenol A, and
tetrabromobisphenol S.

A variety of conventional binder agents can be employed for binding the leuco dye and color developer to the support of the thermosensitive recording material of the present invention.

Specific examples of the binder agent for use in the present invention are as follows: polyvinyl alcohol; starch and starch derivatives; cellulose derivatives such as methoxycellulose, hydroxyethylcellulose, carboxymethylcellulose, methylcellulose, and ethylcellulose; water-soluble polymers such as sodium polyacrylate, polyvinyl pyrrolidone, acrylamide-acrylic acid ester copolymer, acrylamide-acrylic acid ester-methacrylic acid terpolymer, alkali salts of styrene-maleic anhydride copolymer, alkali salts of isobutylene-maleic anhydride copolymer, polyacrylamide, sodium alginate, gelatin, and casein; emulsions such as polyvinyl acetate, polyurethane, polyacrylic acid ester, polymethacrylic acid ester, vinyl chloride-vinyl acetate copolymer, and ethylene-vinyl acetate copolymer; and latexes such as styrene-butadiene copolymer and styrene-butadiene-acrylic acid derivative copolymer.

Moreover, when necessary, auxiliary additive components which are used in the conventional thermosensitive recording materials, such as a filler, a surface active agent, and a thermofusible material (or a lubricant) can be employed with the above-mentioned leuco dye and the color developer in the thermosensitive coloring layer.

Examples of the filler for use in the present invention include finely-divided particles of inorganic fillers such as calcium carbonate, silica, zinc oxide, titanium oxide, aluminum hydroxide, zinc hydroxide, barium sulfate, clay, talc, surface-treated calcium and surface-treated silica; and finely-divided particles of organic fillers such as urea-formaldehyde resin, styrene-methacrylic acid copolymer and polystyrene resin.

Examples of the thermofusible material are as follows; fatty acids such as stearic acid and behenic acid; amides of fatty acids such as stearic acid amide and palmitic acid amide; metal salts of fatty acids such as zinc stearate, aluminum stearate, calcium stearate, zinc palmitate and zinc behenate; p-benzylbiphenyl, terphenyl, triphenyl methane, benzyl p-benzyloxybenzoate, β-benzyloxynaphthalene, phenyl β-naphthoate, phenyl 1-hydroxy-2-naphthoate, methyl 1-hydroxy-2-naphthoate, diphenyl carbonate, dibenzyl terephthalate, dimethyl terephthalate, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis-(phenoxy)butane, 1,4-bis(phenoxy)-2-butene, dibenzoylmethane, 1,4-bis(phenylthio)butane, 1,4-bis(phenylthio)-2-butene, 1,3-bis(2-vinyloxyethoxy)benzene, 1,4-bis(2vinyloxyethoxy)benzene, p-(2-vinyloxyethoxy)biphenyl, p-aryloxybiphenyl, p-propargyloxybiphenyl, dibenzoyloxymethane, 1,3-dibenzoyloxypropane, dibenzyl disulfide, 1,1-diphenylethanol, 1,1-diphenylpropanol, p-(benzyloxy)-benzyl alcohol, 1,3-diphenoxy-2-propanol, N-octadecyl-carbamoyl-p-methoxycarbonyl benzene and N-octadecylcarbamoyl benzene.

In the thermosensitive recording material of the present invention, the conventionally employed overcoat layer may be provided on the thermosensitive coloring layer, the undercoat layer may be interposed between the support and the thermosensitive coloring layer, and the backcoat layer may be provided on the back side of the support, opposite to the thermosensitive coloring layer or preventing the thermal head from wearing, avoiding the sticking problem, and stabilizing the image formation.

As the support for use in the present invention, a sheet of paper is usually employed. In addition to paper, nonwoven fabric, plastic films, synthetic paper, metal foils, and composite sheets comprising the above materials, can also be employed for the support.

The thermosensitive recording material according to the present invention can be employed in various fields just like conventional ones. In particular, since the leuco dyes contained in the thermosensitive recording materials according to the present invention have the advantage of a sufficient absorption intensity in the near infrared region, such thermosensitive recording materials can be used as recording materials for the optical character reader and bar-code reader.

When the thermosensitive recording material according to the present invention is used as a thermosensitive recording adhesive label sheet, a thermosensitive coloring layer comprising the above leuco dye and the color developer is formed on the front side of the support, and an adhesive layer is formed on the back side of the support, with a disposable backing sheet attached to the adhesive layer.

The images formed on the thermosensitive recording material of the present invention can be read by the optical character reader and bar-code reader because the thermosensitive recording material of the present invention comprises a first thermosensitive coloring layer which comprises at least one leuco dye having the absorption intensity in the near infrared region, represented by the previously mentioned formula (I), (II) or (III). Moreover, the thermosensitive recording material of the present invention has the advantages that the background thereof is white and the color tone of the obtained images is black, and that the obtained images are clear and have an excellent heat resistance and light resistance because the thermosensitive recording material of the present invention comprises a second thermosensitive coloring layer comprising at least one leuco dye represented by the previously mentioned formula (IV).

Other features of this invention will become apparent in the course of the following description of exemplary embodiments, which are given for illustration of the invention and are not intended to be limiting thereof.

Example 1

[Formation of First Thermosensitive Coloring Layer]

A dispersion A and a dispersion B were separately prepared by pulverizing and grinding the respective mixtures with the following formulations in a sand grinder for 2 to 4 hours:

| | parts by weight |
|---|---|
| [Dispersion A] | |
| Leuco dye No. 50 having the formula (I) | 20 |
| 10% aqueous solution of polyvinyl alcohol | 20 |
| Water | 60 |
| [Dispersion B] | |
| 4,4'-dihydroxy-3,3'-diallyl diphenylsulfone | 20 |
| Calcium carbonate | 20 |
| 10% aqueous solution of polyvinyl alcohol | 40 |
| Water | 120 |

One part by weight of the dispersion A and 6 parts by weight of the dispersion B were mixed and stirred to prepare a coating liquid for a first thermosensitive coloring layer. The thus prepared coating liquid for the first thermosensitive coloring layer was coated on a sheet of high quality paper with a basis weight of 52 g/m$^2$, in a deposition amount of 2 to 3 g/m$^2$ on a dry basis, and then dried, so that a first thermosensitive coloring layer was formed on the support.

[Formation of Second Thermosensitive coloring Layer ]

A dispersion C and a dispersion D were separately prepared by pulverizing and grinding the respective mixtures with the following formulations in a sand grinder for 2 to 4 hours:

| | parts by weight |
|---|---|
| [Dispersion C] | |
| 3-dibutylamino-6-methyl-7-anilinofluoran | 20 |
| 10% aqueous solution of polyvinyl alcohol | 20 |
| Water | 60 |
| [Dispersion D] | |
| 1,7-bis(4-hydroxyphenylthio)-3,5-dioxaheptane | 20 |
| Calcium carbonate | 20 |
| 10% aqueous solution of polyvinyl alcohol | 40 |
| Water | 120 |

One part by weight of the dispersion C and 6 parts by weight of the dispersion D were mixed and stirred to prepare a coating liquid for a second thermosensitive coloring layer. The thus prepared coating liquid for the second thermosensitive coloring layer was coated on the first thermosensitive coloring layer in a deposition amount of 2 to 3 g/m$^2$ on a dry basis, and then dried, so that a second thermosensitive coloring layer was formed on the first thermosensitive coloring layer.

The produced recording material was subjected to the calendering treatment to have a surface smoothness of 500 to 3000 sec. in terms of Bekk's smoothness, whereby a thermosensitive recording material of the present invention was obtained.

Examples 2 to 7

The procedure for preparing the thermosensitive recording material in Example 1 was repeated except that the leuco dye No. 50 having the formula (I) contained in the dispersion A in Example 1 was respectively replaced b the following leuco dyes shown in Table 1.

TABLE 1

| Example No. | Leuco Dyes to be Used in First Thermosensitive Coloring Layer | Parts by Weight |
|---|---|---|
| Example 2 | Leuco dye No. 3 having the formula (II) | 20 |
| Example 3 | Leuco dye No. 41 having the formula (III) | 20 |
| Example 4 | Leuco dye No. 50 having the formula (I) | 10 |
| | Leuco dye No. 3 having the formula (II) | 10 |
| Example 5 | Leuco dye No. 50 having the formula (I) | 10 |
| | Leuco dye No. 41 having the formula (III) | 10 |
| Example 6 | Leuco dye No. 3 having the formula (II) | 10 |
| | Leuco dye No. 41 having the formula (III) | 10 |
| Example 7 | Leuco dye No. 50 having the formula (I) | 10 |
| | Leuco dye No. 3 having the formula (II) | 10 |
| | Leuco dye No. 41 having the formula (III) | 10 |

Comparative examples 1 to 7

The procedures for preparing the thermosensitive recording materials in Examples 1 to 7 were respectively repeated except that a second thermosensitive coloring layer was not provided, whereby comparative thermosensitive recording materials were obtained.

Comparative Example 8

The same dispersion A, dispersion B, dispersion C and dispersion D as employed in Example 1 were mixed in an amount ratio of 1:6:1:6 and stirred to prepare a coating liquid for a thermosensitive coloring layer. The thus prepared coating liquid for the thermosensitive coloring layer was coated on a sheet of high quality paper with a basis weight of 52 g/m$^2$ in a deposition amount of 4 to 6 g/m$^2$ on a dry basis and then dried. The thermosensitive coloring layer was subjected to the calendering treatment to have a surface smoothness of 500 to 3000 sec. in terms of Bekk's smoothness, whereby a comparative thermosensitive recording material was obtained.

Comparative Example 9

The procedure for preparing the comparative thermosensitive recording material in Comparative Example 8 was repeated except that the dispersion A employed in Comparative Example 8 was replaced by the one prepared in Example 2, whereby a comparative thermosensitive recording material was obtained.

Comparative Example 10

The procedure for preparing the comparative thermosensitive recording material in Comparative Example 8 was repeated except that the dispersion A employed in Comparative Example 8 was replaced by the one prepared in Example 3, whereby a comparative thermosensitive recording material was obtained.

Comparative Example 11

The procedure for preparing the thermosensitive recording material in Example 1 was repeated except that the coating liquid for the second thermosensitive coloring layer employed in Example 1 was replaced by a coating liquid for the first thermosensitive coloring layer, namely, the first thermosensitive coloring layer was overlaid on the first thermosensitive coloring layer, whereby a comparative thermosensitive recording material was obtained.

Then the thermosensitive recording materials thus obtained in Examples 1 to 7 and comparative thermosensitive recording materials obtained in Comparative Examples 1 to 11 were subjected to a dynamic thermal coloring sensitivity test, a heat resistance test and a light resistance test. Each test method was as follows:

(1) Dynamic Thermal Coloring Sensitivity Test

Each recording material was loaded in a printing test apparatus equipped with a commercially available thin film head (made by Matsushita Electronic Components Co., Ltd.), and images were formed on each recording material under the following conditions:

| | |
|---|---|
| Head power: | 0.68 W/dot |
| Recording time: | 10 msec/line |
| Scanning line density: | 8 × 3.85 dots/mm |
| Pulse width: | 0.9 msec. |

The density of the images formed on each thermosensitive recording material was measured with Macbeth densitometer RD-914 with a filter w-106, and the reflectance of the image area was measured with a commercially available spectrophotometer (Trademark "Hitachi Type 330 Spectrophotometer" made by Hitachi, Ltd.) when the near infrared rays with a wavelength of 800 nm was applied thereto.

(2) Preservability Test

Using the thermosensitive recording materials, test samples were prepared by printing the images on each recording material in the same manner as in the dynamic thermal coloring sensitivity test.

(i) Heat Resistance Test

The above test samples were allowed to stand at 70° C. in a dry atmosphere for 24 hours, and then the density and the reflectance of the background were measured with the same measuring apparatus as in the dynamic thermal coloring sensitivity test.

(ii) Light Resistance Test

The above test samples were illuminated by a lamp of 5000 lux for 100 hours, and then the density and the reflectance of the image area were measured with the same measuring apparatus as in the dynamic thermal coloring sensitivity test.

The results of the above tests are shown in Table 2.

| | | | Dynamic Thermal Coloring Sensitivity | | Heat Resistance | | Light Resistance | |
|---|---|---|---|---|---|---|---|---|
| Example No. | Color of Background | Color Tone of Obtained Image | Image Density (A)* | Reflectance of Image (B)** | Density of Background (A) | Reflectance of Background (B) | Image Density (A) | Reflectance of Image (B) |
| Example 1 | White | Black | 1.35 | 6 | 0.13 | 83 | 1.33 | 15 |
| Example 2 | White | Black | 1.37 | 9 | 0.15 | 79 | 1.34 | 19 |
| Example 3 | White | Black | 1.34 | 5 | 0.14 | 81 | 1.33 | 14 |
| Example 4 | White | Black | 1.38 | 8 | 0.15 | 80 | 1.36 | 17 |
| Example 5 | White | Black | 1.36 | 5 | 0.16 | 80 | 1.34 | 14 |
| Example 6 | White | Black | 1.37 | 7 | 0.14 | 79 | 1.34 | 17 |
| Example 7 | White | Black | 1.38 | 6 | 0.17 | 78 | 1.34 | 17 |
| Comparative Example 1 | Light yellow | Reddish black | 0.92 | 5 | 0.11 | 88 | 0.52 | 48 |
| Comparative Example 2 | Light yellow | Bluish purple | 1.10 | 8 | 0.12 | 80 | 0.46 | 55 |
| Comparative Example 3 | Light yellow | Green | 0.84 | 4 | 0.10 | 86 | 0.55 | 45 |
| Comparative Example 4 | Light yellow | Bluish black | 1.04 | 8 | 0.11 | 86 | 0.50 | 53 |
| Comparative Example 5 | Light yellow | Reddish black | 1.00 | 5 | 0.12 | 85 | 0.49 | 46 |
| Comparative Example 6 | Light yellow | Bluish black | 0.88 | 6 | 0.11 | 86 | 0.47 | 50 |
| Comparative Example 7 | Light yellow | Bluish black | 0.98 | 6 | 0.13 | 85 | 0.51 | 52 |
| Comparative Example 8 | Light yellow | Black | 1.33 | 5 | 0.25 | 76 | 1.28 | 53 |
| Comparative Example 9 | Light yellow | Black | 1.35 | 7 | 0.26 | 72 | 1.25 | 60 |
| Comparative Example 10 | Light yellow | Black | 1.30 | 4 | 0.25 | 70 | 1.25 | 50 |
| Comparative Example 11 | Light yellow | Reddish black | 1.33 | 5 | 0.22 | 75 | 1.26 | 52 |

(*)A: in the visual spectrum
(**)B: in the near infrared region

It is obvious from Table 2 that the thermosensitive recording materials of the present invention can produce the clear black images on the white background, and moreover, they have excellent heat resistance and light resistance.

What is claimed is:

1. A thermosensitive recording material comprising: a support, and a thermosensitive coloring layer formed on said support, which thermosensitive coloring layer comprises at least a first thermosensitive coloring layer which comprises at least one leuco dye selected from the group consisting of leuco dyes having formulas (I), (II) and (III) and a color developer capable of inducing color formation in said leuco dye under application of heat thereto, and a second thermosensitive coloring layer which comprises at least one leuco dye having formula (IV) and a color developer capable of inducing color formation in said leuco dye under application of heat thereto:

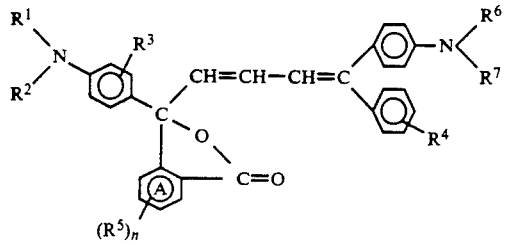

(I)

wherein $R^1$ and $R^2$ each represent a lower alkyl group having 1 to 8 carbon atoms, a substituted alkyl group having 1 to 8 carbon atoms, an aralkyl group which may have a substituent, or an aryl group which may have a substituent; $R^3$ represents hydrogen, a lower alkyl group having 1 to 8 carbon atoms, an alkoxyl group having 1 to 8 carbon atoms, or an aralkyloxy group; $R^4$ represents hydrogen, a lower alkyl group having 1 to 8 carbon atoms, an alkoxyl group having 1 to 8 carbon atoms, a halogen, or a dialkylamino group having 1 to 8 carbon atoms; $R^5$ represents hydrogen, a halogen, or a dialkylamino group having 1 to 8 carbon atoms; $R^6$ and $R^7$ each represent a lower alkyl group having 1 to 8 carbon atoms;

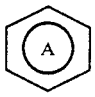

represents a benzene ring or a naphthalene ring; and n is an integer of 1 to 4;

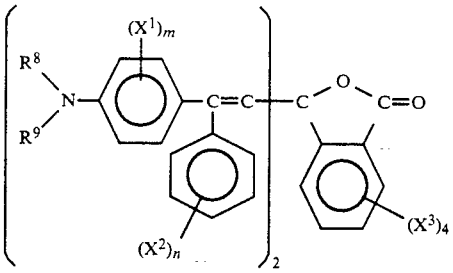

(II)

wherein $R^8$ represents an alkyl group having 8 carbon atoms or less; $R^9$ represents an alkyl group having 8 carbon atoms or less, a cycloalkyl group having 5 to 7 carbon atoms, or a benzyl group or a phenyl group which may be substituted with chlorine, bromine, or an alkyl group having 4 carbon atoms or less; $X^1$ and $X^2$ each represent an alkyl group having 8 carbon atoms or less, an alkoxyl group having 8 carbon atoms or less, fluorine, chlorine, or bromine provided that each $X^1$ may be the same or different and each $X^2$ may also be the same or different; $X^3$ represents chlorine or bromine; and m and n are integers of 0 to 3;

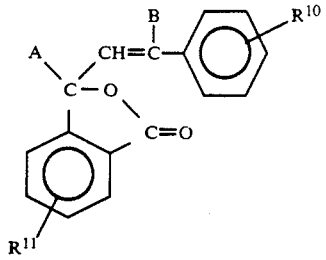

(III)

wherein A represents

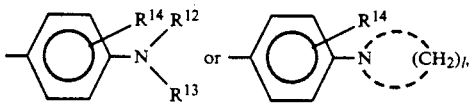

in which $R^{12}$ and $R^{13}$ each represent an alkyl group having 1 to 8 carbon atoms, a cycloalkyl group, or a benzyl group; $R^{14}$ represents hydrogen, an alkyl group having 1 to 8 carbon atoms, or an alkoxyl group having 1 to 8 carbon atoms; and l is an integer of 4 to 6, B represents

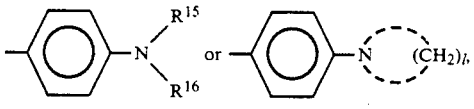

in which $R^{15}$ and $R^{16}$ each represent an alkyl group having 1 to 8 carbon atoms or a benzyl group; and l is an integer of 4 or 6, $R^{10}$ represents hydrogen, an alkyl group having 1 to 8 carbon atoms, a halogen, or a nitro group; and $R^{11}$ represents hydrogen, an alkyl group having 1 to 8 carbon atoms, an alkylamino group having 1 to 8 carbon atoms, a dialkylamino group having 1 to 8 carbon atoms, a cyclic amino group, an amino group, or a halogen;

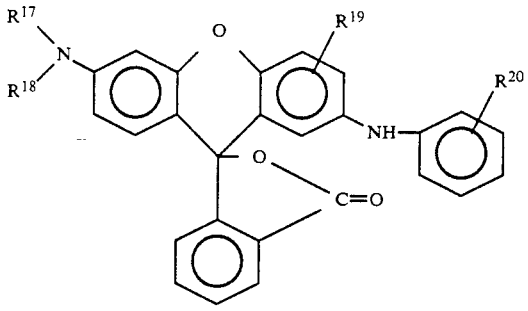

(IV)

wherein $R^{17}$ and $R^{18}$ each represent a saturated or unsaturated hydrocarbon group having 1 to 10 carbon atoms, which may be cyclic or non-cyclic, and may have an ether linkage; $R^{19}$ represents a hydrocarbon group having 1 to 2 carbon atoms or a halogen; and $R^{20}$ represents hydrogen, a halogen, or a hydrocarbon group having 1 to 6 carbon atoms.

2. The thermosensitive recording material as claimed in claim 1, wherein said leuco dye having said formula (I) for use in said first thermosensitive coloring layer is selected from the group consisting of:

No. 1
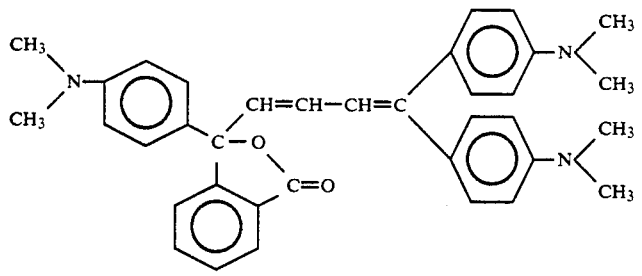
No. 2
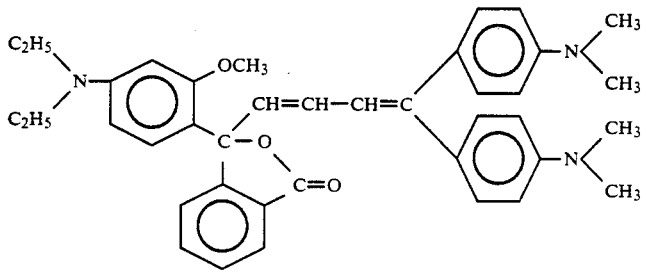
No. 3
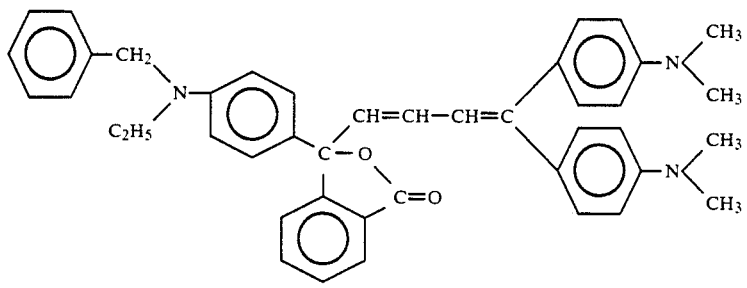
No. 4
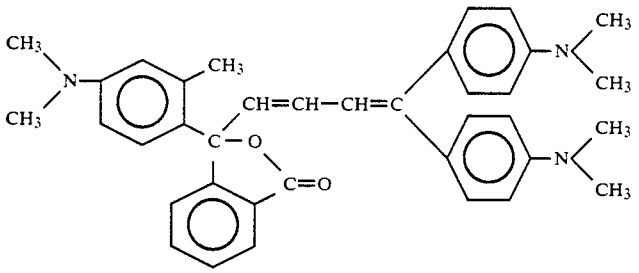
No. 5
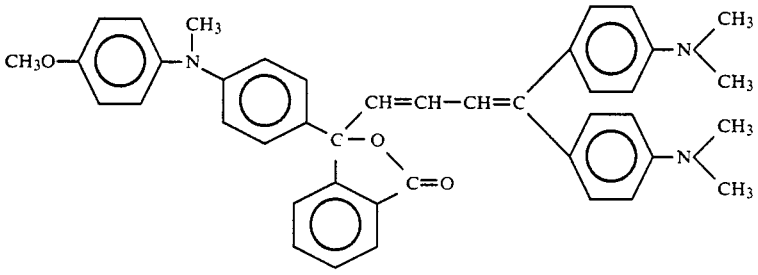

-continued
No. 6
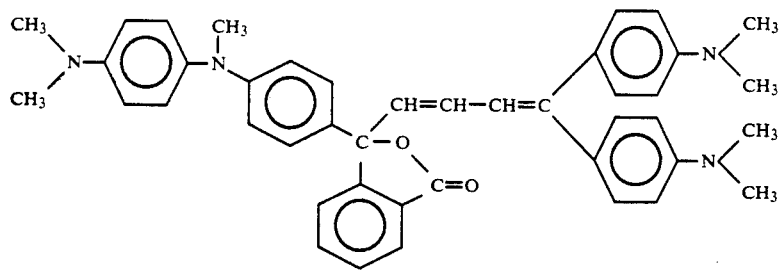
No. 7
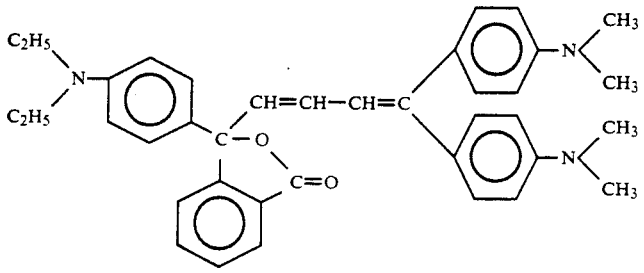
No. 8
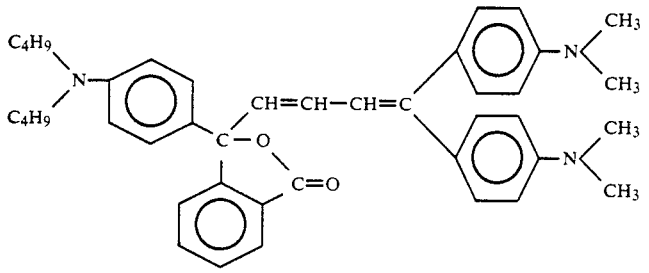
No. 9
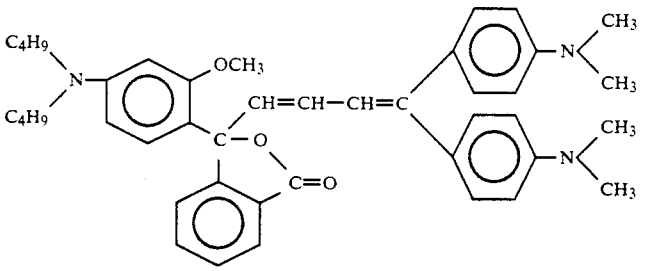
No. 10
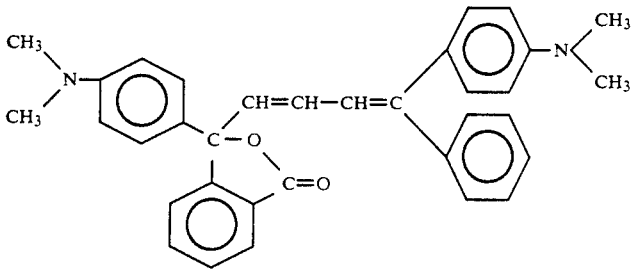

-continued
No. 11
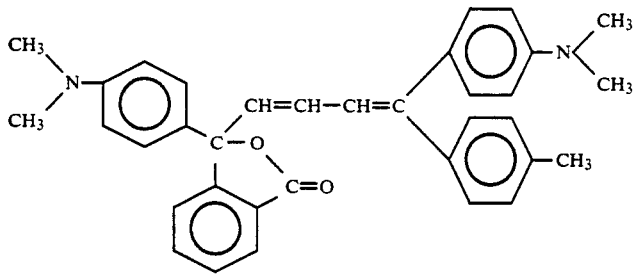
No. 12
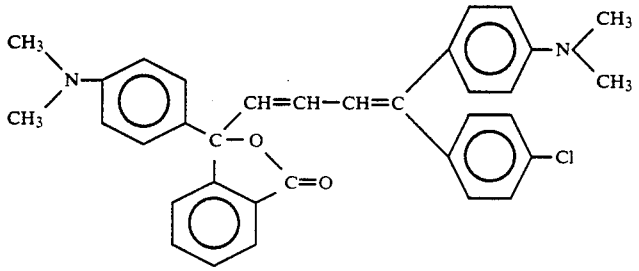
No. 13
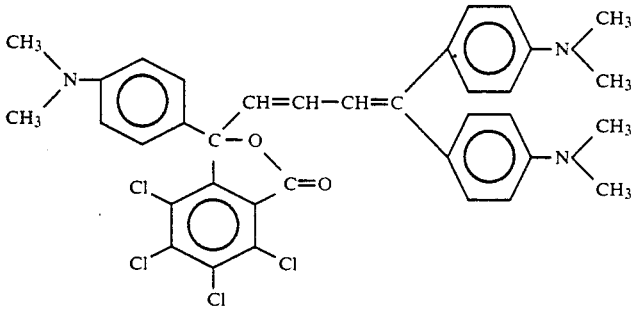
No. 14
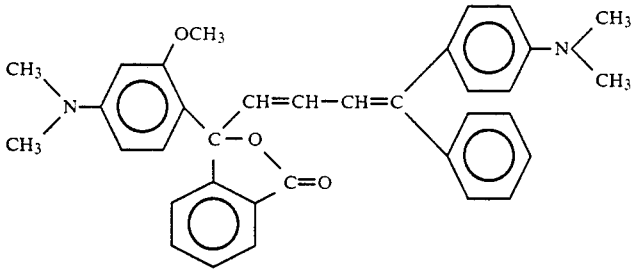
No. 15
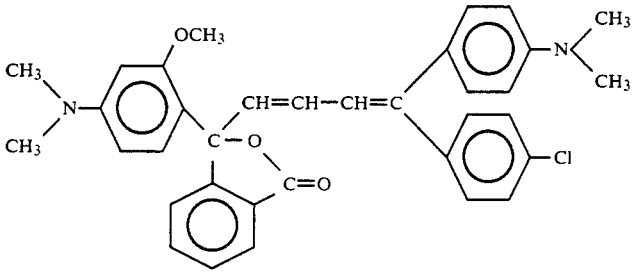

-continued
No. 16
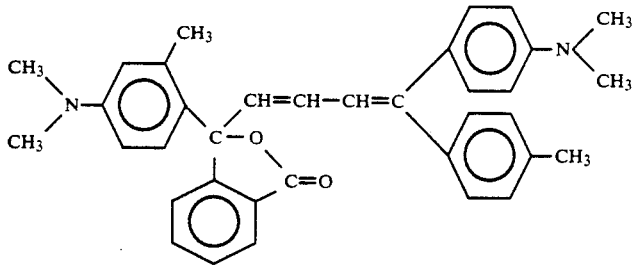
No. 17
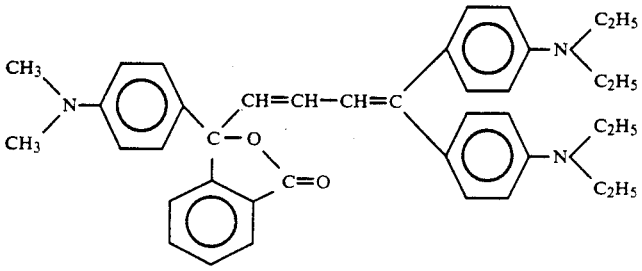
No. 18
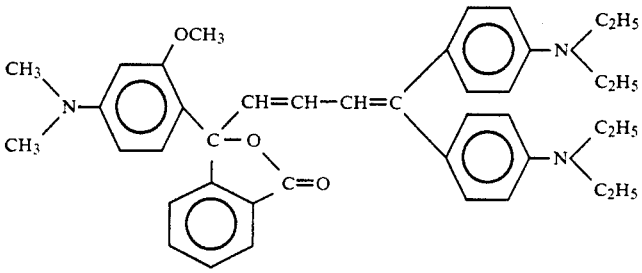
No. 19
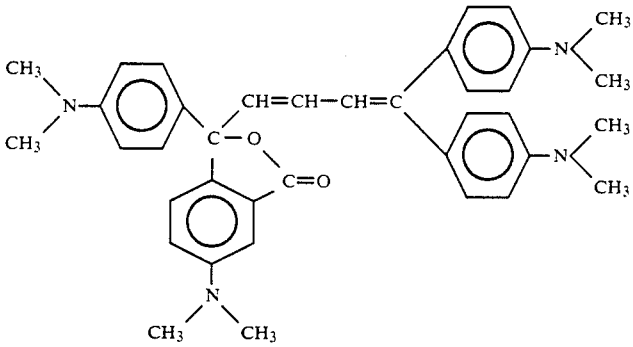
No. 20
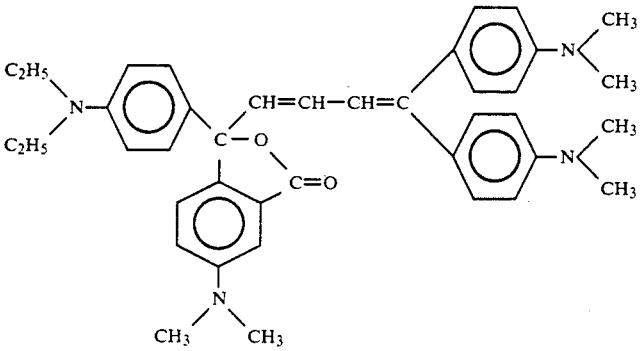

-continued
No. 21
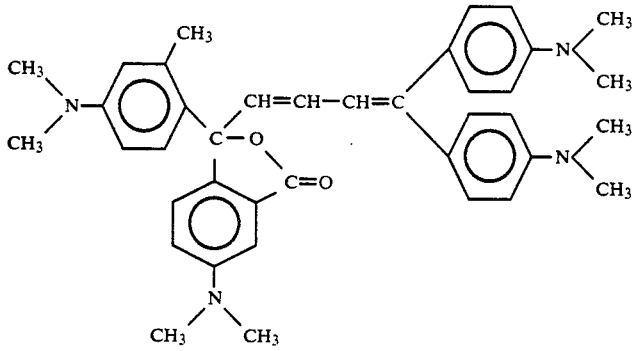
No. 22
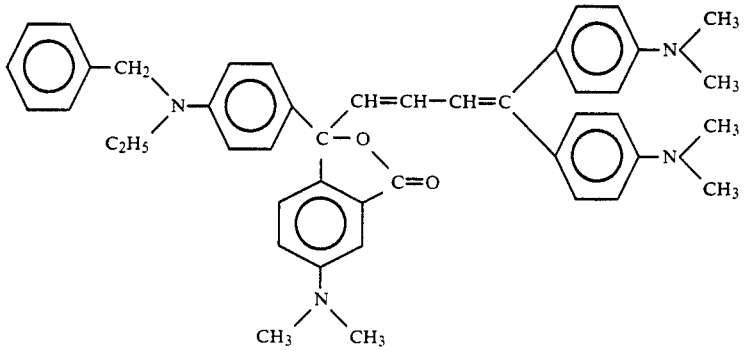
No. 23
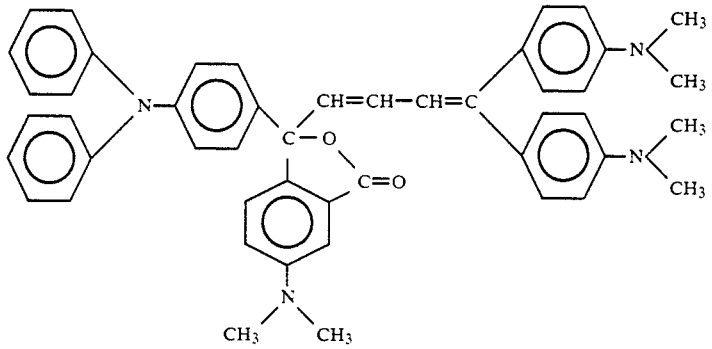
No. 24
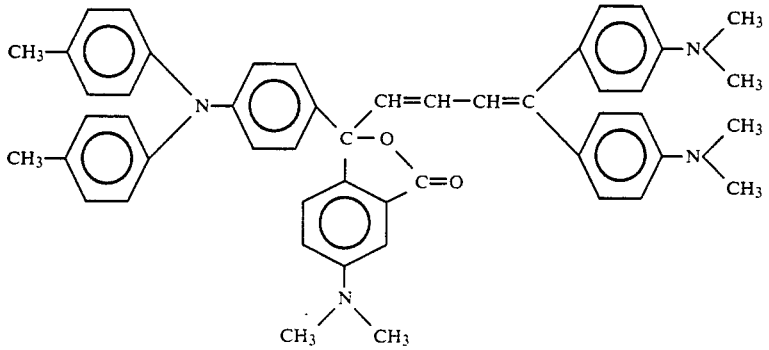

-continued
No. 25
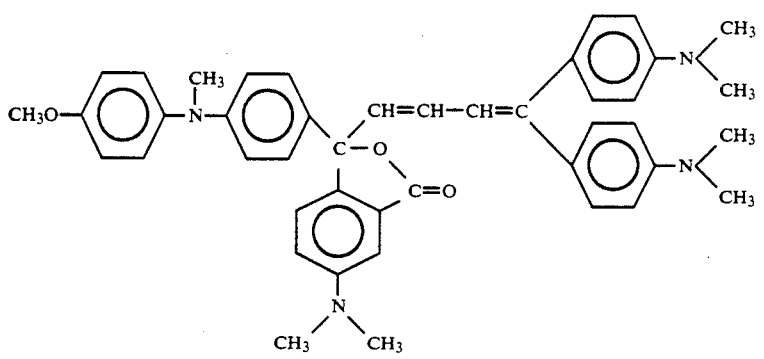
No. 26
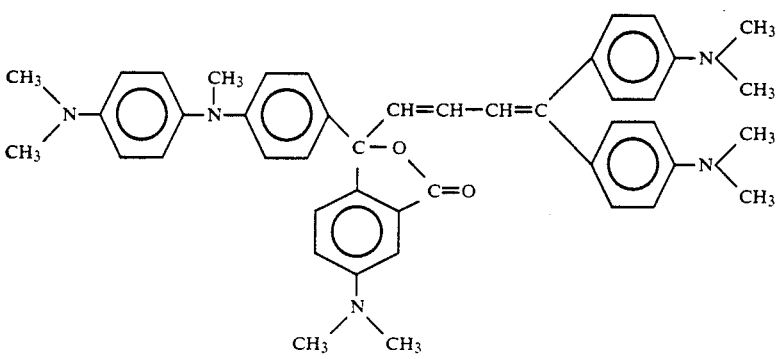
No. 27
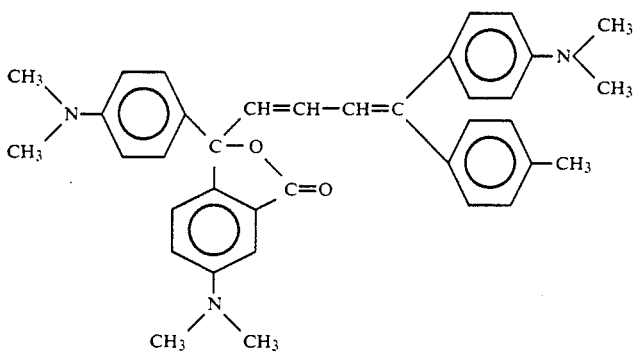
No. 28
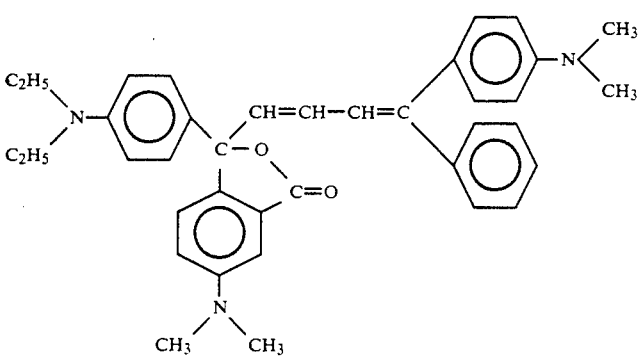

-continued
No. 29
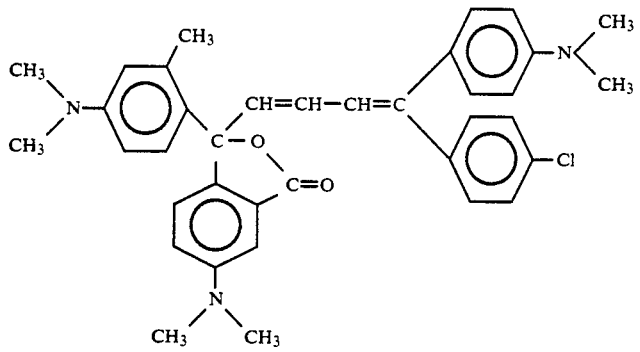
No. 30
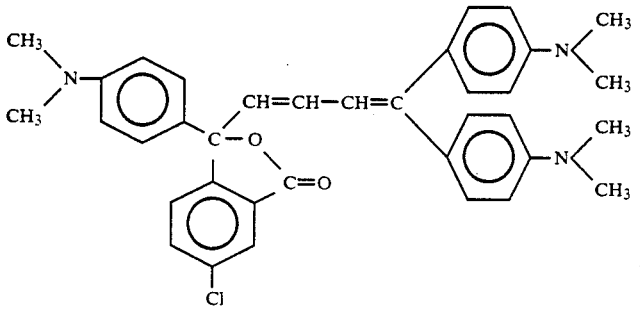
No. 31
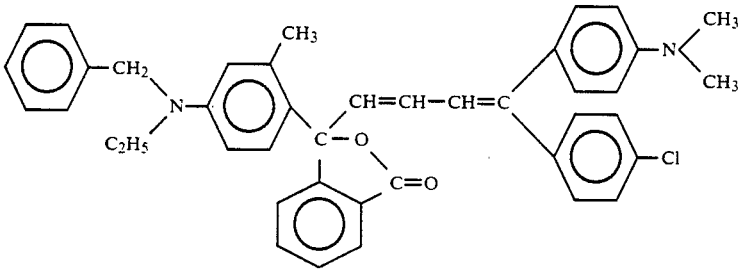
No. 32
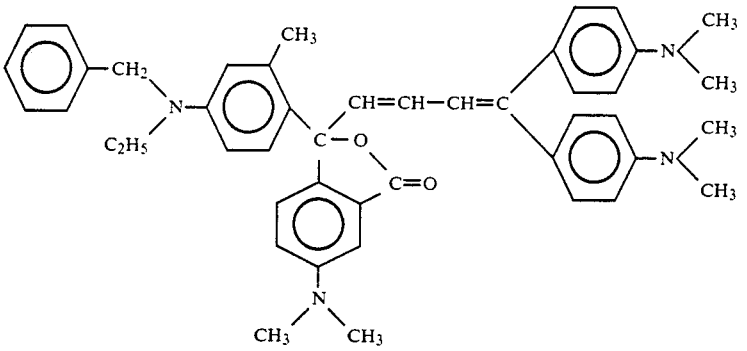
No. 33
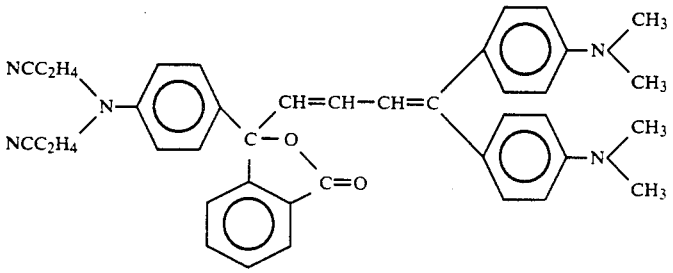

-continued
No. 34
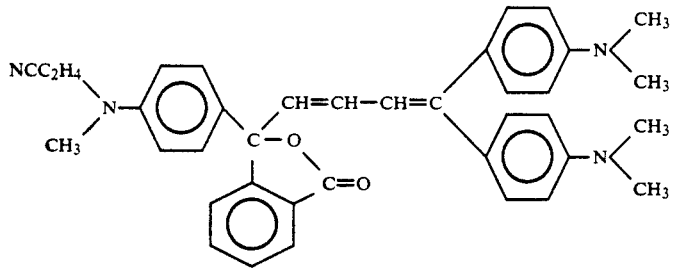
No. 35
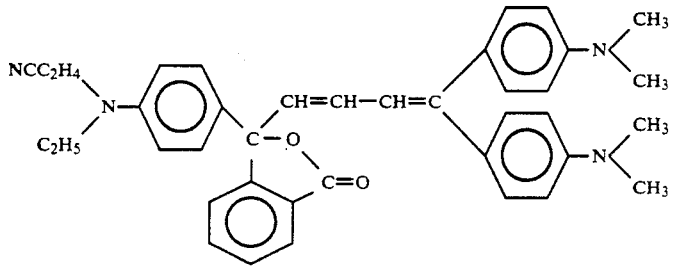
No. 36
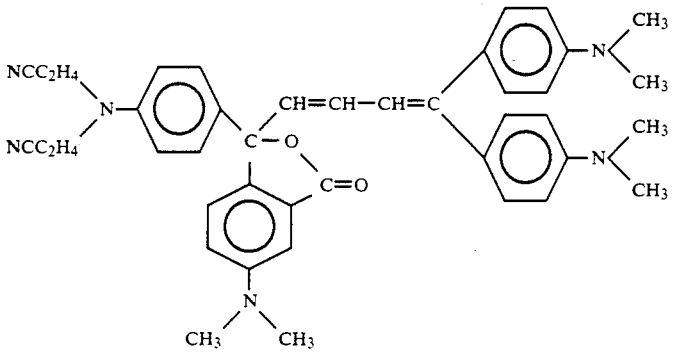
No. 37
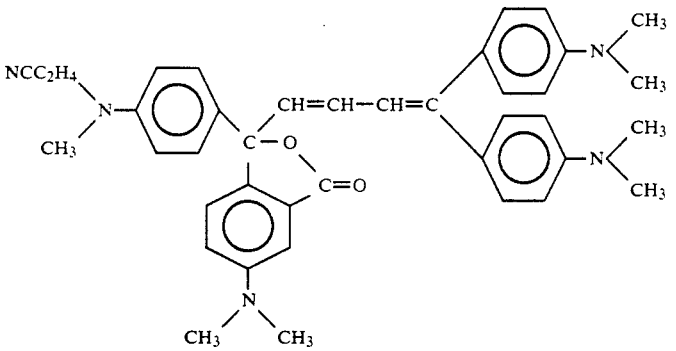
No. 38
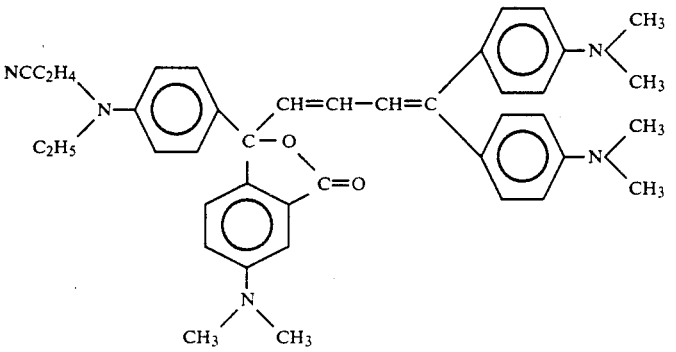

-continued
No. 39
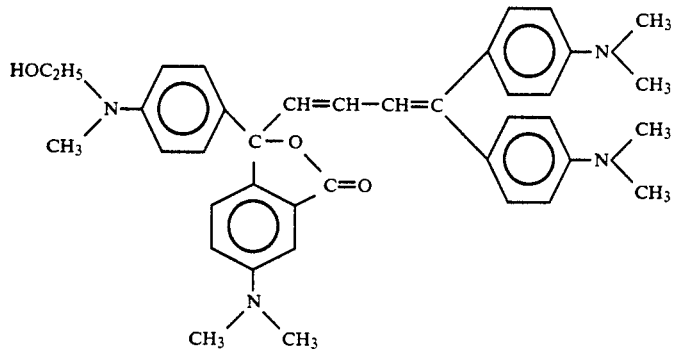
No. 40
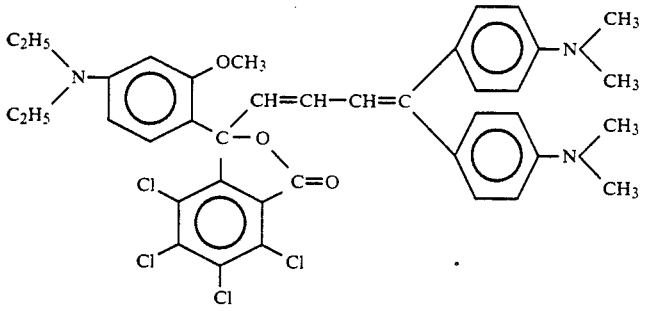
No. 41
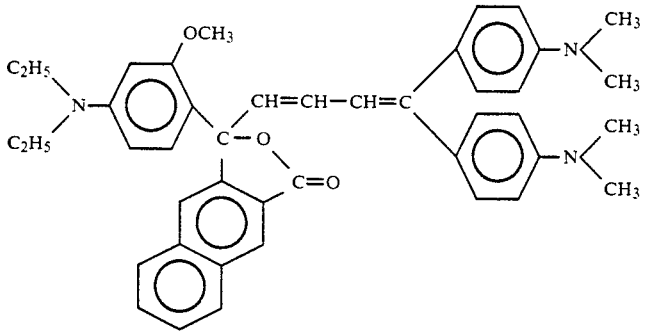
No. 42
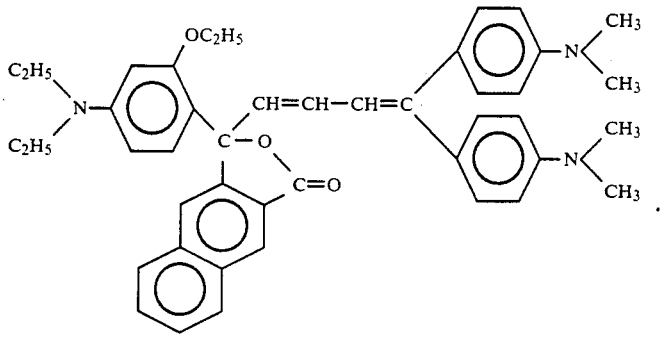

-continued
No. 43
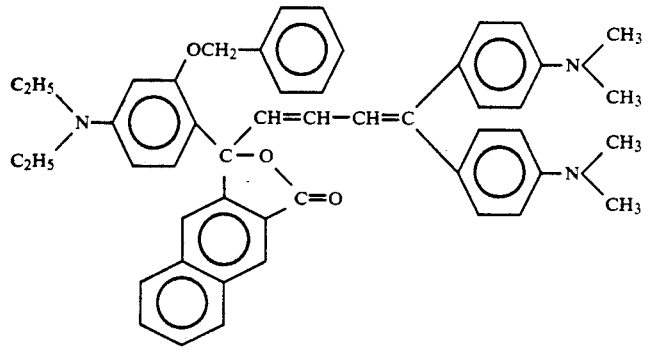
No. 44
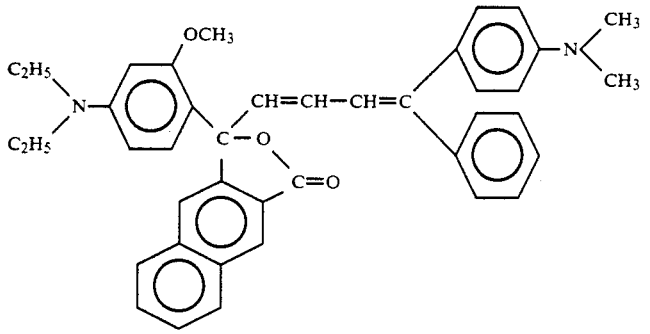
No. 45
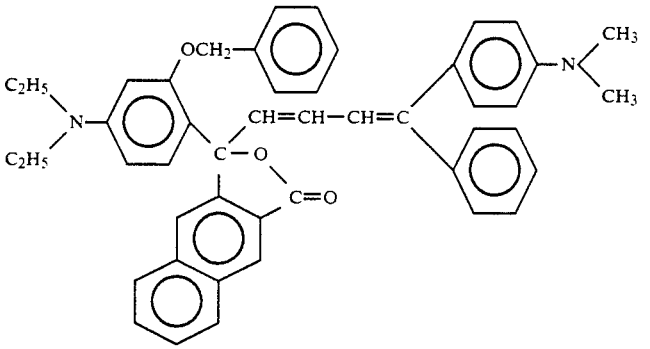
No. 46
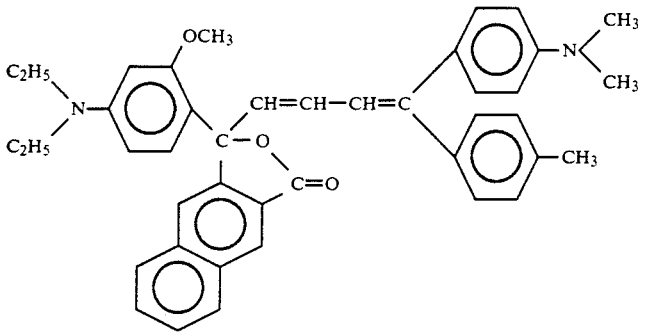

-continued
No. 47
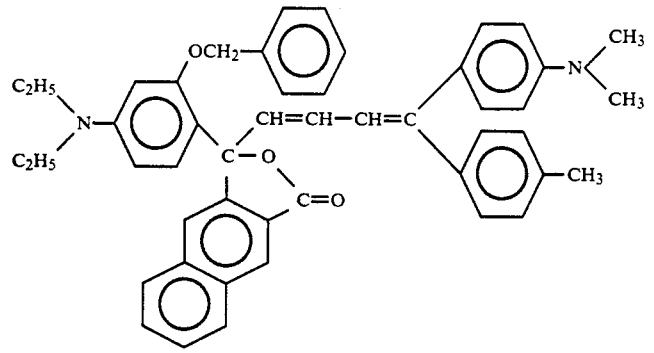
No. 48
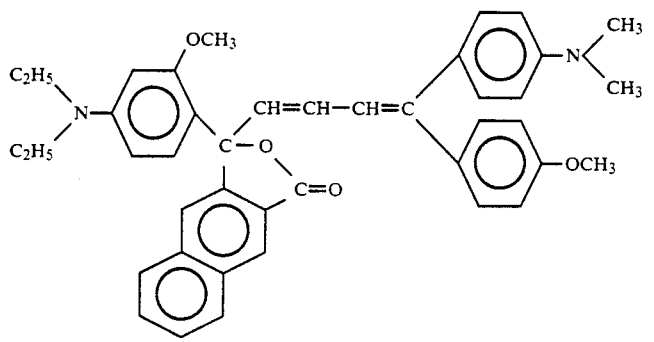
No. 49
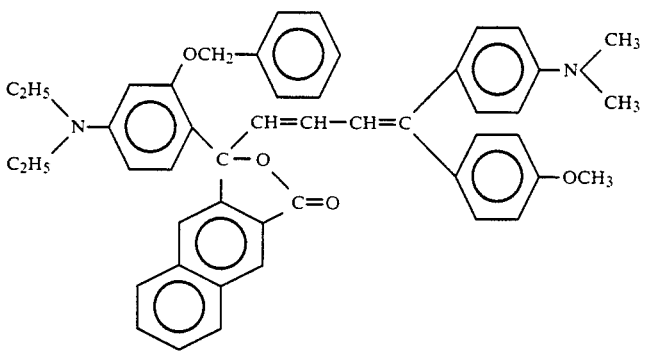
No. 50
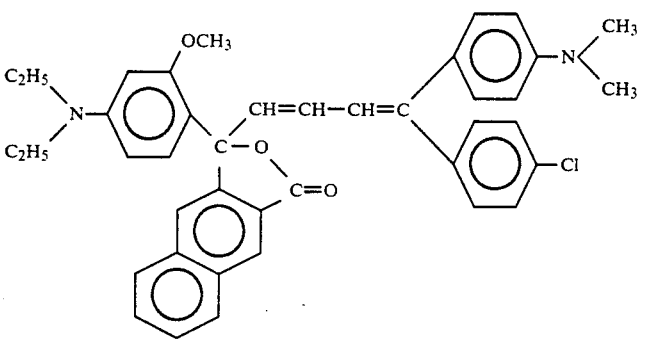

-continued
No. 51
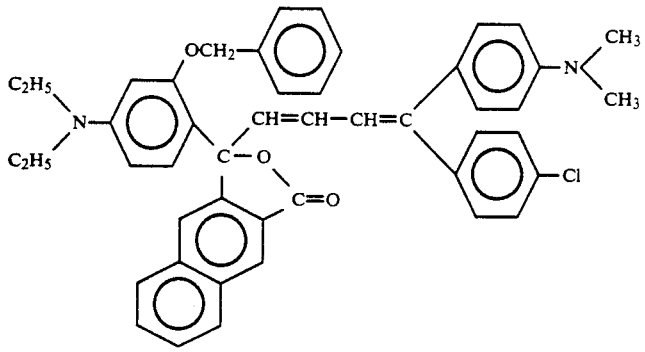
No. 52
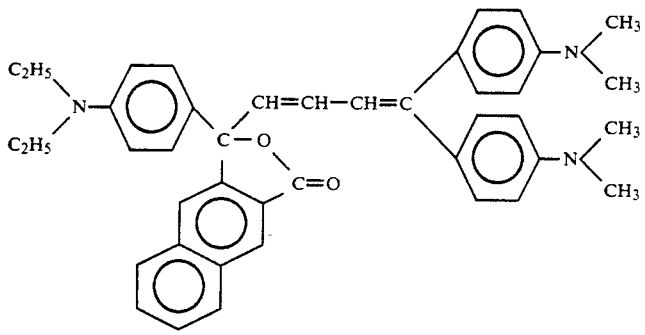
No. 53
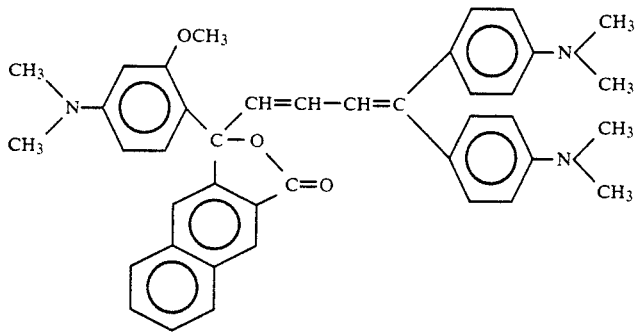
No. 54
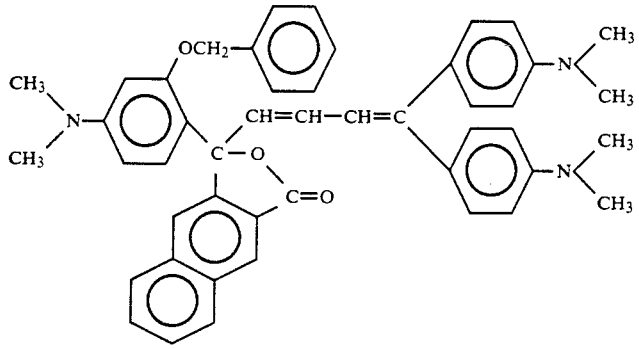

-continued
No. 55
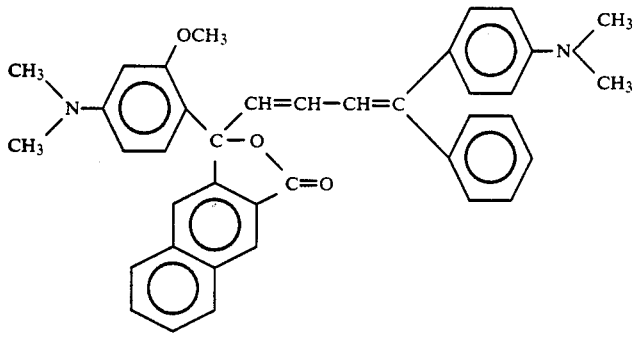
No. 56
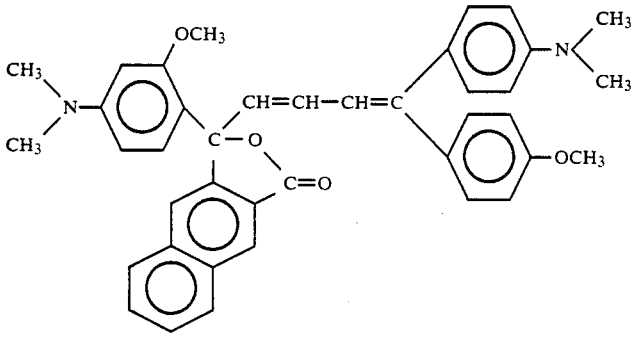
No. 57
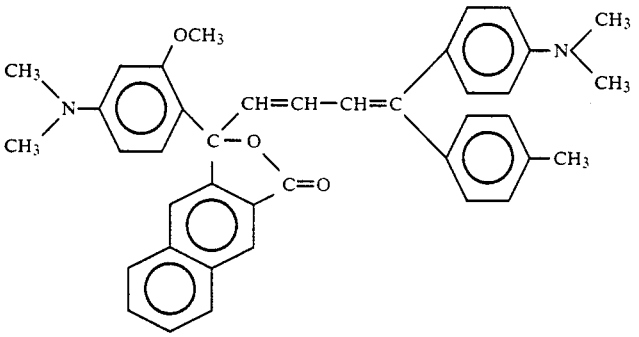
No. 58
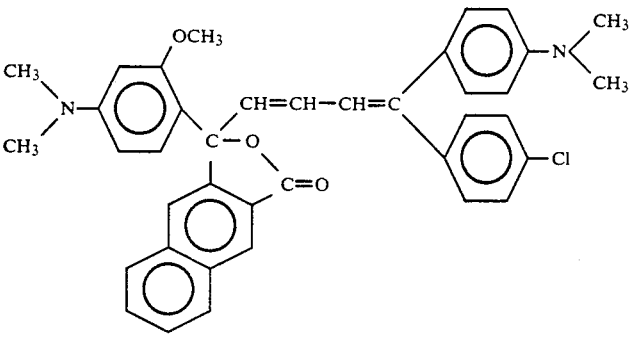

-continued
No. 59
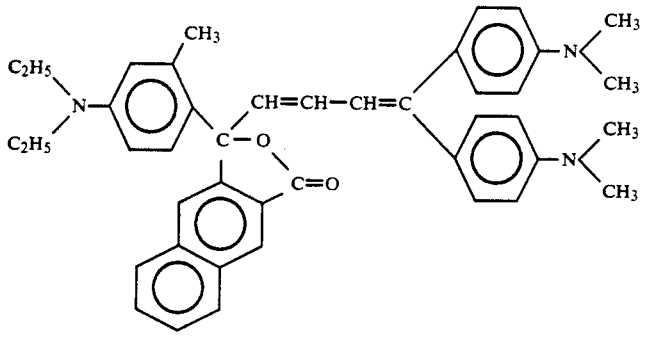
No. 60
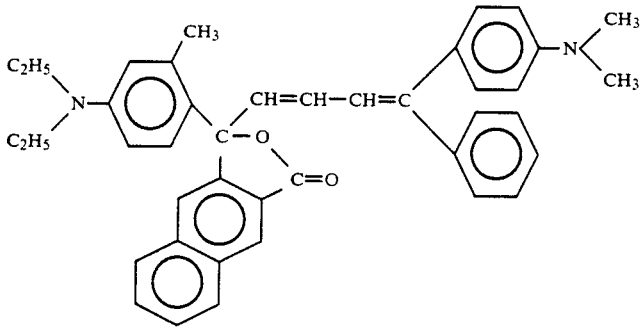
No. 61
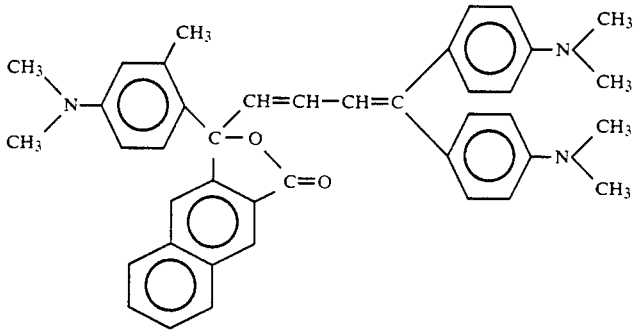
No. 62
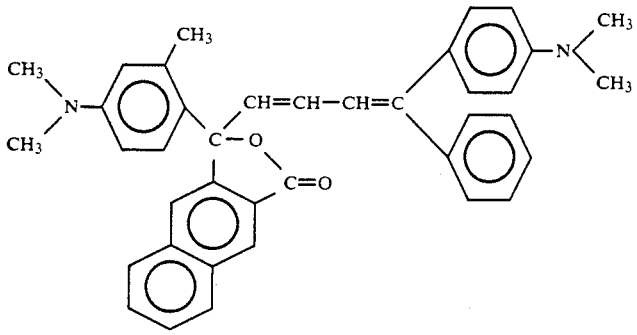

-continued
No. 63
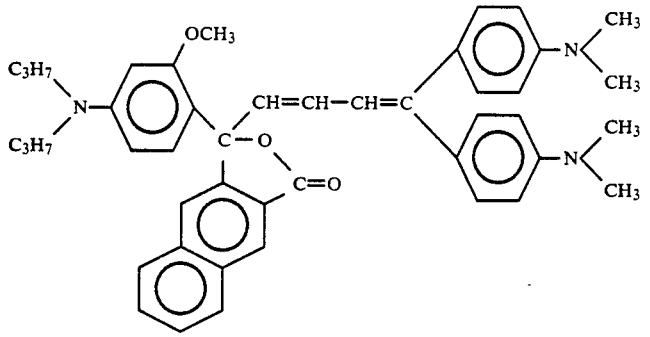
No. 64
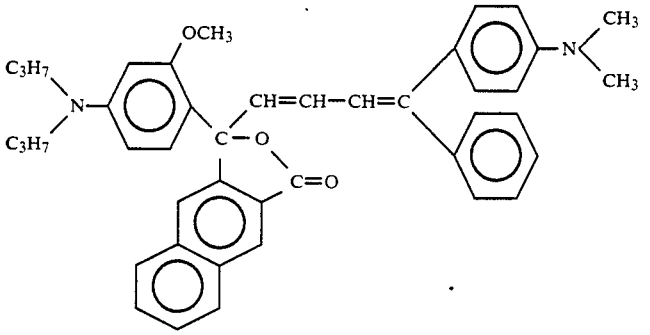
No. 65
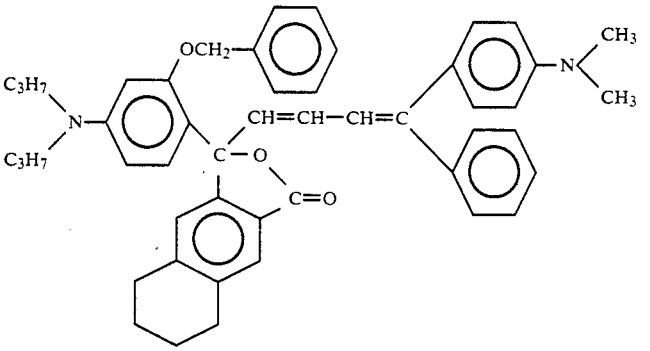
No. 66
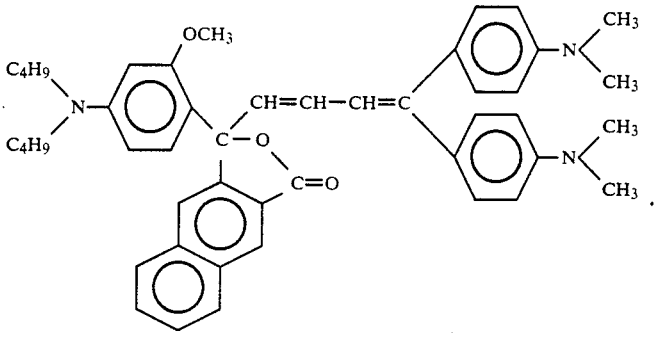

-continued
No. 67
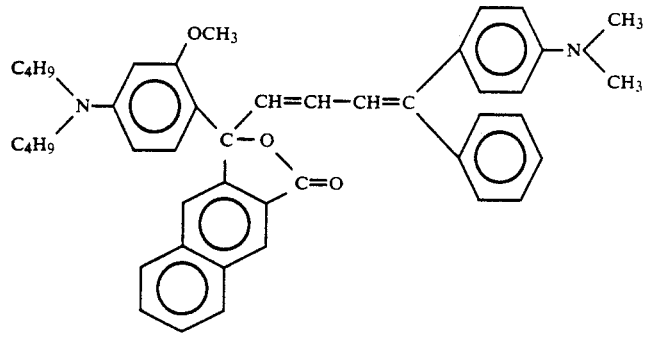
No. 68
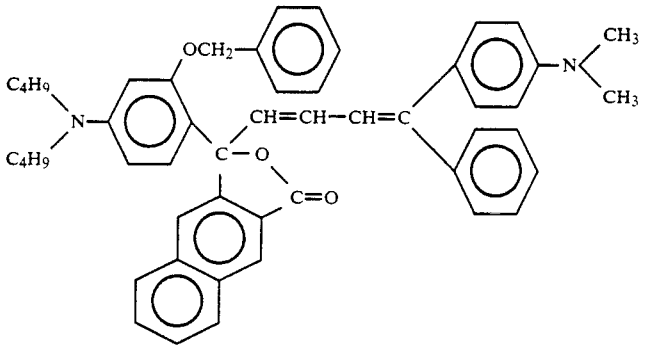
No. 69
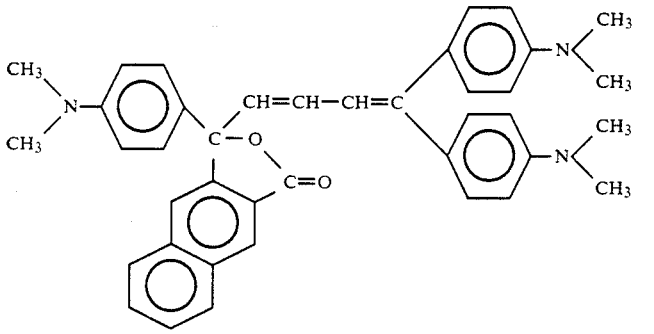
No. 70
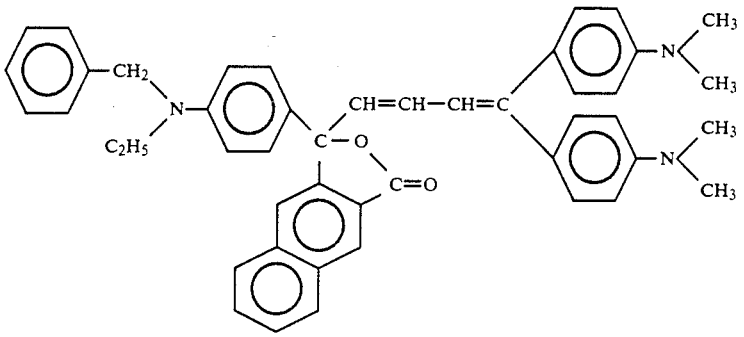

-continued
No. 71
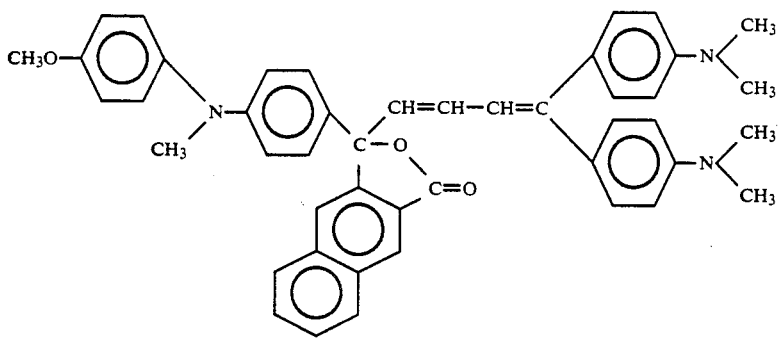
No. 72
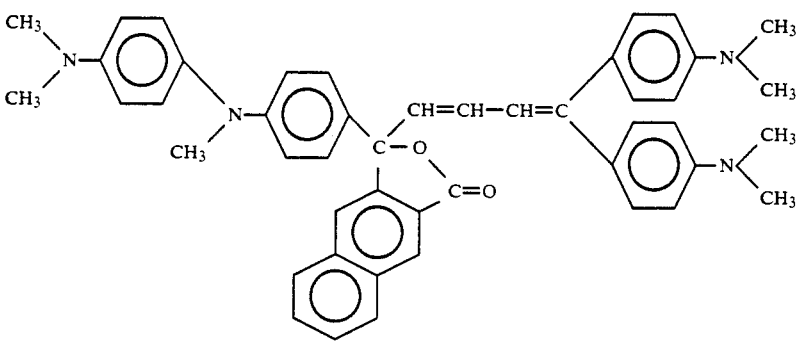
No. 73
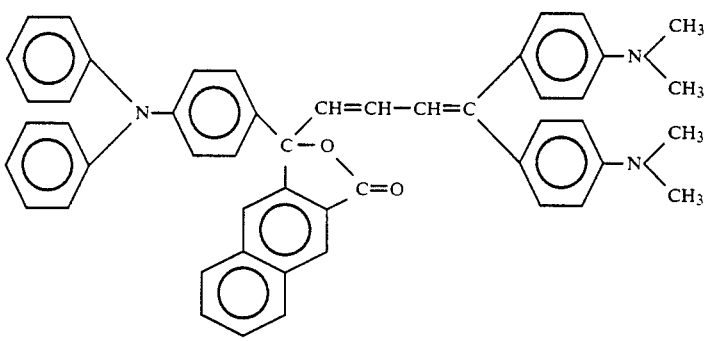
No. 74
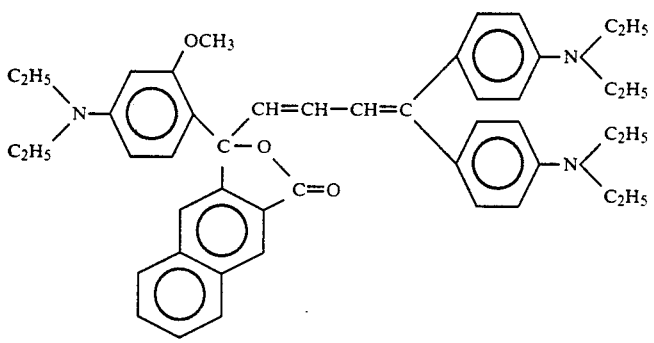

-continued
No. 75
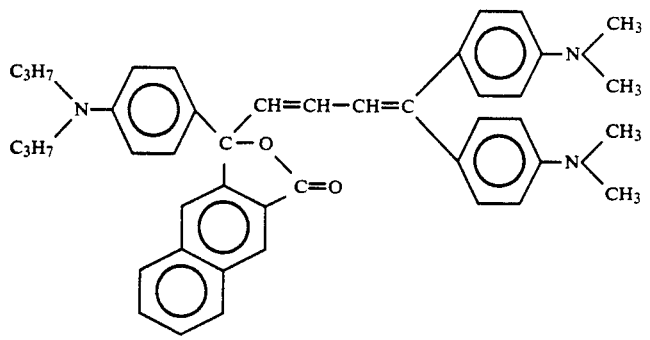
No. 76
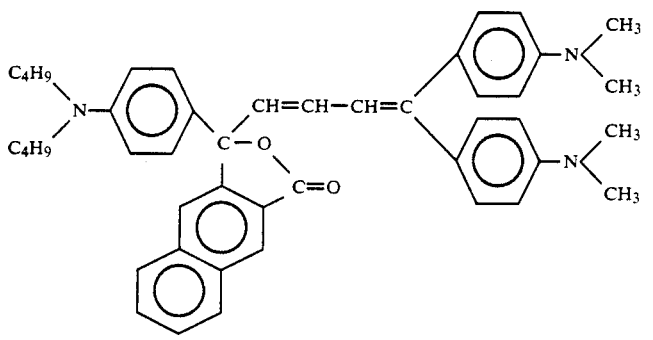
No. 77
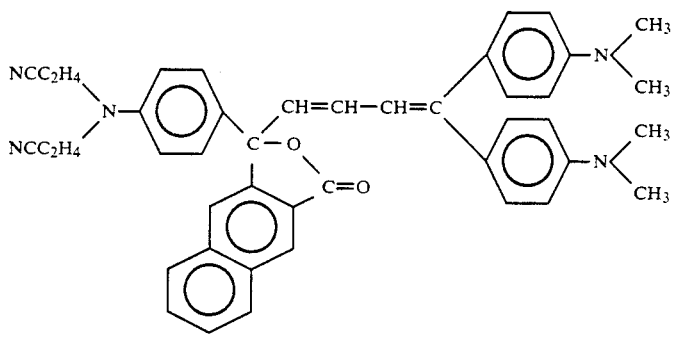
No. 78
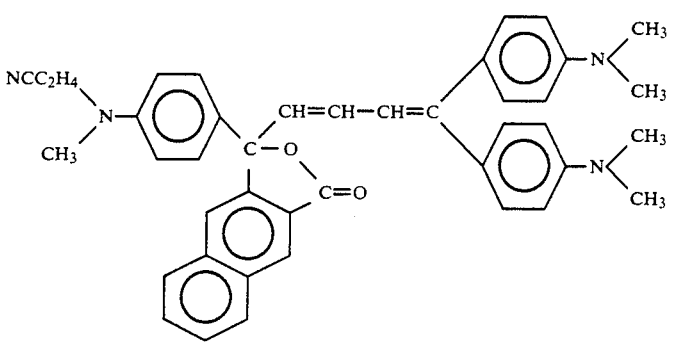

-continued
No. 79
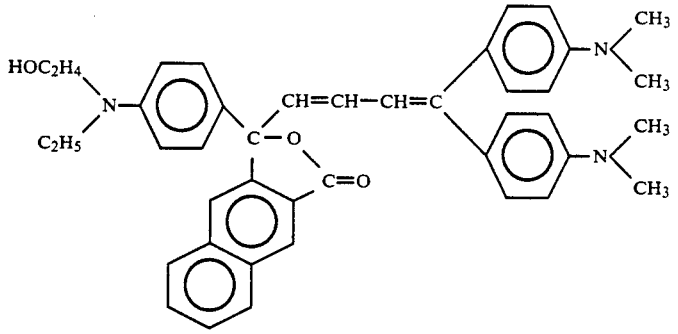
No. 80
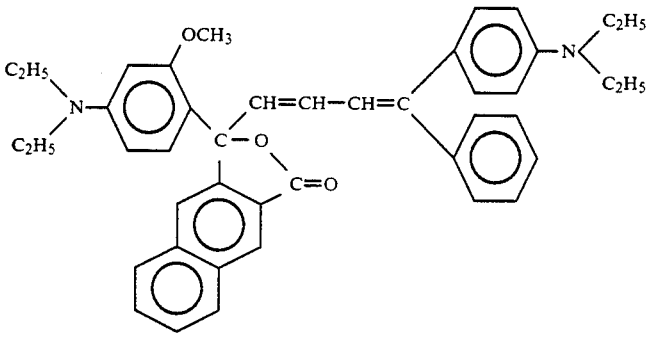
No. 81
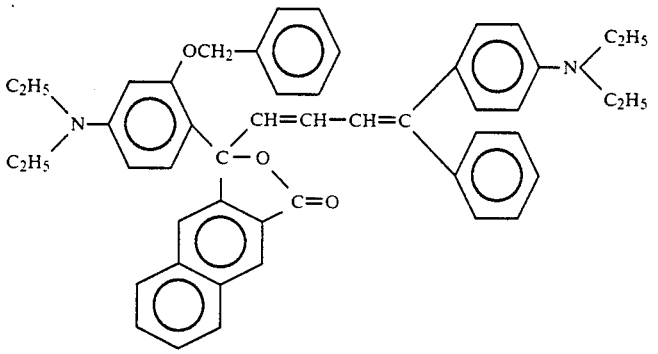
No. 82
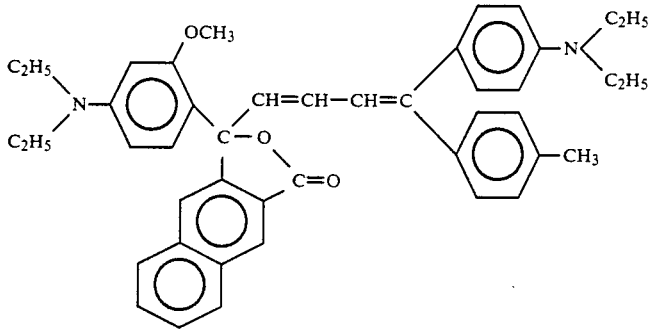

-continued
No. 83
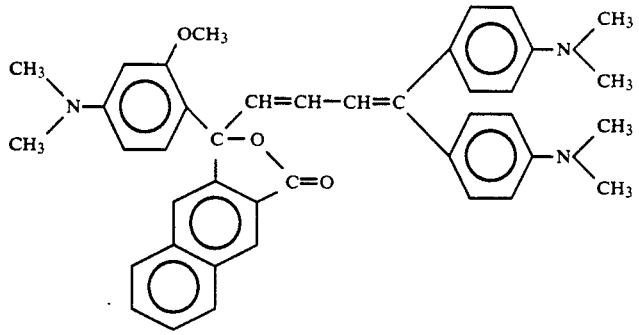
No. 84
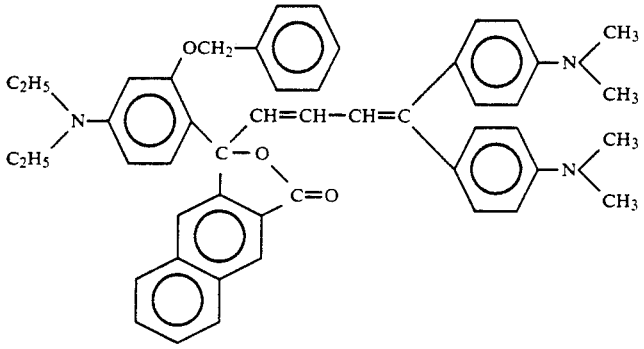
No. 85
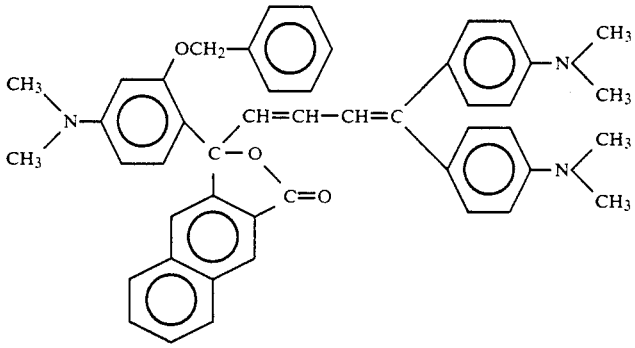
No. 86
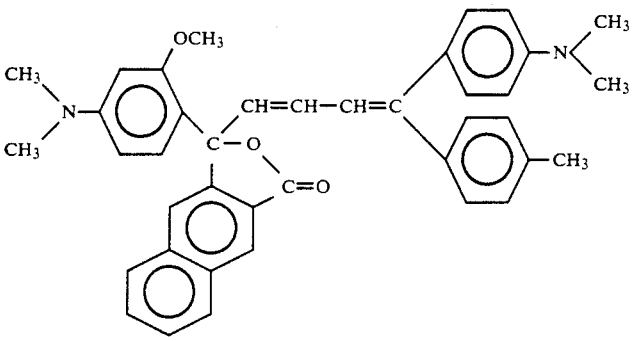

-continued
No. 87
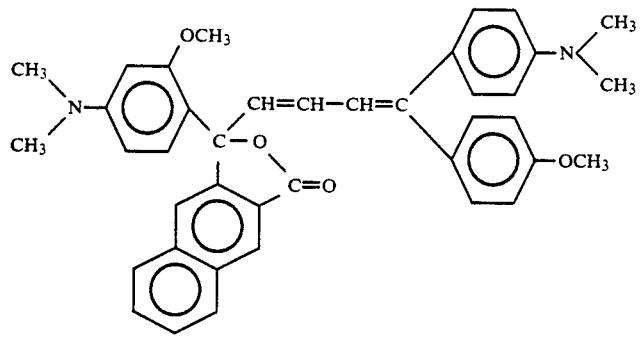
No. 88
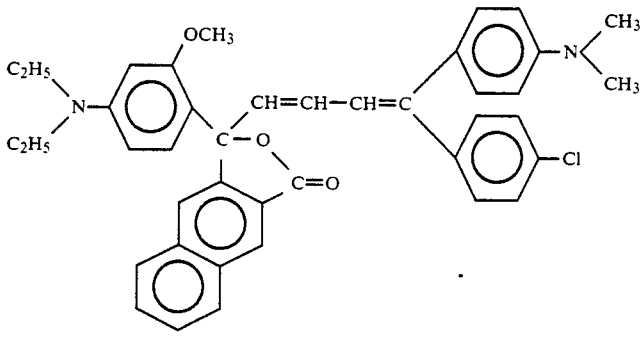
No. 89
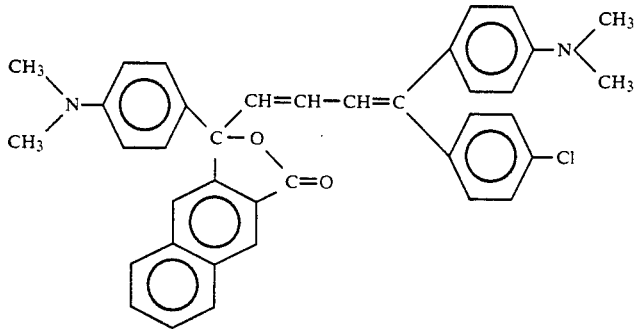
No. 90
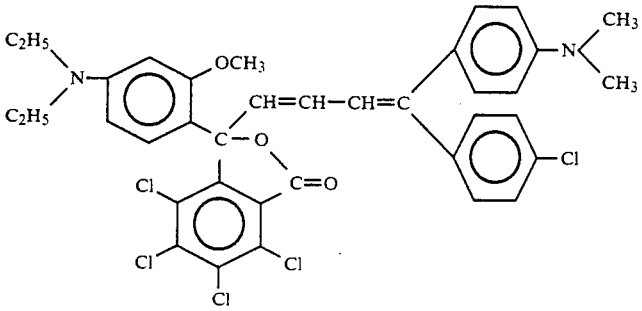

-continued

No. 91

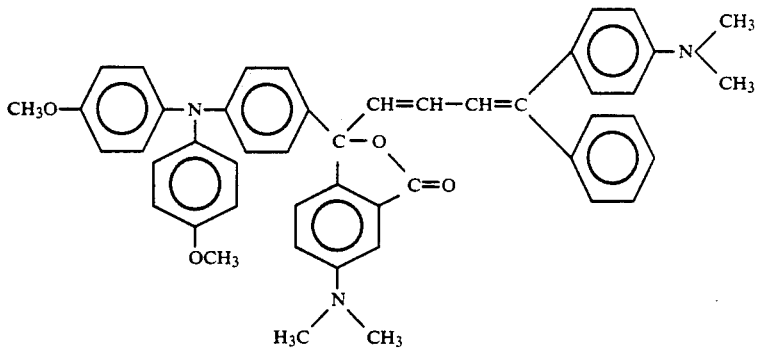

No. 92

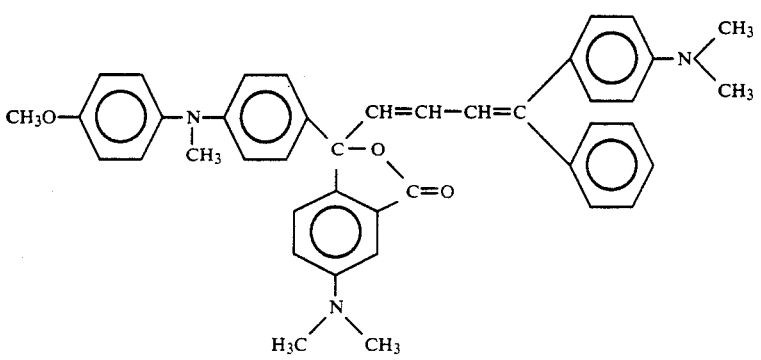

3. The thermosensitive recording material as claimed in claim 1, wherein said leuco dye having said formula (II) for use in said first thermosensitive coloring layer is selected from the group consisting of:

(1) 3,3-bis[2-(p-dimethylaminophenyl)-2-(phenylethenyl)-4,5,6,7-tetrachlorophthalide,
(2) 3,3-bis[2-(p-dimethylaminophenyl)-2-(p-methylphenyl)-ethenyl]-4,5,6,7-tetrachlorophthalide,
(3) 3,3-bis[2-(p-dimethylaminophenyl)-2-(p-methoxyphenyl)-ethenyl]-4,5,6,7-tetrachlorophthalide,
(4) 3,3-bis[2-(p-dimethylaminophenyl)-2-(p-ethoxyphenyl)-ethenyl-4,5,6,7-tetrachlorophthalide,
(5) 3,3-bis[2-(p-dimethylaminophenyl)-2-(m,p-dimethylphenyl)ethenyl]-4,5,6,7-tetrachlorophthalide,
(6) 3,3-bis[2-(p-dimethylaminophenyl)-2-(o-methyl-p-methoxyphenyl)ethenyl]-4,5,6,7-tetrachlorophthalide,
(7) 3,3-bis[2-(p-dimethylamino-o-methylphenyl)-2-phenylethenyl]-4,5,6,7-tetrachlorophthalide,
(8) 3,3-bis[2-(p-dimethylamino-o-chlorophenyl)-2-(p-methylphenyl)ethenyl]-4,5,6,7-tetrachlorophthalide,
(9) 3,3-bis[2-(p-dimethylaminophenyl)-2-(p-chlorophenyl)-ethenyl]-4,5,6,7-tetrachlorophthalide,
(10) 3,3-bis[2-(p-dimethylaminophenyl)-2-(o,p-dimethoxyphenyl)ethenyl]-4,5,6,7-tetrachlorophthalide,
(11) 3,3-bis[2-(p-methylbutylaminophenyl}-2-(p-methoxyphenyl)ethenyl]-4,5,6,7-tetrachlorophthalide,
(12) 3,3-bis[2-(p-dimethylaminophenyl)-2-(p-octylphenyl)-ethenyl]-4,5,6,7-tetrachlorophthalide,
(13) 3,3-bis[2-(p-dimethylaminophenyl)-2-(p-hexyloxyphenyl)ethenyl]-4,5,6,7-tetrachlorophthalide,
(14) 3,3-bis[2-(p-methylcyclohexylaminophenyl)-2-(p-methylphenyl)ethenyl]-4,5,6,7-tetrachlorophthalide,
(15) 3,3-bis[2-(p-ethylbenzylaminophenyl)-2-(p-methoxyphenyl)ethenyl]-4,5,6,7-tetrachlorophthalide,
(16) 3,3-bis[2-(p-dimethylaminophenyl)-2-phenylethenyl]-4,5,6,7-tetrabromophthalide,
(17) 3,3-bis[2-(p-dimethylaminophenyl)-2-phenylethenyl]-5-chloro-4,6,7-tribromophthalide, and
(18) 3,3-bis[2-(p-dimethylaminophenyl)-2-(p-methoxyphenyl)-ethenyl]-5,6-dichloro-4,7-dibromophthalide.

4. The thermosensitive recording material as claimed in claim 1, wherein said leuco dye having said formula (III) for use in said first thermosensitive coloring layer is selected from the group consisting of:

No. 1

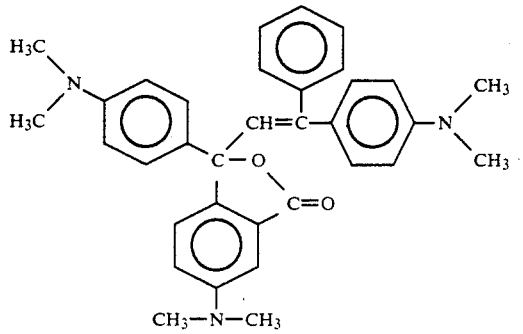

-continued
No. 2
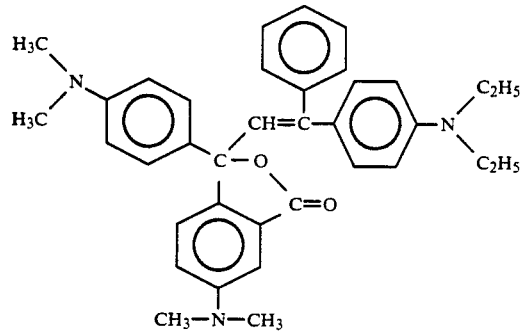
No. 3
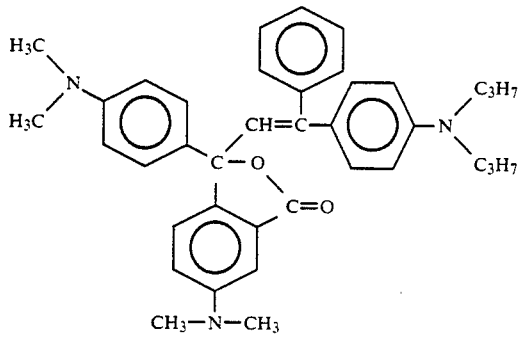
No. 4
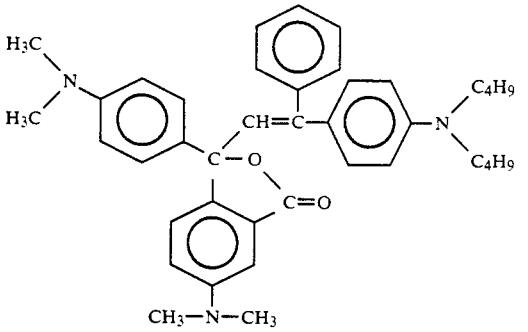
No. 5
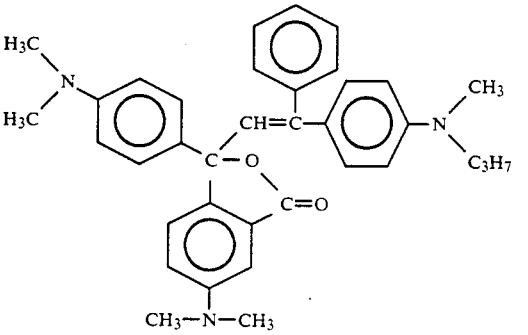

-continued
No. 6
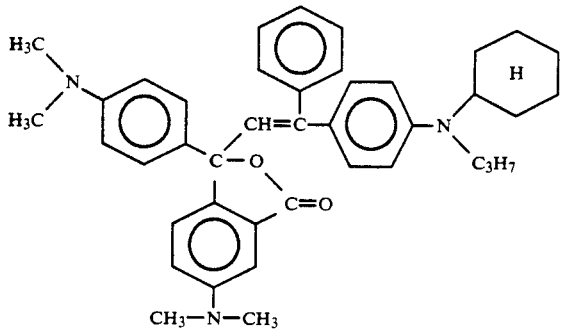
No. 7
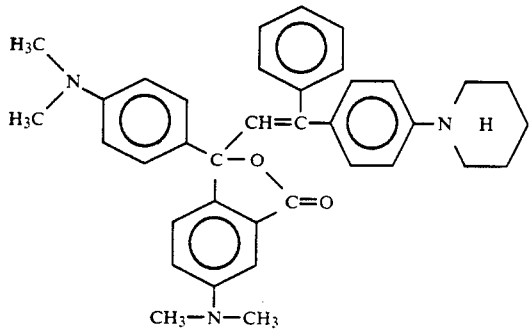
No. 8
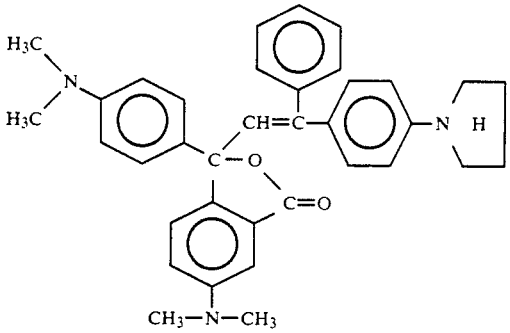
No. 9
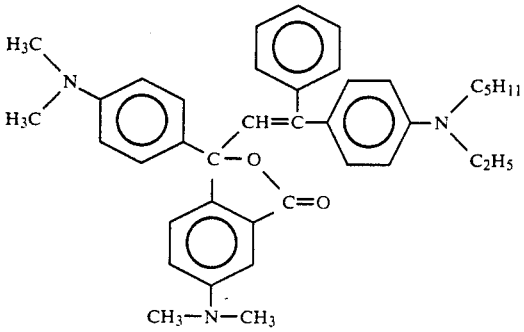

-continued
No. 10
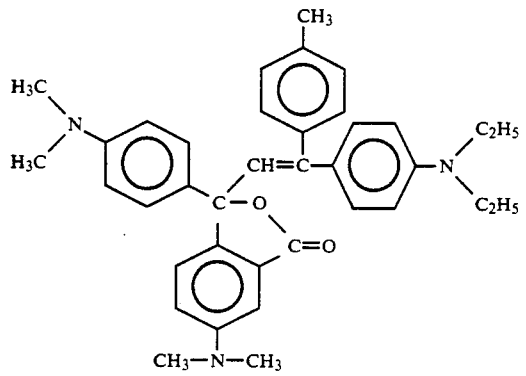
No. 11
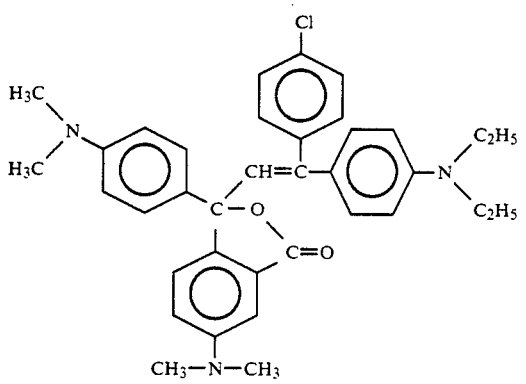
No. 12
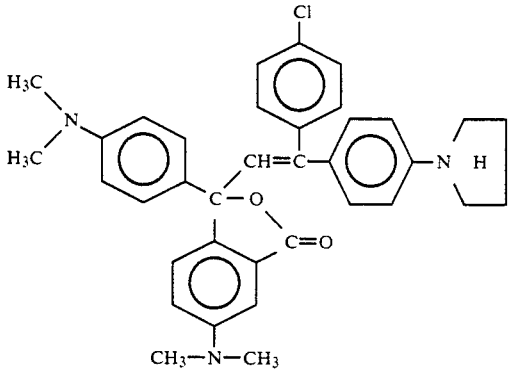
No. 13
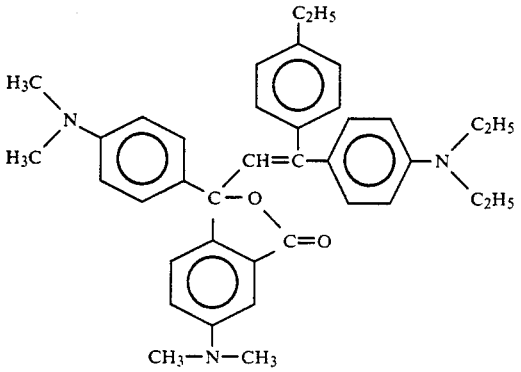

-continued
No. 14
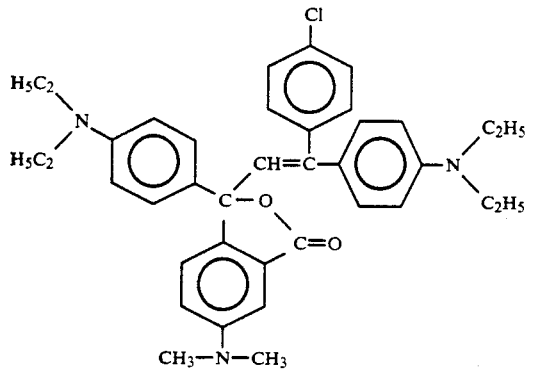
No. 15
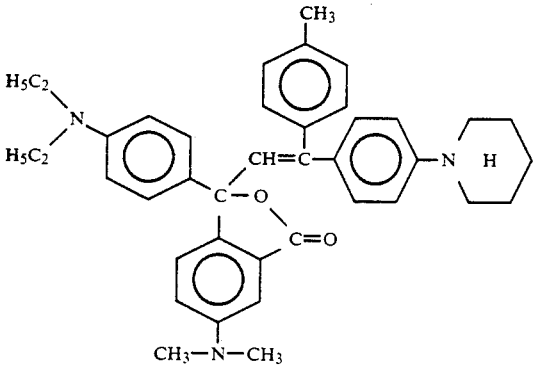
No. 16
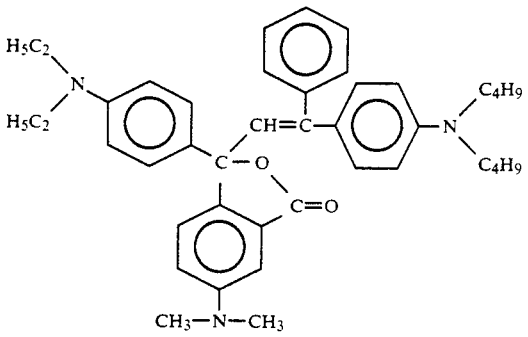
No. 17
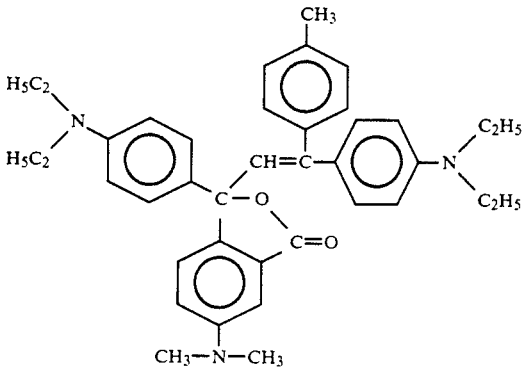

-continued
No. 18
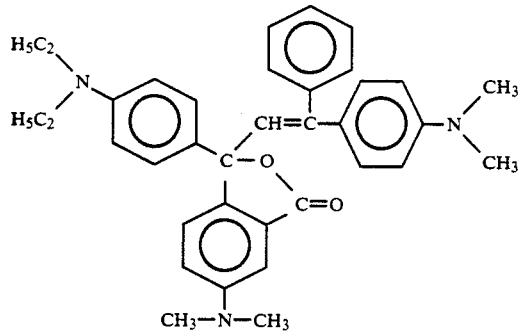
No. 19
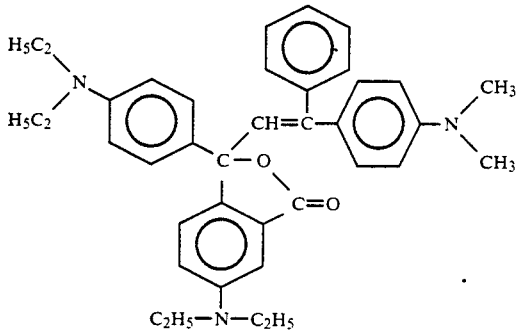
No. 20
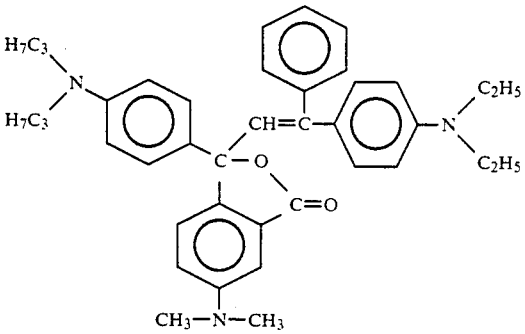
No. 21
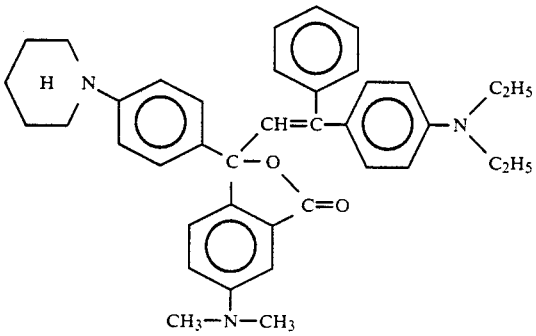

-continued
No. 22
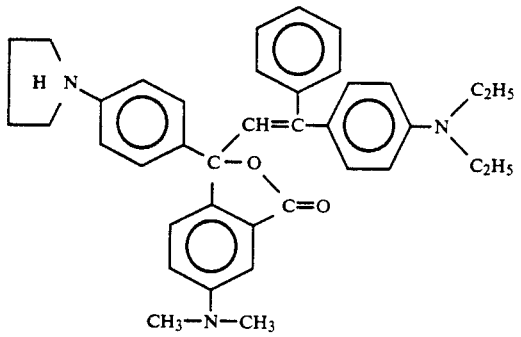
No. 23
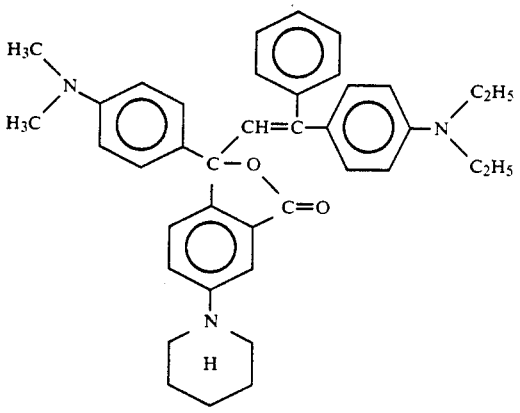
No. 24
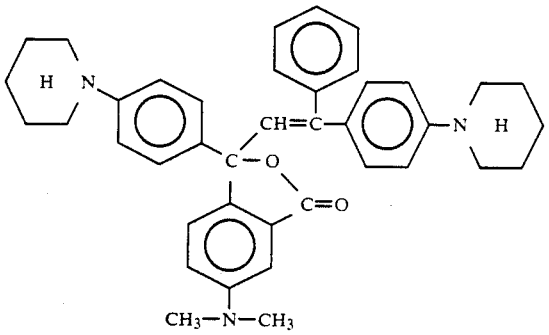
No. 25
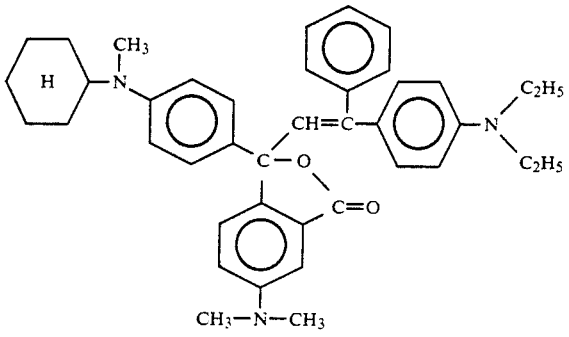

-continued
No. 26
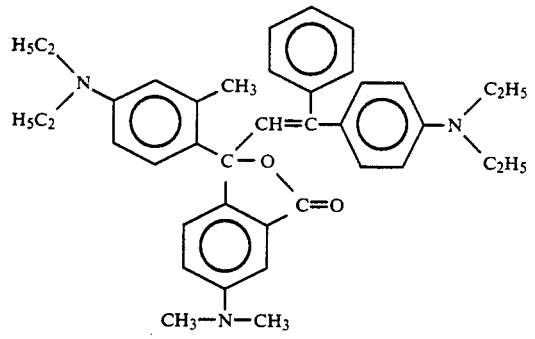
No. 27
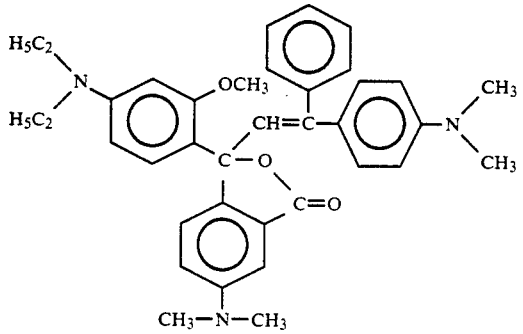
No. 28
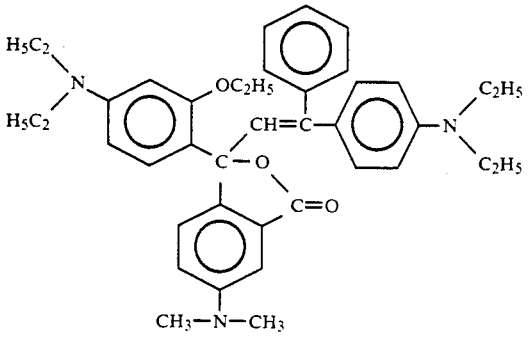
No. 29
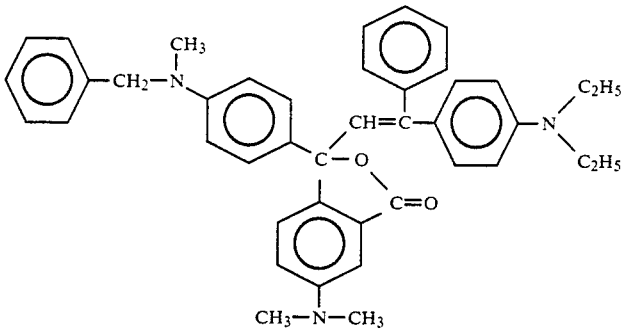
No. 30
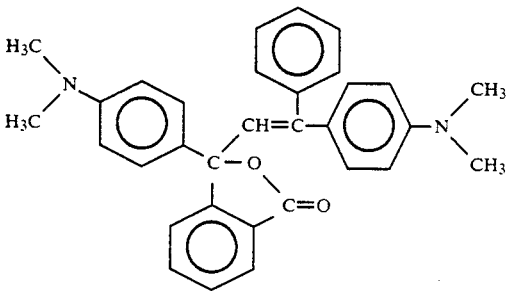

-continued
No. 31
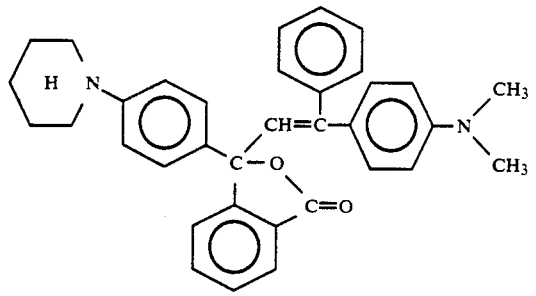
No. 32
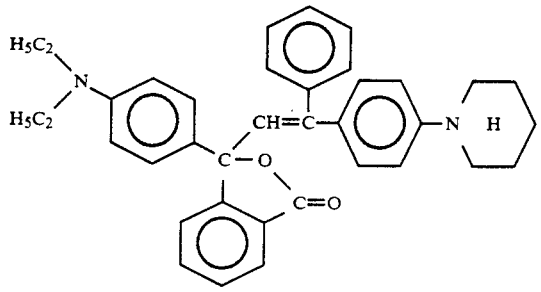
No. 33
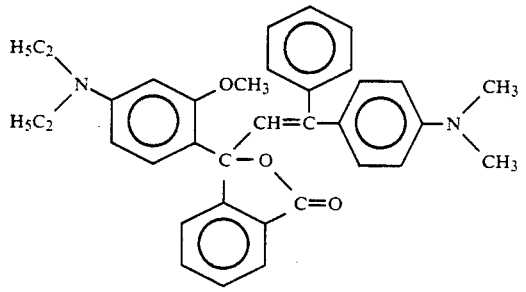
No. 34
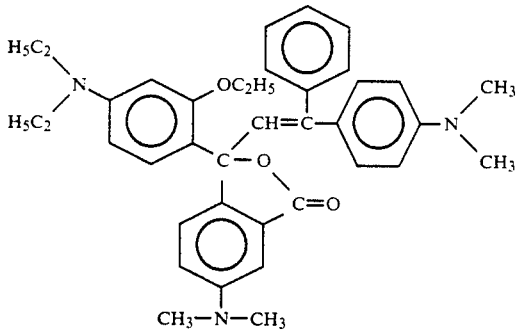
No. 35
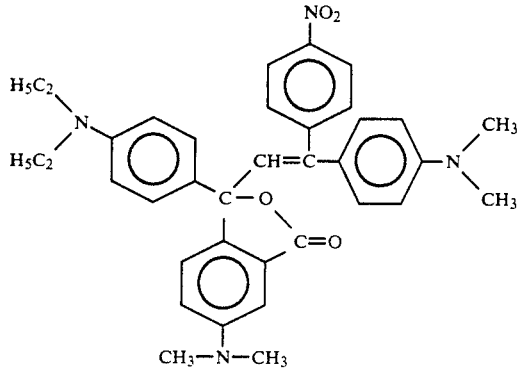

-continued
No. 36
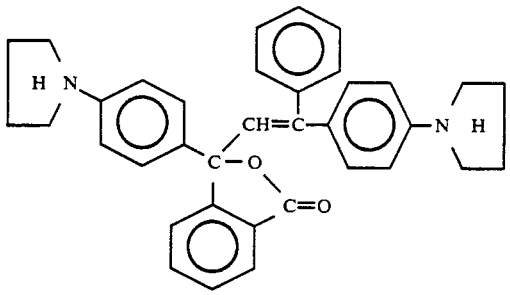
No. 37
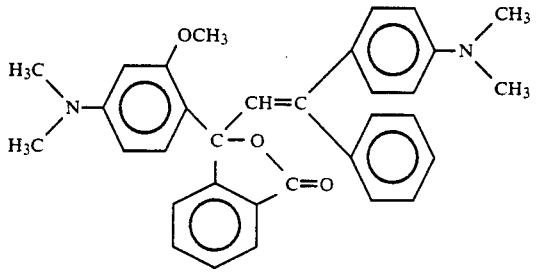
No. 38
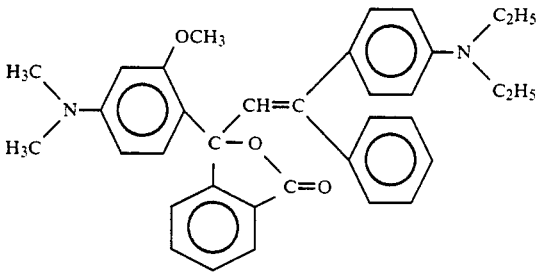
No. 39
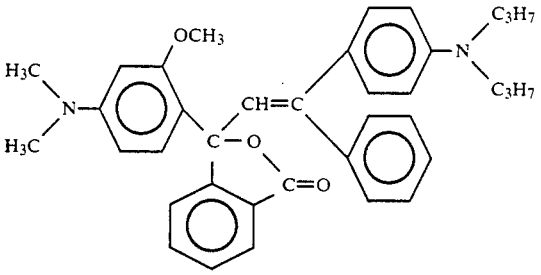
No. 40
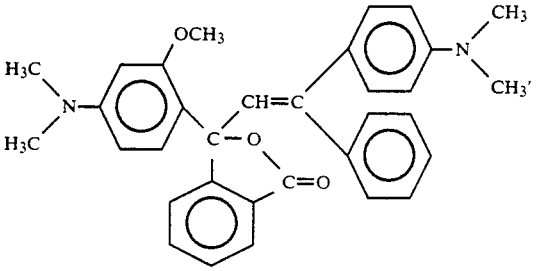

-continued
No. 41
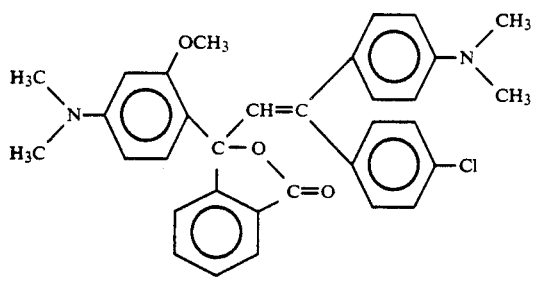
No. 42
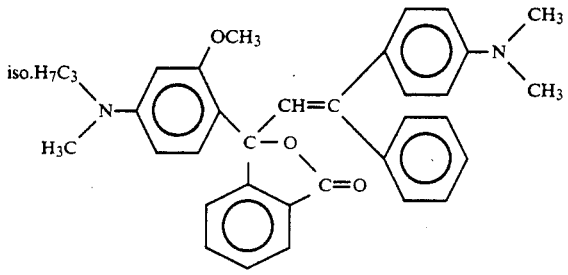
No. 43
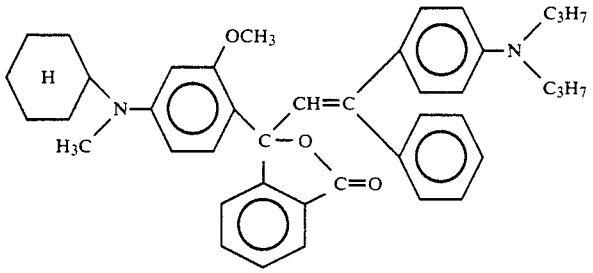
No. 44
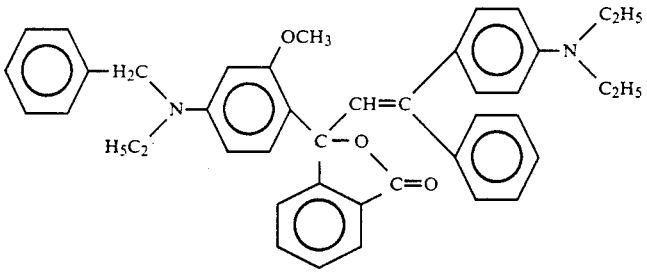
No. 45
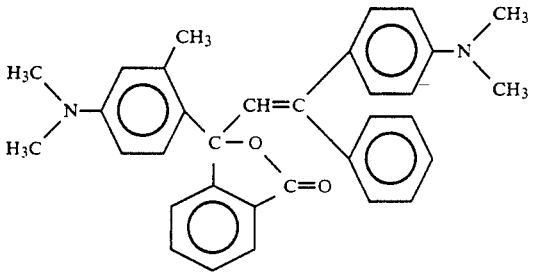

-continued
No. 46
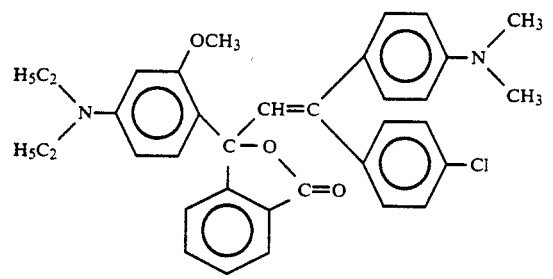
No. 47
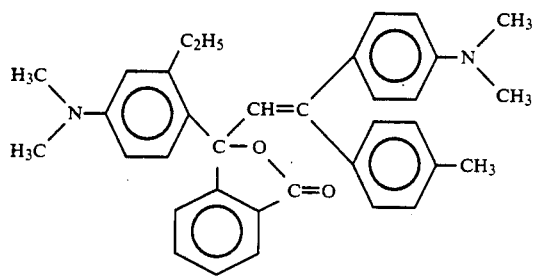
No. 48
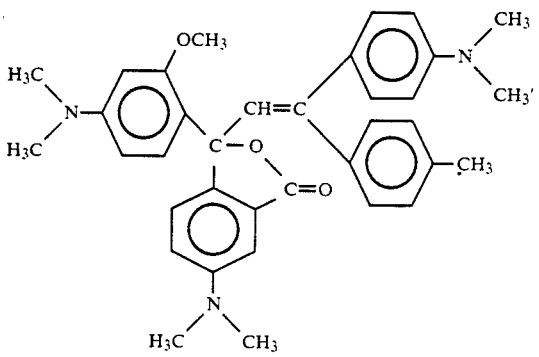
No: 49
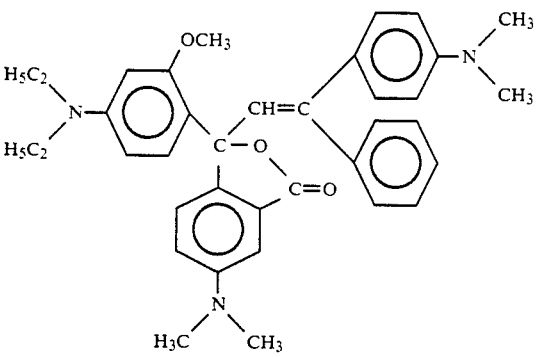
No. 50
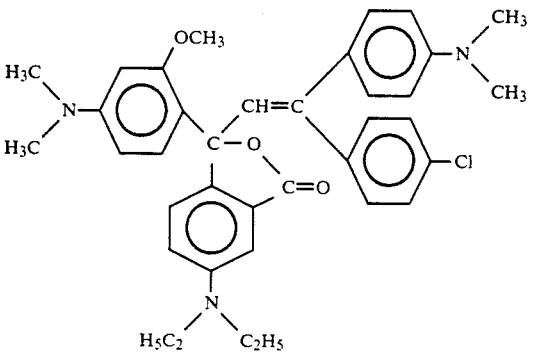

-continued
No. 51
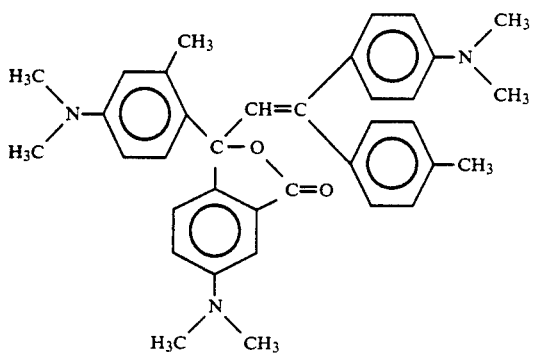
No. 52
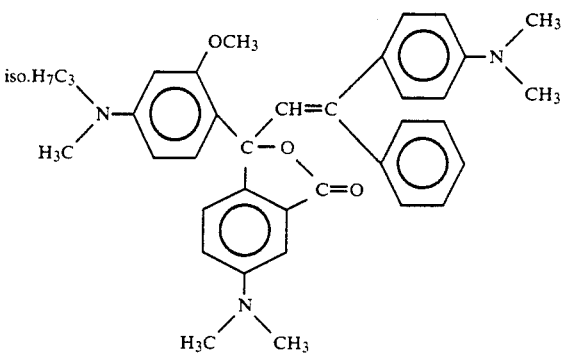
No. 53
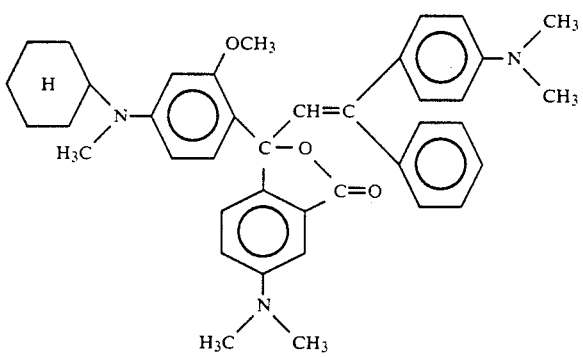
No. 54
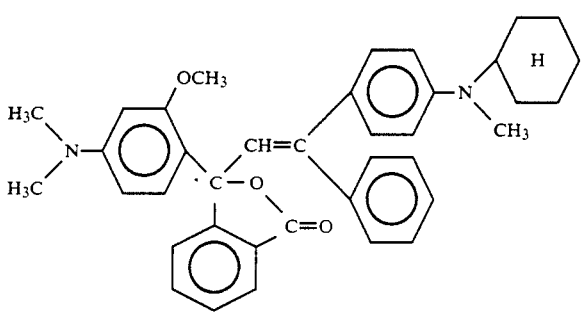

-continued
No. 55
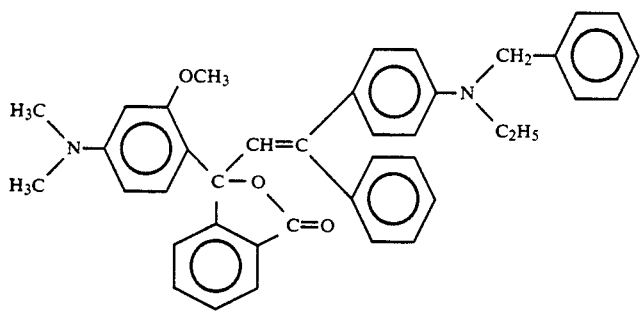
No. 56
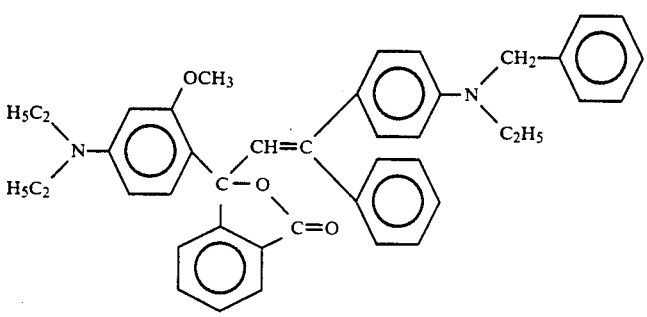
No. 57
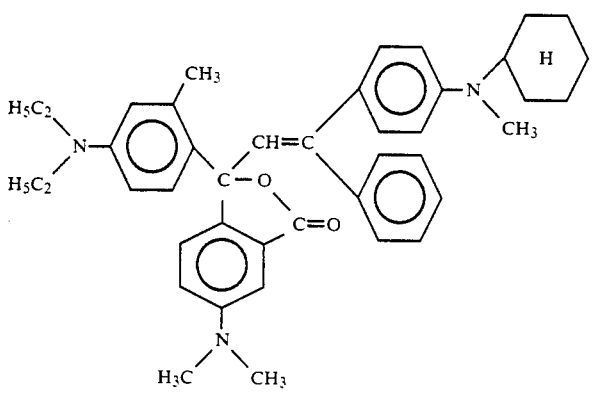
No. 58
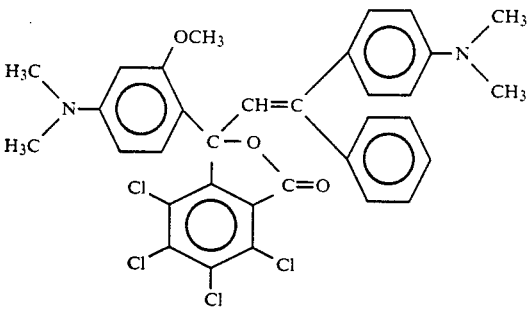
No. 59
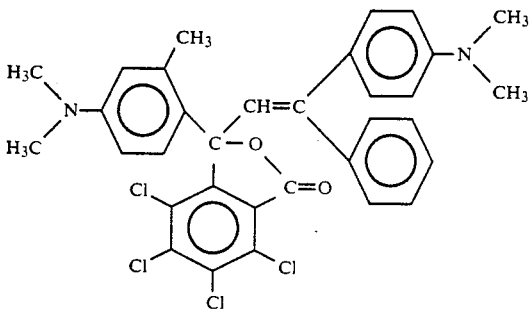

-continued

No. 60

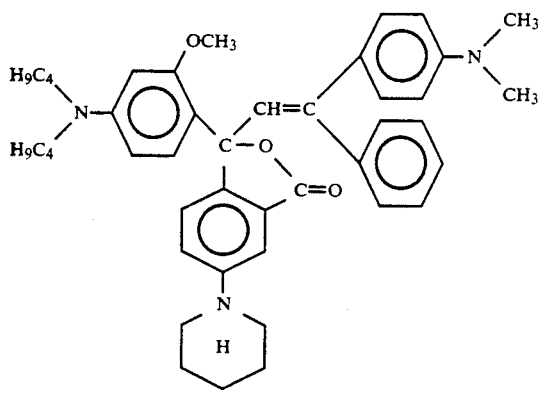

No. 61

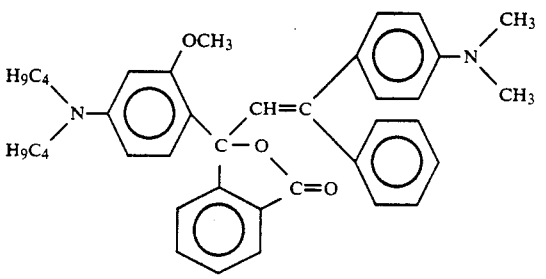

No. 62

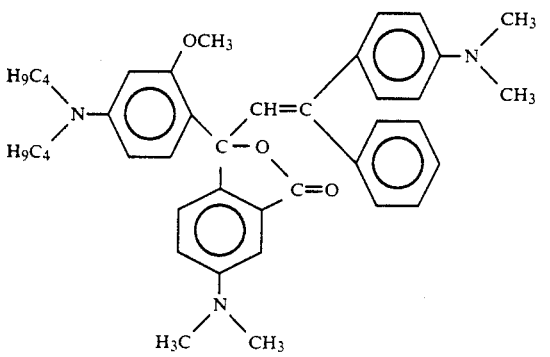

No. 63

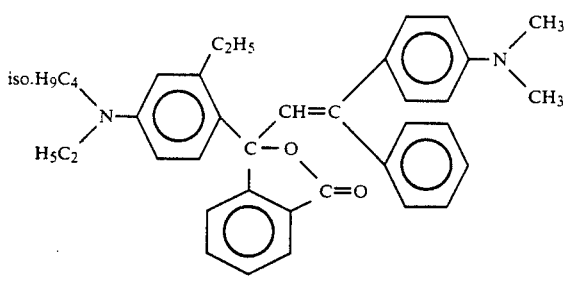

5. The thermosensitive recording material as claimed in claim 1, wherein said leuco dye having said formula (IV) for use in said second thermosensitive coloring layer is selected from the group consisting of:

3-{N-p-tolyl-N-ethylamino)-6-methyl-7-anilinofluoran,
3-diethylamino-6-methyl-7-(m-trifluoromethylanilino)-fluoran,
3-diethylamino-7-(o-chloroanilino)fluoran,
3-dibutylamino-7-(o-chloroanilino)fluoran,
3-N-methyl-N-acylamino-6-methyl-7-anilinofluoran,
3-N-methyl-N-cyclohexylamino-6-methyl-7-anilino-fluoran,
3-diethylamino-6-methyl-7-anilinofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran, and
3-diethylamino-6-methyl-7-mesidino-4',5'-benzofluo-ran.

6. The thermosensitive recording material as claimed in claim 1, further comprising an overcoat layer which is provided on said thermosensitive coloring layer.

7. The thermosensitive recording material as claimed in claim 1, further comprising an undercoat layer which is interposed between said support and said thermosensitive coloring layer.

8. The thermosensitive recording material as claimed in claim 1, further comprising a backcoat layer which is provided on the back side of said support opposite to said thermosensitive coloring layer.

* * * * *

UNITED STATES PATENT AND TRADEMARK OFFICE
CERTIFICATE OF CORRECTION

PATENT NO. : 5,250,493

DATED : October 5, 1993

INVENTOR(S) : Takashi Ueda, et al

It is certified that error appears in the above-identified patent and that said Letters Patent is hereby corrected as shown below:

Column 33-34, change Formula No. 65 to read

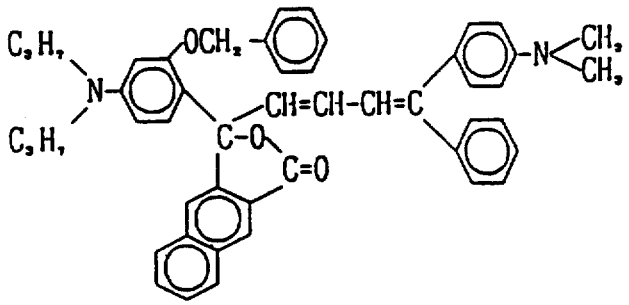

Column 43-44, change Formula No. 83 to read

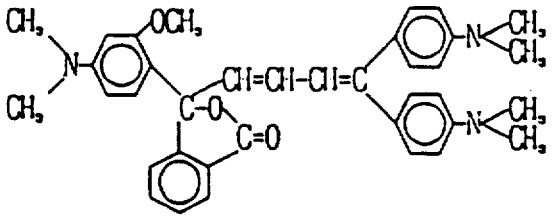

Column 43-44, change Formula No. 84 to read

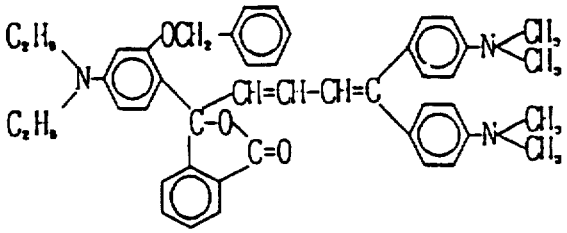

UNITED STATES PATENT AND TRADEMARK OFFICE

CERTIFICATE OF CORRECTION

PATENT NO. : 5,250,493

DATED : October 5, 1993

INVENTOR(S) : Takashi Ueda, et al

It is certified that error appears in the above-identified patent and that said Letters Patent is hereby corrected as shown below:

Column 43-44, change Formula No. 85 to read

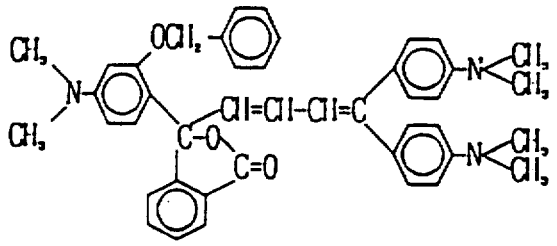

Column 43-44, change Formula No. 86 to read

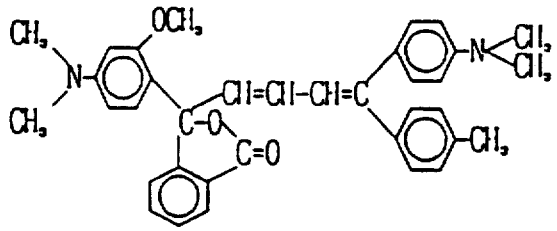

Column 45-46, change Formula No. 87 to read

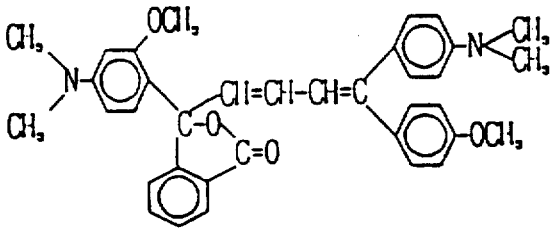

UNITED STATES PATENT AND TRADEMARK OFFICE
CERTIFICATE OF CORRECTION

PATENT NO. : 5,250,493

DATED : October 5, 1993

INVENTOR(S) : Takashi Ueda, et al

It is certified that error appears in the above-identified patent and that said Letters Patent is hereby corrected as shown below:

Column 45-46, change Formula No. 89 to read

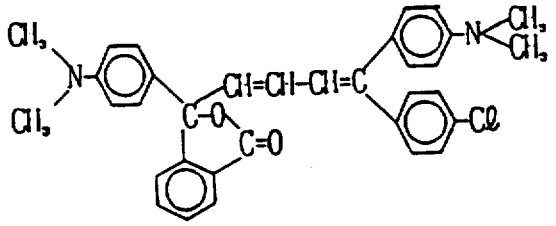

Column 82, Line 2, "replaced b the" should read --replaced by the--

Column 115-116, change Formula No. 65 to read

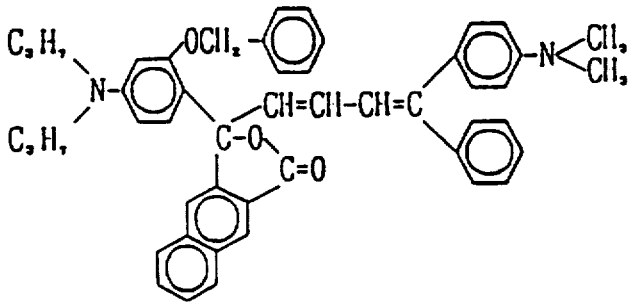

UNITED STATES PATENT AND TRADEMARK OFFICE

CERTIFICATE OF CORRECTION

PATENT NO. : 5,250,493

DATED : October 5, 1993

INVENTOR(S) : Takashi Ueda, et al

It is certified that error appears in the above-identified patent and that said Letters Patent is hereby corrected as shown below:

Column 125-126, change Formula No. 83 to read

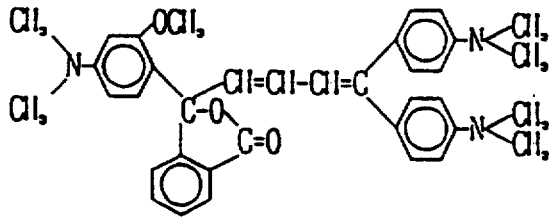

Column 125-126, change Formula No. 84 to read

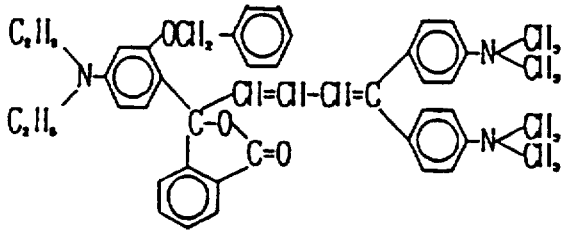

Column 125-126, change Formula No. 85 to read

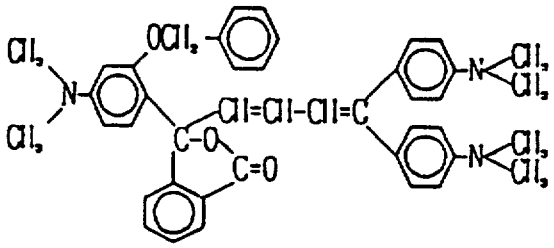

UNITED STATES PATENT AND TRADEMARK OFFICE
CERTIFICATE OF CORRECTION

PATENT NO. : 5,250,493

DATED : October 5, 1993

INVENTOR(S) : Takashi Ueda, et al

It is certified that error appears in the above-identified patent and that said Letters Patent is hereby corrected as shown below:

Column 125-126, change Formula No. 86 to read

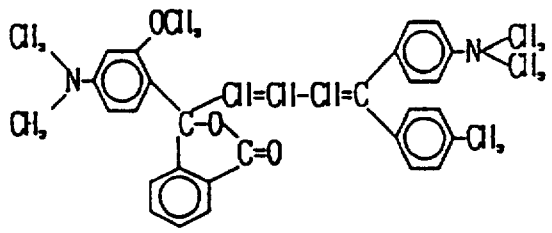

Column 127-128, change Formula No. 87 to read

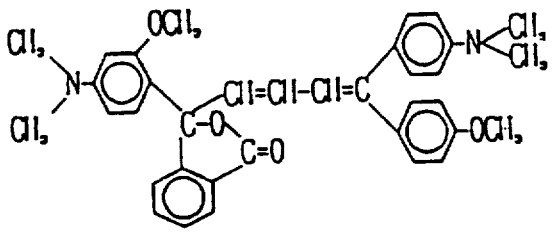

Column 127-128, change Formula No. 89 to read

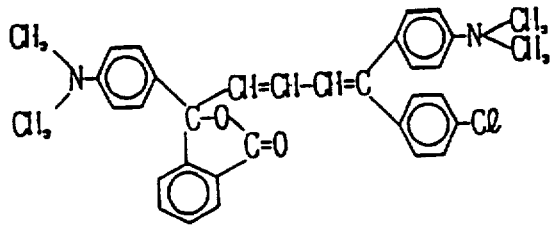

UNITED STATES PATENT AND TRADEMARK OFFICE

CERTIFICATE OF CORRECTION

PATENT NO. : 5,250,493

DATED : October 5, 1993

INVENTOR(S) : Takashi Ueda, et al

It is certified that error appears in the above-identified patent and that said Letters Patent is hereby corrected as shown below:

Column 129, Line 42, "ethenyl" should read --ethenyl]--

Column 157, Line 60, "3-(N-p-tolyl-N-ethylamino)" should read --3-(N-p-tolyl-N-ethylamino)--

Signed and Sealed this

Ninth Day of May, 1995

Bruce Lehman

*Attest:*

BRUCE LEHMAN

*Attesting Officer*

*Commissioner of Patents and Trademarks*